US009448501B2

(12) United States Patent
Inoue et al.

(10) Patent No.: US 9,448,501 B2
(45) Date of Patent: Sep. 20, 2016

(54) TONER FOR DEVELOPING ELECTROSTATIC IMAGE, IMAGE FORMING APPARATUS, IMAGE FORMING METHOD, AND PROCESS CARTRIDGE

(71) Applicants: Ryota Inoue, Shizuoka (JP); Yoshitaka Sekiguchi, Shizuoka (JP); Hiroaki Katoh, Kyoto (JP); Shun Saito, Shizuoka (JP)

(72) Inventors: Ryota Inoue, Shizuoka (JP); Yoshitaka Sekiguchi, Shizuoka (JP); Hiroaki Katoh, Kyoto (JP); Shun Saito, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/373,396

(22) PCT Filed: Feb. 7, 2013

(86) PCT No.: PCT/JP2013/053604

§ 371 (c)(1),
(2) Date: Jul. 21, 2014

(87) PCT Pub. No.: WO2013/125450

PCT Pub. Date: Aug. 29, 2013

(65) Prior Publication Data

US 2014/0363209 A1 Dec. 11, 2014

(30) Foreign Application Priority Data

Feb. 21, 2012 (JP) ..... 2012-035251
Dec. 28, 2012 (JP) ..... 2012-286922

(51) Int. Cl.
*G03G 9/087* (2006.01)
*G03G 9/08* (2006.01)

(52) U.S. Cl.
CPC ..... *G03G 9/08755* (2013.01); *G03G 9/0821* (2013.01); *G03G 9/08795* (2013.01); *G03G 9/08797* (2013.01); *G03G 2215/0629* (2013.01)

(58) Field of Classification Search
CPC ..... G03G 9/08759; G03G 9/08764; G03G 9/08795; G03G 9/09328; G03G 9/09342; G03G 9/09371; G03G 9/09378; G03G 9/09385; G03G 9/09716; G03G 9/09725
See application file for complete search history.

(56) References Cited

U.S. PATENT DOCUMENTS 5,763,130 A * 6/1998 Sasaki ..... G03G 9/09328 430/109.5
7,846,633 B2 12/2010 Nakamura et al.
(Continued)

FOREIGN PATENT DOCUMENTS

JP 63-038955 2/1988
JP 04-024702 4/1992
(Continued)

OTHER PUBLICATIONS

Translation of JP 2006-267231 published Oct. 2006.*
(Continued)

*Primary Examiner* — Peter Vajda
(74) *Attorney, Agent, or Firm* — Oblon, McClelland, Maier & Neustadt, L.L.P

(57) ABSTRACT

A toner for developing an electrostatic image, which contains: resin particles (C), wherein the resin particles (C) each contain a resin particle (B) and resin particles (A) or a coating film (P) deposited on a surface of the resin particle (B), where the resin particle (B) contains a second resin (b) and a filler (f), wherein the resin particles (A) or the coating film (P) contains a first resin (a), wherein the second resin (b) contains a crystalline resin, and wherein the resin particle (B) contains the filler (f) in an amount of 15% by mass or greater.

15 Claims, 3 Drawing Sheets

(56) References Cited

U.S. PATENT DOCUMENTS

| | | | | |
|---|---|---|---|---|
| 2001/0046636 | A1 | 11/2001 | Daimon et al. | |
| 2002/0037468 | A1 | 3/2002 | Matsushima et al. | |
| 2006/0216628 | A1 | 9/2006 | Nakamura et al. | |
| 2008/0102395 | A1 * | 5/2008 | Ohmura | G03G 9/08755 430/109.4 |
| 2011/0281209 | A1 | 11/2011 | Sugiura et al. | |
| 2012/0282000 | A1 | 11/2012 | Nakayama et al. | |

FOREIGN PATENT DOCUMENTS

| | | | |
|---|---|---|---|
| JP | 04-024703 | 4/1992 | |
| JP | 09-329917 | 12/1997 | |
| JP | 2001-305796 | 11/2001 | |
| JP | 3360527 | 12/2002 | |
| JP | 2004-038115 | 2/2004 | |
| JP | 2005-173063 | 6/2005 | |
| JP | 2006-267231 | * 10/2006 | G03G 9/08 |
| JP | 2010-077419 | 4/2010 | |
| JP | 4513627 | 7/2010 | |
| JP | 2011-123344 | 6/2011 | |
| JP | 2011-257738 | 12/2011 | |
| JP | 4929411 | 5/2012 | |
| WO | WO2012/011546 A1 | 1/2012 | |

OTHER PUBLICATIONS

Extended European Search Report issued Mar. 18, 2015 in Patent Application No. 13762328.8.

International Search Report Issued for counterpart International Patent Application No. PCT/JP2013/053604 dated Mar. 26, 2013, filed Feb. 7, 2013.

Office Action issued on Jan. 18, 2016 in Korean Patent Application No. 10-2014-7025866 with English translation.

* cited by examiner

TONER FOR DEVELOPING ELECTROSTATIC IMAGE, IMAGE FORMING APPARATUS, IMAGE FORMING METHOD, AND PROCESS CARTRIDGE

TECHNICAL FIELD

The present invention relates to a toner for developing an electrostatic image used for electrophotographic image formation such as by a photocopier, electrostatic printing, a printer, a facsimile, and electrostatic recording, and relates to an image forming apparatus, image forming method, and process cartridge using the toner for developing an electrostatic image.

BACKGROUND ART

Conventionally, a latent image formed electrically or magnetically in an electrophotographic image forming apparatus is visualized with an electrophotographic toner (may referred to as a "toner for developing an electrostatic image" or merely as a "toner" hereinafter). In the electrophotography, for example, an electrostatic image (a latent image) is formed on a photoconductor, followed by developing the latent image with a toner, to thereby form a toner image. The toner image is generally transferred to a transfer medium, such as paper, followed by fixed on the transfer medium, such as paper. In the process of fixing the toner image on the transfer paper, a thermal fixing system, such as a heat roller fixing system, and a heat belt fixing system, is widely used because of its energy efficiency.

Recently, in the market, there is an increasing need for increased printing speed and energy saving of image forming apparatuses. To this end, desired is a toner having excellent low temperature fixing ability, and capable of providing high quality images. To achieve low temperature fixing ability of a toner, a softening point of a binder resin used in the toner needs to be set low. When the softening point of the binder resin is low, however, part of a toner image tends to be deposited on a surface of a fixing member during fixing, which will then be transferred to a photocopy sheet, which is so-called offset (may be referred to as "hot offset" hereinafter). Moreover, blocking, which is a phenomenon that heat resistant storage stability of a toner reduces, and thus toner particles are fused to each other especially in a high temperature environment, tends to occur. In addition, there is a problem that a toner is fused on an internal area of a developing unit or a regulating member of the developing unit to pollute inside the developing unit, and a problem that toner filming is caused on a photoconductor.

As a technique to solve these problems, it has been known that a crystalline resin is used as a binder resin of a toner. Specifically, the crystalline resin sharply softens at a melting point of the resin, and therefore a softening point of the toner can be reduced to adjacent to the melting point while securing heat resistant storage stability at temperature equal to or lower than the melting point. Therefore, the low temperature fixing ability and heat resistant storage stability are both achieved.

As a toner using a crystalline resin, for example, disclosed is a toner using, as a binder resin, a crystalline resin obtained through a chain elongation of crystalline polyester with diisocyanate (see PTL 1 and PTL 2). These disclosed toners have excellent low temperature fixing ability, but insufficient hot offset resistance, and therefore do not reach the quality required in the recent market.

Moreover, disclosed is a toner using a crystalline resin having a crosslink structure formed by an unsaturated bond containing a sulfonic acid group (see PTL 3). This toner can improve hot offset resistance compared to toners in the conventional art. Further, disclosed is a technique associated resin particles having excellent low temperature fixing ability and heat resistant storage stability in which a ratio of softening point and melt heat peak temperature, and viscoelastic property are specified (see PTL 4).

These toners using a crystalline resin as a main component of a binder resin have excellent impact resistance due to the properties of the resin, but have weak impression hardness, such as Vickers hardness. Therefore, there are problems that pollution to a regulating member or inside a developing unit is caused due to stirring stress within the developing unit, filming is caused on a, photoconductor, and charging ability or flowability of the toner tends to be impaired due to embedded external additive to toner particles. Moreover, it takes a long time for the toner melted on a fixing medium (transfer medium) during thermal fixing to recrystallize, and therefore hardness of a surface of an image cannot be promptly recovered. As a result, there are problems that variations in glossiness due to a roller mark formed on the surface of the image or damage are caused by a discharge roller in discharging after fixing. Moreover, the hardness is not sufficient even after the hardness of the surface of the image is recovered by recrystallization of the toner, a resulting image does not have sufficient resistance to scratches or abrasion.

Further, disclosed is a technique for improving stress resistance of a toner by specifying duro mater hardness of a crystalline resin, and adding inorganic particles in the toner (see PTL 5).

However, such toner cannot improve damages (image transport damage) of a roller mark just after fixing, and image hardness after recrystallization is also insufficient. Moreover, the inorganic particles significantly adversely affect low temperature fixing ability of the toner, and therefore an advantage of the crystalline resin to the fixing ability cannot be utilized at the maximum level.

Meanwhile, disclosed are various techniques in which a crystalline resin and a non-crystalline resin are used in combination, unlike the aforementioned conventional art using only a crystalline resin as a main component of a binder resin (see, for example, PTL 6 and PTL 7). These toners can compensate the disadvantage of the crystalline resin in terms of hardness with the non-crystalline resin, but there is a problem that an effect of the crystalline resin to low temperature fixing ability cannot be exhibited at the maximum level.

CITATION LIST

Patent Literature

PTL 1: Japanese Patent Publication Application (JP-B) No. 04-024702
PTL 2: JP-B No. 04-024703
PTL 3: Japanese Patent Application Laid-Open (JP-A) No. 2001-305796
PTL 4: JP-A No. 2010-077419
PTL 5: JP-A No. 09-329917

SUMMARY OF INVENTION

Technical Problem

The present invention aims to solve the aforementioned problems in the art, and achieve the following object.

An object of the present invention is to provide a toner for developing an electrostatic image, which solves the problems originated from a crystalline resin in the toner containing the crystalline resin as a main component of a resin, such as insufficient stress resistance of the toner, image transporting damages formed during re-crystallization just after thermal fixing, and insufficient hardness of an output image, without adversely affecting low temperature fixing ability of the toner, and which has excellent low temperature fixing ability, hot offset resistance, heat resistant storage stability, environmental variability, transfer properties, resistance to image transporting damage, and stress resistance.

Solution to Problem

A toner for developing an electrostatic image, comprising:

resin particles (C), wherein resin particles (C) each contain a resin particle (B) and resin particles (A) or a coating film (P) deposited on a surface of the resin particle (B), where the resin particle (B) contains a second resin (b) and a filler (f), wherein the resin particles (A) or the coating film (P) contains a first resin (a), wherein the second resin (b) contains a crystalline resin, and wherein the resin particle (B) contains the filler (f) in an amount of 15% by mass or greater.

Advantageous Effects of Invention

The present invention can provide a toner for developing an electrostatic image, which solves the problems originated from a crystalline resin in the toner containing the crystalline resin as a main component of a resin, such as insufficient stress resistance of the toner, image transporting damages formed during re-crystallization just after thermal fixing, and insufficient hardness of an output image, without adversely affecting low temperature fixing ability of the toner, and which has excellent low temperature fixing ability, hot offset resistance, heat resistant storage stability, environmental variability, transfer properties, resistance to image transporting damage, and stress resistance.

Figure 1A:
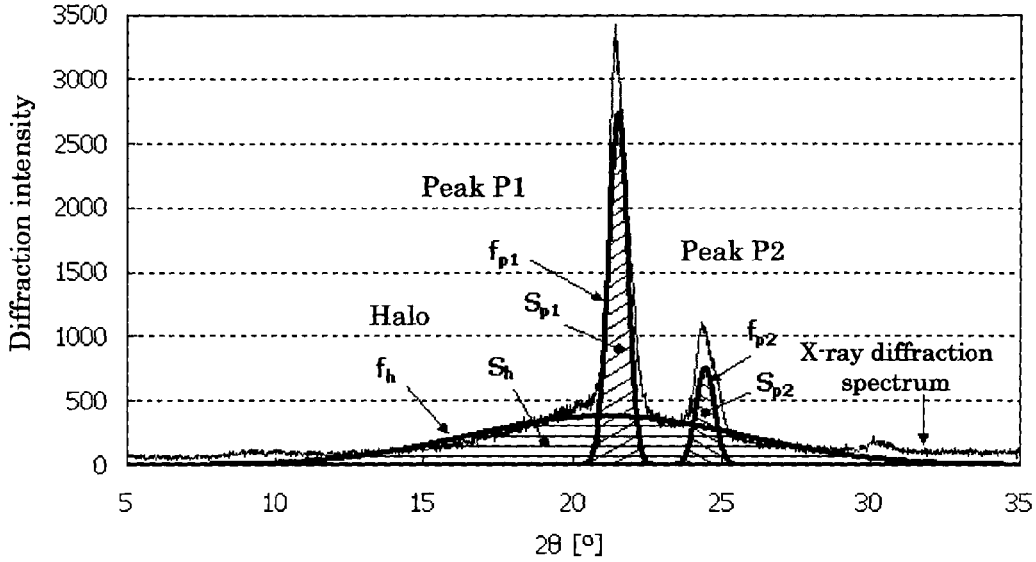
FIG. 1A is a graph depicting an example of a diffraction spectrum obtained by X-ray diffraction spectroscopy.

DESCRIPTION OF EMBODIMENTS (Toner for Developing Electrostatic Image)

The toner for developing an electrostatic image of the present invention contains: resin particles (C), wherein the resin particles (C) each contain a resin particle (B) and resin particles (A) or a coating film (P) deposited on a surface of the resin particle (B), where the resin particle (B) contains a second resin (b) and a filler (f), wherein the resin particles (A) or the coating film (P) contains a first resin (a) that is different from the second resin (b), wherein the second resin (b) contains a crystalline resin, and wherein the resin particle (B) contains the filler (f) in an amount of 15% by mass or greater.

Specifically, the resin particle (C) constituting the toner for developing an electrostatic image according to the present invention has the structure of either (1) or (2) described below.

(1): A structure where resin particles (A) containing at least a first resin (a) are deposited on a surface of a resin particle (B) containing a second resin (b) and a filler (f).

(2): A structure where a coating film (P) containing a first resin (a) is provided on a surface of a resin particle (B) containing a second resin (b) and a filler (f).

In the toner of the present invention, the first resin (a) is a polyester resin, and the polyester resin is preferably composed of polybasic acid, and polyhydric alcohol.

The toner for developing an electrostatic image (may be referred to merely as "toner" hereinafter) according to the present invention, as well as the image forming apparatus, image forming method and process cartridge using the toner will be specifically explained next.

<Second Resin (b)>

The second resin (b) is appropriately selected depending on the intended purpose without any limitation, provided that it is the second resin (b) containing a crystalline resin therein. As for the second resin (b), the crystalline resin and a non-crystalline resin may be used in combination. It is preferred that a main component of the second resin (b) be substantially the crystalline resin.

An amount of the crystalline resin in the second resin (b) is appropriately selected depending on the intended purpose without any limitation, but it is preferably 50% by mass or greater, more preferably 65% by mass or greater, even more preferably 80% by mass or greater, and particularly preferably 95% by mass or greater, to exhibit an effect of the crystalline resin to give both low temperature fixing ability and heat resistant storage stability to a resulting toner, as much as possible. When the amount thereof is smaller than 50% by mass, thermal sharpness of the second resin (b) cannot be shown with the viscoelastic properties of a toner, and therefore it may be difficult to achieve both low temperature fixing ability and heat resistant storage stability of the toner.

In the present specification, the term "crystallinity" or "crystalline" means characteristics that it sharply softens with heat, and, for example, is represented by a ratio of 0.8 to 1.55, where the ratio is a ratio (softening temperature [° C.]/maximum peak temperature of heat of melting [° C.]) of the softening temperature measured by an elevated flow tester to the maximum peak temperature of heat of melting measured by a differential scanning calorimeter (DSC). The resin having such characteristics is defined as a "crystalline resin."

Moreover, the term "non-crystallinity" or "non-crystalline" means characteristics that it gradually softens with heat, and, for example, is represented by a ratio of greater than 1.55, where the ratio is a ratio (softening temperature [° C.]/maximum peak temperature of heat of melting [° C.]) of the softening temperature measured by an elevated flow tester to the maximum peak temperature of heat of melting measured by a differential scanning calorimeter (DSC). The resin having such characteristics is defined as a "non-crystalline resin."

Note that, softening points of various resins and the toner can be measured by means of an elevated flow tester (e.g., CFT-500D (manufactured by Shimadzu Corporation)). As a sample, 1 g of a resin or a toner is used. The sample is heated at the heating rate of 6° C./min., and at the same time, load of 1.96 Mpa is applied by a plunger to extrude the sample from a nozzle having a diameter of 1 mm and length of 1 mm, during which an amount of the plunger of the flow tester pushed down relative to the temperature is plotted. The temperature at which half of the sample is flown out is determined as a softening point of the sample.

—Crystalline Resin—

The crystalline resin is appropriately selected depending on the intended purpose without any limitation, provided that it has crystallinity. Examples thereof include a polyester resin, a polyurethane resin, a polyurea resin, a polyamide resin, a polyether resin, a vinyl resin, and a modified crystalline resin. These may be used alone, or in combination. Among them, preferred are a polyester resin, a polyurethane resin, a polyurea resin, a poly amide resin, and a poly ether, and the crystalline resin is preferably a resin having at least a urethane skeleton, or a urea skeleton, or both thereof. Moreover, a straight chain polyester resin, and a composite resin containing the straight chain polyester resin are preferable.

Preferable examples of the resin having at least a urethane skeleton, or a urea skeleton, or both thereof include a polyurethane resin, a polyurea resin, a urethane-modified polyester resin, and a urea-modified polyester resin.

The urethane-modified polyester resin is a resin obtained by reacting a polyester resin having an isocyanate group at a terminal thereof with polyol. Moreover, the urea-modified polyester resin is a resin obtained by reacting a polyester resin having an isocyanate group at a terminal thereof with amine.

As for viscoelastic properties of the crystalline resin, the storage elastic modulus G' of the crystalline resin at the temperature that is (maximum peak temperature of heat of melting)+20° C. is preferably $5.0\times10^6$ Pa·s or lower, more preferably $1.0\times10^1$ Pa·s to $5.0\times10^5$ Pa·s, and even more preferably $1.0\times10^1$ Pass to $1.0\times10^4$ Pa·s. Moreover, the loss elastic modulus G" of the crystalline resin at the temperature that is (maximum peak temperature of heat of melting)+20° C. is preferably $5.0\times10^6$ Pa·s or lower, more preferably $1.0\times10^1$ Pa·s to $5.0\times10^5$ Pa·s, and even more preferably $1.0\times10^1$ Pa·s to $1.0\times10^4$ Pa·s. As for the viscoelastic properties of the toner of the present invention, the values of G' and G" of the toner at the temperature that is (maximum peak temperature of heat of melting)+20° C. are preferably both in the range of $1.0\times10^3$ Pa·s to $5.0\times10^6$ Pa·s in view of fixing strength and hot offset resistance. Considering an increase in G' and G" as a result of that a colorant or layered inorganic mineral is dispersed in the binder resin, the viscoelastic properties of the crystalline resin are preferably in the aforementioned ranges.

The viscoelastic properties of the crystalline resin can be adjusted by adjusting a blending ratio of a crystalline monomer and a non-crystalline monomer constituting the resin, or adjusting a molecular weight of the resin. For example, the value of G' (Ta+20) decreases, as a blending ratio of the crystalline monomer increases.

Dynamic viscoelastic values (storage elastic modulus G', loss elastic modulus G") of the resin and toner can be measured by means of a dynamic viscoelastometer (e.g., ARES of TA Instruments Japan Inc.). The measurement is carried out with a frequency of 1 Hz. A sample is formed into a pellet having a diameter of 8 mm, and a thickness of 1 mm to 2 mm, and the pellet sample is fixed to a parallel plate having a diameter of 8 mm, followed by stabilizing at 40° C. Then, the sample is heated to 200° C. at the heating rate of 2.0° C./min. with frequency of 1 Hz (6.28 rad/s), and strain of 0.1% (in a strain control mode) to thereby measure dynamic viscoelastic values of the sample.

As a result of the researches conducted by the present invention, it has been found that the characteristic of a toner using a crystalline resin as a main component of the binder resin that it sharply melts at temperature equal to or higher than a melting point, which is conventionally considered as effective to low temperature fixing ability, may be a factor for significantly varying a fixable temperature range depending on types of paper. It has also found by the present inventors that fixing can be performed at constant temperature and at constant speed regardless of types of paper by adding a high molecular weight component, compared to a molecular weight of a binder resin used for a conventional toner having excellent low temperature fixing ability, i.e., a component having a polystyrene conversion molecular weight of 100,000 or greater as measured by gel permeation chromatography (GPC), in a certain amount or greater, and adjusting the weight average molecular weight in a certain range.

An amount of the component having a molecular weight of 100,000 or greater is preferably 2% or greater, more preferably 5% or greater, and even more preferably 9% or greater. By using the component having a molecular weight of 100,000 or greater in an amount of 2% or greater, fluidity or viscoelasticity of the toner after melting has less temperature dependency, and therefore a difference in the fluidity or viscoelasticity of the toner is hardly formed whether paper for use is thin paper through which heat is easily transmitted during fixing, or thick paper through which it is difficult to transmit heat. Accordingly, a fixing device can carry out fixing at constant temperature and at constant speed. When the amount of the component having a molecular weight of 100,000 or greater is smaller than 2%, fluidity or viscoelasticity of the toner after belting significantly varies depending on temperature. For example, in the case where fixing is performed on thin paper, deformation of the toner is excessively large, and therefore contact area of the toner to the fixing member increases. As a result, the toner image cannot be desirably released from the fixing member, and paper may be wrapped around the fixing member.

The following is considered as a reason for enabling fixing at constant temperature and at constant speed regardless of types of paper. Specifically, the crystalline resin has sharp melt characteristics as mentioned earlier, but the internal cohesive power or viscoelasticity of the melted toner varies depending on a molecular weight or structure of a resin. In the case where the resin has a urethane bond or urea bond, which is a linking group having large cohesive force, for example, the resin acts as a rubber-like elastic body in the melted state as long as it is relatively low temperature. On the other hand, thermal motion energy of the polymer chain increases as the temperature increases, and therefore aggregation between bonds generally breaks down and the state thereof becomes close to an elastic body.

If such resin is used as a binder resin for a toner, fixing may be carried out without any problem when the fixing temperature is low, but so-called hot offset may occur when the fixing temperature is high, because internal cohesive force of the melted toner is small. The hot offset is a phenomenon that an upper side of a toner image is deposited onto a fixing member during fixing. Therefore, quality of a resulting image is significantly impaired. When urethane bond or urea bond segments are increased for preventing hot offset, fixing can be performed without a problem at high temperature, but fixing performed at low temperature provides an image of low glossiness, melting and penetration of the toner into paper are insufficient, which may result in a state where the image is easily detached from the paper. Especially in the case where fixing is performed on thick paper having surface irregularities, thermal transmission efficiency to the toner is low during fixing, and therefore the fixing state is further degraded, and the fixing state of the toner especially in the elastic state is significantly degraded, as pressure is not sufficiently applied by a fixing member to the toner present in the recess parts of the paper.

Considering a molecule weight as a means for controlling viscoelasticity after melting, naturally the viscoelasticity increases, as the molecular weight increases, because there is greater hindrance to the movements of molecular chains with increase in the molecular weight thereof. In the case where the molecular weight is large, moreover, tangling of the molecular chains is caused, and therefore the resin shows elastic behavior. In view of the fixing ability of the toner to paper, the smaller molecular weight of the resin is preferable, as the viscosity of the toner during melting is smaller. On the other hand, hot offset occur unless the toner has a certain degree of elasticity. When a molecular weight of the resin is increased on the whole, however, fixing ability of the toner is impaired, and the fixing state of the toner, especially to thick paper, is significantly degraded, as the thermal transmittance efficiency to the toner is low during fixing. Therefore, by adjusting the molecular weight of the binder resin on the whole not to be too large, and adding a high molecular weight crystalline component, provided can be a toner whose viscoelasticity after melting can be suitably controlled, and which can be fixed at constant temperature and at constant speed regardless of types of paper, such as thin paper, and thick paper.

Note that, the weight average molecular weight is preferably in the range of 15,000 to 70,000, more preferably in the range of 30,000 to 60,000, and even more preferably in the range of 35,000 to 50,000. When the weight average molecular weight is greater than 70,000, a molecular weight of the entire binder resin is too high, and therefore a resulting toner may have insufficient fixing ability, which may lead to low glossiness of an image, and moreover, an image after being fixed may be easily peeled off upon application of external stress. When the weight average molecular weight is smaller than 15,000, internal cohesive force becomes small during melting a toner, even through a large amount of the high molecular weight component is present. As a result, hot offset may occur, or paper may be wrapped around a fixing member.

As for a method for producing a toner containing a binder resin having the aforementioned molecular weight distribution, for example, there are a method for using two or more resins each having a different molecular weight distribution, and a method for using a resin whose molecular weight distribution has been controlled during polymerization.

In the case where two or more resins each having a different molecular weight distribution are used, at least two resins including a relatively high molecular weight resin, and a relatively low molecular weight resin are used. As for the high molecular weight resin, a resin having a high molecular weight may be selected, or a modified resin having a terminal isocyanate group may be elongated in the production process of the toner to form a high molecular resin. The latter is preferable because the high molecular weight resin can be uniformly distributed in the toner, and in a production method including a step of dissolving the binder resin in an organic solvent, the modified resin is more easily dissolved than the high molecular weight resin, which originally has a high molecular weight.

In the case where two types of resins, i.e., a high molecular weight resin (including a modified resin containing an isocyanate group) and a low molecular weight resin, constitute the binder resin, a ratio (mass ratio) of the high molecular weight resin to the low molecular weight resin (high molecular weight resin/low molecular weight resin) is preferably 5/95 to 60/40, more preferably 8/92 to 50/50, even more preferably 12/88 to 35/65, and particularly preferably 15/85 to 25/75. When the amount of the high molecular weight resin is smaller than 5/95 in the ratio, or is greater than 60/40 in the ratio, is may be difficult to obtain a toner containing a binder resin having the aforementioned molecular weight distribution.

When the resin whose molecular weight distribution is controlled during polymerization thereof is used, a method for obtaining such resin includes, for example, a polymerization method, such as condensation polymerization, polyaddition, and addition condensation. In accordance with such polymerization method, a molecular weight distribution of the resin can be widen by adding, other than a bifunctional monomer, small amounts of monomers having different number of functional groups. The monomers having different number of functional groups include a trifunctional or higher monomer, and a monofunctional monomer. However, use of the trifunctional or higher monomer results in generation of a branched structure, and therefore it may be difficult to form a crystalline structure when a resin having crystallinity is used. Use of the monofunctional monomer brings the following advantage. The monofunctional monomer terminates a polymerization reaction, and therefore, when two or more resins are used, the low molecular weight is purified, as well as allowing the polymerization reaction to continue in part to yield a high molecular weight component.

In the present invention, the molecular weight distribution and weight average molecular weight (Mw) of the tetrahydrofuran (THF) soluble component of the toner and the resin can be measured by means of a gel permeation chromatography (GPC) measuring device (e.g., GPC-8220GPC of Tosoh Corporation). As for a column used for the measurement, TSKgel Super HZM-H, 15 cm, three connected columns (of Tosoh Corporation) are used. The resin to be measured is formed into a 0.15% by mass solution using tetrahydrofuran (THF) (containing a stabilizer, manufactured by Wako Chemical Industries, Ltd.), and the resulting solution is subjected to filtration using a filter having a pore size of 0.2 μm, from which the filtrate is provided as a sample. The THF sample solution is injected in an amount of 100 μL into the measuring device, and the measurement is carried out at a flow rate of 0.35 mL/min. in the environment having the temperature of 40° C.

The molecular weight is calculated using a calibration curve prepared from several monodisperse polystyrene standard samples. As for the monodisperse polystyrene standard samples, Showdex STANDARD series manufactured by SHOWA DENKO K.K., and toluene are used. The following three types of THF solutions of monodisperse polystyrene standard samples are prepared, and the measurement is carried out under the aforementioned conditions. The retaining time of the peak top is determined as a molecular weight by light scattering, to prepare a calibration curve. As the detector, a refractive index (RI) detector is used.

Solution A: S-7450 (2.5 mg), S-678 (2.5 mg), S-46.5 (2.5 mg), S-2.90 (2.5 mg), THF (50 mL)

Solution B: S-3730 (2.5 mg), S-257 (2.5 mg), S-19.8 (2.5 mg), S-0.580 (2.5 mg), THF (50 mL)

Solution C: S-1470 (2.5 mg), S-112 (2.5 mg), S-6.93 (2.5 mg), toluene (2.5 mg), THF (50 mL)

The proportion of the component having a molecular weight of 100,000 or greater, and the proportion of the component having a molecular weight of 250,000 or greater can be determined with an intersection point between an integrated molecular weight distribution curve with a curve of a molecular weight 100,000, and a curve of a molecular weight 250,000, respectively.

Moreover, the ratio (CC)/((CC)+(AA)) is preferably 0.15 or greater in view of both fixing ability and heat resistant storage stability, more preferably 0.20 or greater, even more preferably 0.30 or greater, and particularly preferably 0.45 or greater, where (CC) is an integrated intensity of part of a spectrum derived from a crystal structure, and (AA) is an integrated intensity of a part of the spectrum derived from a non-crystal structure, where the spectrum is a diffraction spectrum of the toner obtained by an X-ray diffractometer.

In the case where the toner of the present invention contains wax, a diffraction peak due to the wax often appears at 2θ=23.5° to 24°. When an amount of the wax is smaller than 15% by mass relative to a total mass of the toner, it is not necessary to consider the diffraction peak due to the wax, because contribution of the diffraction peak due to wax is not very significant. When an amount of the wax is greater than 15% by mass relative to a total mass of the toner, the "integrated intensity of part of a spectrum derived from a crystal structure (CC)" is replaced with the value obtained by subtracting the integrated intensity of part of the spectrum derived from the crystalline structure of the wax, from the integrated intensity of part of the spectrum derived from the crystalline structure of the binder resin.

The ratio (CC)/((CC)+(AA)) is an index for an amount of the crystalline segment in the toner (mainly, an amount of the crystalline segment in the binder resin, which is a main component of the toner). In the present invention, X-ray diffraction spectroscopy is performed by means of an X-ray diffractometer equipped with a 2D detector (D8 DISCOVER with GADDS, of Bruker Japan). Note that, a conventional toner containing a crystalline resin or wax as an additive has the ratio of less than 0.15.

As for a capillary tube for use in the measurement, a marked tube (Lindemann glass) having a diameter of 0.70 mm is used. A sample is loaded in the capillary tube up to the top of the capillary tube to carry out the measurement. At the time when the sample is loaded, tapping is performed, and a number of taps is 100 times.

Specific conditions for the measurement are as follows:
Tube current: 40 mA
Tube voltage: 40 kV
Goniometer 2θ axis: 20.0000°
Goniometer Ω axis: 0.0000°
Goniometer ϕ axis: 0.0000°
Detector distance: 15 cm (wide angle measurement)
Measuring range: 3.2≤2θ(°)≤37.2
Measuring time: 600 sec As for an incident optical system, a collimator having a pin hole having a diameter of 1 mm is used. The obtained 2D data was integrated using the supplied software (x axis: 3.2° to 37.2°) to invert the 2D data into 1D data of diffraction intensity and 2θ. A method for calculating the ratio (CC)/((CC)+(AA)) based on the results obtained from the X-ray diffraction spectroscopy will be explained hereinafter.

Figure 1B:
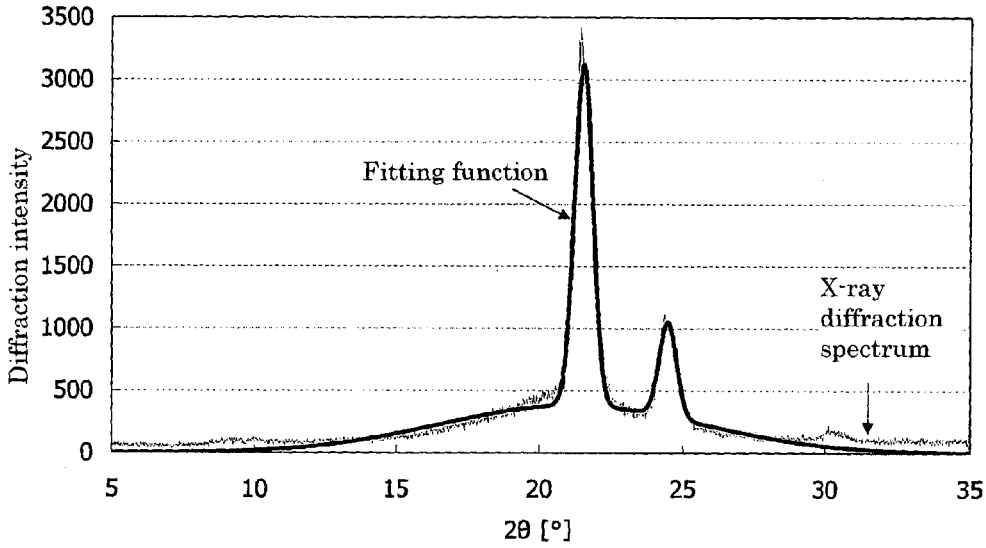
FIG. 1B is a graph depicting a fitting function of FIG. 1A.

Examples of the diffraction spectrums obtained by X-ray diffraction spectroscopy are presented in FIGS. 1A and 1B. The horizontal axis represents 2θ, the longitudinal axis represents X-ray diffraction intensity, and both are linear axes. In the X-ray diffraction spectrum of FIG. 1A, the main peaks (P1, P2) are appeared at 2θ=21.3°, 24.2°, and the halo (h) is appeared in the wide range including these two peaks. The main peaks are due to the crystalline structure, and the halo is due to the non-crystalline structure.

The two main peaks, and halo are respectively represented with Gaussian functions of the following formulae A(1) to A(3).

$$fp1(2\theta)=ap1\exp\{-(2\theta-bp1)^2/(2cp1^2)\} \quad \text{Formula A(1)}$$

$$fp2(2\theta)=ap2\exp\{-(2\theta-bp2)^2/(2cp2^2)\} \quad \text{Formula A(2)}$$

$$fh(2\theta)=ah\exp\{-(2\theta-bh)^2/(2ch^2)\} \quad \text{Formula A(3)}$$

In the formulae above, fp1(2θ), fp2(2θ), fh(2θ) are functions corresponding to the main peaks P1, P2, and halo, respectively.

Then, the following formula A(4) represented as a sum of these three functions is used as a fitting function (depicted in FIG. 1B) of the entire X-ray diffraction spectrum, and fitting is performed by the least-squares method.

$$f(2\theta)=fp1(2\theta)+fp2(2\theta)+fh(2\theta) \quad \text{Formula A(4)}$$

The variables for the fitting are 9 variables, i.e., ap1, bp1, cp1, ap2, bp2, cp2, ah, bh, and ch. As for a fitting initial value of each variable, peak positions of X-ray diffraction (bp1=21.3, bp2=24.2, bh=22.5, in the example depicted in FIG. 1) are set for bp1, bp2, and bh, and for other variables, values are appropriately assigned, and the values with which the two main peaks and halo are matched to the X-ray diffraction spectrum as close as possible are set as the fitting initial values of the aforementioned other variables. The fitting can be performed, for example, using a solver, Excel 2003, of Microsoft Corporation.

The ratio (CC)/((CC)+(AA)), which is an index for an amount of the crystalline segments, can be calculated from the integrated areas (Sp 1, Sp2, Sh) of Gaussian functions fp1(2θ) and fp2(2θ), which are corresponded to the two main peaks after the fitting (P1, P2), and Gaussian function fh(2θ), which is corresponded to the halo, where (Sp1+Sp2) is determined as (CC), and Sh is determined as (AA).

[Properties of Toner]

In order to prevent damages caused by transferring an image, the maximum endothermic peak T1 and the maximum exothermic peak T2 preferably satisfy the following condition (1), where the maximum endothermic peak T1 is the maximum endothermic peak as measured by second heating in the range from 0° C. to 150° C. in differential scanning calorimetry (DSC) of the toner, and the maximum exothermic peak T2 is the maximum exothermic peak as measured by cooling in the range from 0° C. to 150° C. in differential scanning calorimetry (DSC) of the toner $$(T1-T2)\leq 30^\circ\text{ C., and } T2\geq 30^\circ\text{ C.} \quad \text{Condition (1)}$$

<Method and Conditions for Measuring Maximum Endothermic and Exothermic Peaks of Toner>

The maximum endothermic peak of the toner is measured by means of DSC System Q-200 (manufactured by TA INSTRUMENTS JAPAN INC.). Specifically, first, an aluminum sample container is charged with about 5.0 mg of a resin is placed on a holder unit, and the holder unit is then set in an electric furnace. Next, the sample is heated from 0° C. to 100° C. at the heating rate of 10° C./min, followed by cooling from 100° C. to 0° C. at the cooling rate of 10° C./min. The sample is then again heated from 0° C. to 100° C. at the heating rate of 10° C./min. By means of an analysis program in DSC System Q-200 (manufactured by TA INSTRUMENTS JAPAN INC.) a DSC curve obtained from the second heating is selected to thereby measure the maximum endothermic peak temperature T1 of the toner. In the same manner, the maximum exothermic peak temperature T2 of the toner is measured from the cooling.

T1 of the toner is preferably 50° C. to 80° C., more preferably 53° C. to 65° C., and even more preferably 58° C. to 63° C. When T1 of the toner is in the range of 50° C. to 80° C., the minimum heat resistance storage stability required for the toner can be maintained, and excellent low temperature fixing ability of the toner, which has not been realized in the conventional art, can be achieved. When T1 of the toner is lower than 50° C., low temperature fixing ability of the toner improves, but heat resistant storage stability thereof may be impaired. When T1 of the toner is higher than 80° C., in contrast to the above, heat resistant storage stability of the toner improves, but low temperature fixing ability thereof may be impaired.

T2 of the toner is preferably 30° C. to 56° C., more preferably 35° C. to 56° C., and even more preferably 40° C. to 56° C. When T2 of the toner is lower than 30° C., a speed of a fixed image to be cooled and solidified is slow, which may cause blocking or transport damage of a toner image (print). T2 is preferably as high as possible. As T2 is a crystallization temperature, however, it is impossible that T2 is higher than T1 that is a melting point. In order to maintain excellent heat resistant storage stability and low temperature fixing ability and to prevent blocking or transport damage of a toner image, a difference between T1 and T2, i.e., (T1−T2) is preferably a relatively narrow range. T1−T2 is preferably 30° C. or lower, more preferably 25° C. or lower, and even more preferably 20° C. or lower. When the difference (T1−T2) is greater than 30° C., a difference between fixing temperature and temperature at which a toner image is solidified is large, and therefore an effect of preventing blocking or transport damage of a toner image may not be obtained.

An output image formed with a toner containing, as a binder resin, a crystalline polyester resin containing at least either a urethane bond or urea bond tends to suffer from transport damage. This is because the crystalline polyester resin containing at least either a urethane bond or a urea bond has a low recrystallization speed when the crystalline polyester resin is cooled from the melted to state to temperature equal to a melting point thereof or lower. An image just after thermal fixing a toner containing the resin having low recrystallization speed temporarily in the suppercooling state even after it is cooled to around room temperature, as the recrystallization speed thereof is low.

The toner in the supercooling state has significantly low elastic modulus compared to that in a crystalline state. Therefore, the toner of such state does not have sufficient resistance to mechanical stress applied from transporting members to be in contact with the toner just after fixing.

In accordance with a method for reducing an amount of an urethane bond and urea bond to adjust ununiformity of physical crosslink points or molecular structures, which are main factors for lowing a recrystallization speed, strength of an image reduces along with reduction in elastic modulus, and therefore transport damages tend to be caused more, and also hot offset resistance may be degraded. In a method for adjusting the molecular weight for the reason mentioned above, formation of transport damages cannot be prevented, and a recrystallization speed and elastic modulus of an image, which are paradox, and cannot be improved at the same time.

As mentioned above, it is difficult to prevent a transport damage to be formed in an image only with a crystalline polyester resin having at least either a urethane bond or a urea bond. As a result of researches and studies conducted by the present inventors, it has been found that use of a composite of the crystalline resin containing at least either a urethane bond or a urea bond, and a non-modified crystalline polyester resin enables to improve recrystallization speed of an image while maintaining desirable elastic modulus of the image.

Specifically, when an image is cooled from the melted state to temperature lower than a melting point, the molecular chains are mobile as there is no physical crosslink point, and the non-modified crystalline polyester, whose molecular chain has higher symmetry, is immediately crystallized to form a crystal nucleus, to thereby accelerate crystallization of the entire image. As a result, the crystallization speed of the image is significantly improved.

Even in the case where the crystalline polyester resin having at least either a urethane bond or a urea bond is used as a binder resin, the elastic modulus and strength of the image can be significantly improved from being in contact with transporting member, due to a crystallization speed acceleration effect of the non-modified crystalline polyester resin, and therefore formation of transport damages can be prevented. Moreover, at this time, the hot offset resistance can be still secured because of the presence of the crystalline polyester resin having at least either a urethane bond or a urea bond, and moreover, the non-modified crystalline polyester gives an advantages effect to low temperature fixing ability.

By using the crystalline resin having at least either a urethane bond or a urea bond, and the non-modified crystalline polyester resin in combination as a binder resin, low temperature fixing ability and heat resistant storage stability are both achieved at high level, and problems, such as formation of transport damages, and insufficient strength of an output image, can be solved. This is because recrystallization speed of an image after thermal fixing is increased, and hardness of an output image can be improved before the image reaches a transport member, which is a factor for causing a transport damage by using, in combination, the crystalline polyester resin having at least either a urethane bond or a urea bond, which has high cohesive energy, and the non-modified crystalline resin, both of which can together improve hot offset resistance, heat resistant storage stability, and strength of an output image.

The non-modified crystalline polyester resin and the crystalline polyester resin having at least either a urethane bond or a urea bond are both preferably present in an image in a uniformly mixed state. Therefore, these resins are preferably uniformly mixed or dispersed inside the toner. In view of uniform mixing and dispersibility within the toner, the non-modified crystalline polyester resin and the crystalline polyester unit of the crystalline polyester resin having at least either a urethane bond or a urea bond preferably have similar skeletons.

It is important for the high molecular weight component to have a resin structure similar to that of the entire binder resin. In the case where the binder resin has crystallinity, the high molecular weight component similarly has crystallinity. When the high molecular weight component is structurally significantly different from other resin components, the high molecular weight component is easily separated to cause phase separation to be in the a sea-island state, and therefore it cannot be expect a contribution from the high molecular weight component to improve viscoelasticity or cohesive force of the entire toner. As for a comparison between a proportion of a crystalline structure in the high molecular weight component and that in the entire binder resin, for example, a ratio (ΔH(H)/ΔH(T)) of an endothermic value (ΔH(H)) of a tetrahydrofuran (THF)-ethyl acetate mixed solvent (blending ratio: 50:50 (mass ratio)) insoluble component as measured by differential scanning calorimetry (DSC) to an endothermic value (ΔH(T)) of the toner as measured by DSC is preferably in the range of 0.2 to 1.25, more preferably 0.3 to 1.0, and even more preferably 0.4 to 1.0.

As for a specific test method for obtaining a component insoluble to a mixed solvent of tetrahydrofuran (THF) and ethyl acetate (blending ratio: 50:50 (mass ratio)), the following method can be used. To 40 g of the aforementioned mixed solvent having room temperature (20° C.), 0.4 g of the toner is added, and the mixture is mixed for 20 minutes. Thereafter, the insoluble component is separated by a centrifuge, and a supernatant is removed. The resultant is vacuum dried, to thereby obtain the aforementioned mixed solvent insoluble component.

[Amount of Element N in THF Soluble Component of Toner]

An amount of an element N, which is derived from a urethane bond and a urea bond, in the THF soluble component of the toner is preferably in the range of 0.3% by mass to 2.0% by mass, more preferably 0.5% by mass to 1.8% by mass, and more preferably 0.7% by mass to 1.6% by mass. When the amount of the element N is greater than 2.0% by mass, the viscoelasticity of the melted toner may be too high, which may cause degraded fixing ability, low glossiness, and poor charging properties. When the amount thereof is smaller than 0.3% by mass, the aggregation or the toner or contamination of a member with the toner may occur within an image forming apparatus due to low toughness of the toner, and hot offset may occur due to low viscoelsticity of the melted toner.

The amount of the element N can be determined in the following method. By means of vario MICRO cube (manufactured by Elementar Analysensysteme GmbH), CHN analysis was performed under the conditions including a combustion furnace of 950° C., reducing furnace of 550° C., helium flow rate of 200 mL/min, and oxygen flow rate of 25 mL/min to 30 mL/min. The measurement is performed twice, and the average value from the measurement values is determined as the amount of the element N. Note that, in the case where the amount of the element N is smaller than 0.5% by mass in accordance with this measuring method, a measurement is further performed by means of a trace nitrogen analysis device ND-100 (manufactured by Mitsubishi Chemical Corporation). Temperature of an electric furnace (horizontal reaction furnace) is 800° C. in a thermal decomposition section, and 900° C. in a catalyst section. The measuring conditions include a main $O_2$ flow rate of 300 mL/min, and Ar flow rate of 400 mL/min. The sensitivity is set as low, and the elemental determination is performed using a calibration curve prepared with a pyridine standard liquid.

Note that, the THF soluble component in the toner can be obtained by placing 5 g of the toner in Soxhlet extractor in advance, carrying out extraction with 70 mL of tetrahydrofuran (THF) for 20 hours by means of the extractor, and heating and vacuuming the resultant to remove THF, to thereby obtain a THF soluble component.

[Urea Bond]

It is important that the urea bond is present in the THF soluble component of the toner because it can give an effect of improving toughness of the toner, and hot offset resistance during fixing, even though an amount of the urea bond is small.

The presence of the urea bond in the THF soluble component of the toner can be confirmed by $^{13}$C-NMR.

Specifically, the analysis is performed in the following manner. An analysis sample (2 g) is immersed in 200 mL of a potassium hydroxide methanol solution having a concentration of 0.1 mol/L, and left to stand for 24 hours at 50° C. Then, the solution is removed, and the residue is washed with ion-exchanged water until pH becomes neutral, and the resulting solid is dried. The dried sample is added to a mixed solvent (DMAc:DMSO-d6=9:1 (volume ratio)) of dimethyl acetoamide (DMAc) and deuterated dimethyl sulfoxide (DMSO-d6) at a concentration of 100 mg/0.5 mL, and is dissolved therein for 12 hours to 24 hours at 70° C. Then, the sample solution is cooled to 50° C., followed by subjected to $^{13}$C-NMR. Note that, the measuring frequency is 125.77 MHz, 1H_60° pulse is 5.5 and a standard material is 0.0 ppm of tetramethyl silane (TMS).

Figure 2:
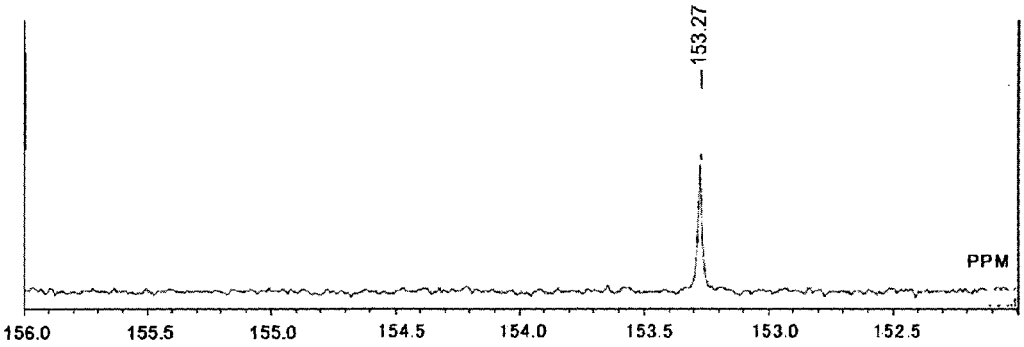
FIG. 2 is a graph depicting an example of a $^{13}$C-NMR spectrum.

The presence of the urea bond in the sample is confirmed by determining whether or not a signal can be seen with a chemical shift of a signal derived from carboxyl carbon of a urea bond segment of polyurea, which is a sample. Typically, the chemical shift of the carbonyl carbon appears at 150 ppm to 160 ppm. As one example of polyurea, $^{13}$C-NMR spectrum around carboxyl carbon of polyurea, which is a reaction product of 4,4'-diphenyl methane diisocyanate (MDI) and water, is depicted in FIG. 2. The signal derived from carbonyl carbon can be seen at 153.27 ppm.

—Polyester Resin—

Examples of the polyester resin as the crystalline resin in the second resin include a polycondensation polyester resin synthesized from polyol and polycarboxylic acid, a lactone ring-opening polymerization product, and polyhydroxy carboxylic acid. Among them, a polycondensation polyester resin synthesized from polyol and polycarboxylic acid is preferably in view of exhibition of crystallinity.

—Polyol—

Examples of the polyol include diol, and trivalent to octavalent or higher polyol.

The diol is appropriately selected depending on the intended purpose without any limitation, and examples thereof include: aliphatic diol, such as straight chain aliphatic diol, and branched aliphatic diol; C4-C36 alkylene ether glycol; C4-C36 alicyclic diol; an alkylene oxide (may be abbreviated as AO, hereinafter) adduct of the aforementioned alicyclic diol; an AO adduct of bisphenol; polylactone diol; polybutadiene diol; and diol containing a carboxyl group, diol having a sulfonic acid group or a sulfamic acid, and diol having another functional group, such as a salt of any of the aforementioned acids. Among them, an aliphatic diol whose chain has 2 to 36 carbon atoms is preferable, and straight chain aliphatic diol is more preferable. These may be used alone, or in combination.

An amount of the straight chain aliphatic diol in the total amount of diols is preferably 80 mol % or greater, more preferably 90 mol % or greater. When the amount thereof is 80 mol % or greater, it is preferable because the crystallinity of the resin improves, and desirable low temperature fixing ability and heat resistant storage stability are both achieved, and hardness of the resin tends to be improved.

The straight chain aliphatic diol is appropriately selected depending on the intended purpose without any limitation, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decane-diol, 1,11-undecanediol, 1,12-dodecanediol, 1,13-tridecanediol, 1,14-tetradecanediol, 1,18-octadecanediol, and 1,20-eicosanediol. Among them, preferred are ethylene glycol, 1,3-propanediol, 1,4-butanediol, 1,6-hexanediol, 1,9-nonanediol, and 1,10-decanediol, as they are readily available.

The branched aliphatic diol whose chain has 2 to 36 carbon atoms is appropriately selected depending on the intended purpose without any limitation, and examples thereof include 1,2-propylene glycol, 1,2-butanediol, 1,2-hexanediol, 1,2-octanediol, 1,2-decanediol, 1,2-dodecanediol, 1,2-tetradecanediol, neopentyl glycol, and 2,2-diethyl-1,3-propanediol.

The C4-C36 alkylene ether glycol is appropriately selected depending on the intended purpose without any limitation, and examples thereof include diethylene glycol, triethylene glycol, dipropylene glycol, polyethylene glycol, polypropylene glycol, and polytetramethylene ether glycol.

The C4-C36 alicyclic diol is appropriately selected depending on the intended purpose without any limitation, and examples thereof include 1,4-cyclohexane dimethanol, and hydrogenated bisphenol A.

The alkylene oxide (may be abbreviated as AO, hereinafter) of the alicyclic diol is appropriately selected depending on the intended purpose without any limitation, and examples thereof include an ethylene oxide (may be abbreviated as EO, hereinafter), propylene oxide (may be abbreviated as PO, hereinafter), or butylene oxide (may be abbreviated as BO, hereinafter) adduct (the number of moles added: 1 to 30) of the alicyclic diol.

The AO adduct of the bisphenol is appropriately selected depending on the intended purpose without any limitation, and examples thereof include an AO (e.g., EO, PO, and BO) adduct (the number of moles added: 2 to 30) of bisphenol A, bisphenol F, or bisphenol S.

The polylactone diol is appropriately selected depending on the intended purpose without any limitation, and examples thereof include poly ϵ-caprolacone diol.

The diol having a carboxyl group is appropriately selected depending on the intended purpose without any limitation, and examples thereof include C6-C24 dialkylol alkanoic acid, such as 2,2-dimethylol priopionic acid (DMPA), 2,2-dimethylol butanoic acid, 2,2-dimethylol heptanoic acid, and 2,2-dimethylol octanoic acid.

The diol having a sulfonic acid group or sulfamic acid group is appropriately selected depending on the intended purpose without any limitation, and examples thereof include: sulfamic acid diol, such as N,N-bis(2-hydroxyalkyl)sulfamic acid (number of carbon atoms in the alkyl group: 1 to 6) (e.g., N,N-bis(2-hydroxyethyl)sulfamic acid), and an AO (e.g., EO and PO, number of moles of AO added: 1 to 6) adduct of N,N-bis(2-hydroxyalkyl)sulfamic acid (number of carbon atoms in the alkyl group: 1 to 6) (e.g., N,N-bis(2-hydroxyethyl)sulfamic acid PO (2 mol) adduct); and bis(2-hydroxyethyl)phosphate.

The neutralized salt group contained in the diol having a neutralized salt group is appropriately selected depending on the intended purpose without any limitation, and examples thereof include C3-C30 tertiary amine (e.g., triethyl amine), and alkali metal (e.g., sodium salt).

Among them, the C2-C12 alkylene glycol, diol having a carboxyl group, AO adduct of bisphenols, and any combination thereof are preferable.

Moreover, the optional trivalent to octavalent or higher polyol is appropriately selected depending on the intended purpose without any limitation, and examples thereof include: C3-C36 trihydric to octahydric or higher polyhydric aliphatic alcohol such as alkane polyol, and its intramolecular or intermolecular dehydrate (e.g., glycerin, trimethylol ethane, trimethylol propane, pentaerythritol, sorbitol, sorbitan, and polyglycerin), saccharide and derivatives thereof (e.g., sucrose, and methylglucoside); a trisphenol (e.g., trisphenol PA) AO adduct (number of moles added: 2 to 30); a novolak resin (e.g., phenol novolak, cresol novolak) AO adduct (number of moles added: 2 to 30); and acryl polyol, such as a copolymer of hydroxyethyl(meth)acrylate and a vinyl monomer. Among them, trihydric to octahydric or higher polyhydric aliphatic alcohol and a novolak resin AO adduct are preferable, and the novolak resin AO adduct is more preferable.

—Polycarboxylic Acid—

Examples of the polycarboxylic acid include dicarboxylic acid, and trivalent to hexavalent or higher polycarboxylic acid.

The dicarboxylic acid is appropriately selected depending on the intended purpose without any limitation, and preferable examples thereof include: aliphatic dicarboxylic acid, such as straight chain aliphatic dicarboxylic acid, and branched aliphatic dicarboxylic acid; and aromatic dicarboxylic acid. Among them, straight chain aliphatic dicarboxylic acid.

The aliphatic dicarboxylic acid is appropriately selected depending on the intended purpose without any limitation, and preferable examples thereof include: C4-C36 alkane dicarboxylic acid, such as succinic acid, adipic acid, sebacic acid, azelaic acid, dodecane dicarboxylic acid, octadecane dicarboxylic acid, and decyl succinic acid; C4-C36 alkene dicarboxylic acid, such as alkenyl succinic acid (e.g., dodecenyl succinic acid, pentadecenyl succinic acid, and octadecenyl succinic acid), maleic acid, fumaric acid, and citraconic acid; and C6-C10 alicyclic dicarboxylic acid, such as dimer acid (e.g., linoleic acid dimer).

The aromatic dicarboxylic acid is appropriately selected depending on the intended purpose without any limitation, and preferable examples thereof include: C8-C36 aromatic dicarboxylic acid, such as phthalic acid, isophthalic acid, terephthalic acid, t-butylisophthalic acid, 2,6-naphthalene dicarboxylic acid, 4,4'-biphenyl dicarboxylic acid.

Moreover, examples of the optional trivalent to hexavalent or higher polycarboxylic acid include C9-C20 aromatic polycarboxylic acid, such as trimellitic acid, and pyromellitic acid.

Note that, as the dicarboxylic acid or trivalent to hexavalent or higher polycarboxylic acid, acid anhydrides or C1-C4 lower alkyl ester (e.g., methyl ester, ethyl ester, and isopropyl ester) of the above-listed acids may be used.

Among the above-listed dicarboxylic acids, a use of the aliphatic dicarboxylic acid (preferably, adipic acid, sebacic acid, dodecane dicarboxylic acid, terephthalic acid, isophthalic acid, etc.) alone is particularly preferable. Use of a combination of the aliphatic dicarboxylic acid with the aromatic dicarboxylic acid (preferably terephthalic acid, isophthalic acid, t-butylisophthalic acid, lower alkyl ester of any of the above-listed aromatic dicarboxylic acids, etc.) is also preferable. In this case, an amount of the aromatic dicarboxylic acid copolymerized is preferably 20 mol % or smaller.

—Lactone Ring-Opening Polymerization Product—

The lactone ring-opening polymerization product is appropriately selected depending on the intended purpose without any limitation, and examples thereof include: a lactone ring-opening polymerization product obtained through a ring-opening polymerization of lactone, such as C3-C12 monolactone (number of ester groups in a ring: one)

(e.g., β-propiolactone, γ-butylolactone, δ-valerolactone, and ε-caprolactone) with a catalyst (e.g., metal oxide, and an organic metal compound); and a lactone ring-opening polymerization product containing a terminal hydroxy group obtained by subjecting C3-C12 monolactones to ring-opening polymerization using glycol (e.g., ethylene glycol, and diethylene glycol) as an initiator.

The C3-C12 monolactone is appropriately selected depending on the intended purpose without any limitation, but it is preferably ε-caprolactone in view of crystallinity.

The lactone ring-opening polymerization product may be selected from commercial products, and examples of the commercial products include highly crystalline polycaprolactone such as H1P, H4, H5, and H7 of PLACCEL series manufactured by Daicel Corporation.

—Polyhydroxycarboxylic Acid—

The preparation method of the polyhydroxycarboxylic acid is appropriately selected depending on the intended purpose without any limitation, and examples thereof include a method in which hydroxycarboxylic acid such as glycolic acid, and lactic acid (e.g., L-lactic acid, D-lactic acid, and racemic lactic acid) is directly subjected to a dehydration-condensation reaction; and a method in which C4-C12 cyclic ester (the number of ester groups in the ring is 2 to 3), which is an equivalent to a dehydration-condensation product between 2 or 3 molecules of hydroxycarboxylic acid, such as glycolide or lactide (e.g., L-lactide acid, D-lactide, and racemic lactic acid) is subjected to a ring-opening polymerization using a catalyst such as metal oxide and an organic metal compound. The method using ring-opening polymerization is preferable because of easiness in adjusting a molecular weight of the resultant.

Among the cyclic esters listed above, L-lactide and D-lactide are preferable in view of crystallinity. Moreover, terminals of the polyhydroxycarboxylic acid may be modified to have a hydroxyl group or carboxyl group.

—Polyurethane Resin—

The polyurethane resin as the crystalline resin in the second resin includes a polyurethane resin synthesized from polyol (e.g., diol, trihydric to octahydric or higher polyol) and polyisocyanate (e.g., diisocyanate, and trivalent or higher polyisocyanate). Among them, preferred is a polyurethane resin synthesized from the diol and the diisocyanate.

As for the diol and trihydric to octahydric or higher polyol, those mentioned as the diol and trihydric to octahydric or higher polyol listed in the description of the polyester resin can be used.

—Polyisocyanate—

The polyisocyanate includes, for example, diisocyanate, and trivalent or higher polyisocyanate.

The diisocyanate is appropriately selected depending on the intended purpose without any limitation, and examples thereof include aromatic diisocyanate, aliphatic diisocyanate, alicyclic diisocyanate, and aromatic aliphatic diisocyanate. Specific examples thereof include C6-C20 aromatic diisocyanate (the number of the carbon atoms excludes other than those contained in NCO groups, which is the same as follows), C2-C18 aliphatic diisocyanate, C4-C15 alicyclic diisocyanate, C8-C15 aromatic aliphatic diisocyanate, and modified products (e.g., modified products containing a urethane group, carboxylmide group, allophanate group, urea group, biuret group, uretdione group, uretimine group, isocyanurate group, or oxazolidone group) of the preceding diisocyanates, and a mixture of two or more of the preceding diisocyanates. Optionally, trivalent or higher isocyanate may be used in combination.

The aromatic diisocyanate is appropriately selected depending on the intended purpose without any limitation, and examples thereof include 1,3- and/or 1,4-phenylene diisocyanate, 2,4- and/or 2,6-tolylenediisocyanate (TDI), crude TDI, 2,4'- and/or 4,4'-diphenyl methane diisocyanate (MDI), crude MDI (e.g., a phosgenite product of crude diaminophenyl methane (which is a condensate between formaldehyde and aromatic amine (aniline) or a mixture thereof, or condensate of a mixture of diaminodiphenyl methane and a small amount (e.g., 5% by mass to 20% by mass) of trivalent or higher polyamine) and polyallylpolyisocyanate (PAPI)), 1,5-naphthalene diisocyanate, 4,4',4"-triphenylmethane triisocyanate, and m- and p-isocyanatophenylsulfonyl isocyanate.

The aliphatic diisocyanate is appropriately selected depending on the intended purpose without any limitation, and examples thereof include ethylene diisocyanate, tetramethylenediisocyanate, hexamethylene diisocyanate(HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate.

The alicyclic diisocyanate is appropriately selected depending on the intended purpose without any limitation, and examples thereof include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- and 2,6-norbornanediisocyanate.

The aromatic aliphatic diisocyanate is appropriately selected depending on the intended purpose without any limitation, and examples thereof include m- and p-xylene diisocyanate (XDI), and α,α,α',α'-tetramethylxylene diisocyanate (TMXDI).

Moreover, the modified product of the diisocyanate is appropriately selected depending on the intended purpose without any limitation, and examples thereof include modified products containing a urethane group, carboxylmide group, allophanate group, urea group, biuret group, uretdione group, uretimine group, isocyanurate group, or oxazolidone group. Specific examples thereof include: modified products of diisocyanate such as modified MDI (e.g., urethane-modified MDI, carbodiimide-modified MDI, and trihydrocarbylphosphate-modified MDI), and urethane-modified TDI (e.g., isocyanate-containing prepolymer); and a mixture of two or more of these modified products of diisocyanate (e.g., a combination of modified MDI and urethane-modified TDI).

Among these diisocyanates, C6-C15 aromatic diisocyanate (where the number of carbon atoms excludes those contained in NCO groups, which will be the same as follows), C4-C12 aliphatic diisocyanate, and C4-C15 alicyclic diisocyanate are preferable, and TDI, MDI, HDI, hydrogenated MDI, and IPDI are particularly preferable.

—Polyurea Resin—

The polyurea resin as the crystalline resin in the second resin includes a polyurea resin synthesized from polyamine (e.g., diamine, and trivalent or higher polyamine) and polyisocyanate (e.g., diisocyanate, and trivalent or higher polyisocyanate) is included. Among them, the polyurea resin synthesized from the diamine and the diisocyanate is preferable.

As for the diisocyanate and trivalent or higher polyisocyanate, those listed as the diisocyanate and trivalent or higher polyisocyanate in the description of the polyurethane resin can be used.

—Polyamine—

The polyamine includes, for example, diamine, and trivalent or higher polyamine.

The diamine is appropriately selected depending on the intended purpose without any limitation, and examples thereof include aliphatic diamine, and aromatic diamine. Among them, C2-C18 aliphatic diamine, and C6-C20 aromatic diamine are preferable. With this, the trivalent or higher amines may be used in combination, if necessary.

The C2-C18 aliphatic diamine is appropriately selected depending on the intended purpose without any limitation, and examples thereof include: C2-C6 alkylene diamine, such as ethylene diamine, propylene diamine, trimethylene diamine, tetramethylene diamine, and hexamethylene diamine; C4-C18 alkylene diamine, such as diethylene triamine, iminobispropyl amine, bis(hexamethylene) triamine, triethylene tetramine, tetraethylene pentamine, and pentaethylene hexamine; C1-C4 alkyl or C2-C4 hydroxyalkyl substitution products of the alkylene diamine or polyalkylene diamine, such as dialkylaminopropylamine, trimethylhexamethylene diamine, aminoethylethanolamine, 2,5-dimethyl-2,5-hexamethylene diamine, and methyl isobispropyl amine; C4-C15 alicyclic diamine, such as 1,3-diaminocyclohexane, isophorone diamine, menthane diamine, and 4,4'-methylene dichlorohexane diamine (hydrogenated methylene dianiline); C4-C15 heterocyclic diamine, such as piperazine, N-aminoethyl piperazine, 1,4-diaminoethyl piperazine, 1,4-bis(2-amino-2-methylpropyl)piperazine, 3,9-bis(3-aminopropyl)-2,4,8,10-tetraoxapiro[5,5]undecane; and C8-C15 aromatic ring-containing aliphatic amines such as xylylene diamine, and tetrachloro-p-xylylene diamine.

The C6-C20 aromatic diamine is appropriately selected depending on the intended purpose without any limitation, and examples thereof include: non-substituted aromatic diamine, such as 1,2-, 1,3-, or 1,4-phenylene diamine, 2,4'-, or 4,4'-diphenylmethane diamine, crude diphenyl methane diamine(polyphenyl polymethylene polyamine), diaminodiphenyl sulfone, benzidine, thiodianiline, bis(3,4-diaminophenyl)sulfone, 2,6-diaminopyridine, m-aminobenzyl amine, triphenylmethane-4,4',4"-triamine, and naphthylene diamine; aromatic diamine having a C1-C4 nuclear-substituted alkyl group, such as 2,4-, or 2,6-tolylene diamine, crude tolylene diamine, diethyltolylene diamine, 4,4'-diamino-3,3'-dimethyldiphenyl methane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenyl methane, 3,5-diethyl-3'-methyl-2',4-diaminodiphenyl methane, 3,3'-diethyl-2,2'-diaminodiphenyl methane, 4,4'-diamino-3,3'-dimethyl diphenyl methane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenyl sulfone; a mixture of isomers of the above-listed non-substituted aromatic diamine and/or aromatic diamine having C1-C4 nuclear-substituted alkyl group with various blending rates; aromatic diamine having a nuclear-substituted electron-withdrawing group (e.g., halogen, such as Cl, Br, I, and F; an alkoxy group, such as a methoxy group, and an ethoxy group; and a nitro group), such as methylenebis-o-chloroaniline, 4-chloro-o-phenylene diamine, 2-chloro-1,4-phenylene diamine, 3-amino-4-chloroaniline, 4-bromo-1,3-phenylene diamine, 2,5-dichloro-1,4-phenylene diamine, 5-nitro-1,3-phenylene diamine, and 3-dimethoxy-4-aminoaniline; and aromatic diamine having a secondary amino group [part of or entire primary amino groups in the non-substituted aromatic diamine, the aromatic diamine having C1-C4 nuclear-substituted alkyl group, the mixture of isomers thereof with various blending ratios, and aromatic diamine having a nuclear-substituted electron-withdrawing group are replaced with secondary amino groups by substitution with a lower alkyl group, such as a methyl group, and an ethyl group], such as 4,4'-diamino-3,3'-dimethyl-5,5'-dibromo-diphenyl methane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), 4-aminophenyl-2-chloroaniline; 4,4'-di(methylamino)diphenyl methane, and 1-methyl-2-methylamino-4-amino benzene.

Other examples of the diamine include: polyamide polyamine, such as low molecular weight polyamie polyamine obtained by dicarboxylic acid (e.g., dimer acid) and an excess amount (two moles or more per mole of acid) of the polyamine (e.g., the alkylene diamine, and the polyalkylenepolyamine); and polyether polyamine, such as a hydrogenated compound of cyanoethylated compound of polyether polyol (e.g., polyalkylene glycol).

—Poly Amide Resin—

The polyamide resin as the crystalline resin in the second resin includes a polyamide resin synthesized from polyamine (e.g., diamine, and trivalent or higher polyamine), and polycarboxylic acid (e.g., dicarboxylic acid, and trivalent to hexavalent or higher polycarboxylic acid). Among them, the polyamide resin synthesized from diamine and dicarboxylic acid is preferable.

As for the diamine and trivalent or higher polyamine, those listed as the diamine and trivalent or higher polyamine in the description of the polyurea resin can be used.

As for the dicarboxylic acid and trivalent to hexavalent or higher polycarboxylic acid, those listed as the dicarboxylic acid and trivalent to hexavalent or higher polycarboxylic acid in the description of the polyester resin can be used.

—Poly Ether Resin—

The polyether resin as the crystalline resin in the second resin is appropriately selected depending on the intended purpose without any limitation, and examples thereof include crystalline polyoxy alkylene polyol.

The preparation method of the crystalline polyoxyalkylene polyol is appropriately selected depending on the intended purpose without any limitation, and examples thereof include: a method in which chiral AO is subjected to ring-opening polymerization using a catalyst that is commonly used for a polymerization of AO (e.g., a method described in Journal of the American Chemical Society, 1956, Vol. 78, No. 18, pp. 4787-4792); and a method in which inexpensive racemic AO is subjected to ring-opening polymerization using a catalyst that is a complex having a three-dimensionally bulky unique chemical structure.

As for a method using a unique complex, known are a method using, as a catalyst, a compound in which a lanthanoid complex is made in contact with organic aluminum (for example, disclosed in JP-A No. 11-12353), and a method in which bimetal μ-oxoalkoxide and a hydroxyl compound are allowed to react in advance (for example, disclosed in JP-A No. 2001-521957).

Moreover, as for a method for obtaining crystalline polyoxy alkylene polyol having extremely high isotacticity, known is a method for using a salen complex (for example, disclosed in Journal of the American Chemical Society, 2005, vol. 127, no. 33, pp. 11566-11567). For example, polyoxy alkylene glycol having a hydroxyl group at terminal thereof, which has isotacticity of 50% or greater is obtained through ring-opening polymerization of chiral AO using glycol or water as an initiator. The polyoxy alkylene glycol, which has the isotacticity of 50% or greater, may be one whose terminal is modified, for example, to have a carboxyl group. Note that, the isotacticity of 50% or greater typically gives crystallinity. Examples of the glycol include the aforementioned diol, and examples of carboxylic acid used for carboxy modification include the aforementioned dicarboxylic acid.

As for AO used for the production of the crystalline polyoxy alkylene polyol, C3-C9 AO is included. Examples thereof include PO, 1-chlorooxetane, 2-chlorooxetane, 1,2-dichlorooxetane, epichlorohydrin, epibromohydrin, 1,2-BO, methyl glycidyl ether, 1,2-pentylene oxide, 2,3-pentylene oxide, 3-methyl-1,2-butylene oxide, cyclohexene oxide, 1,2-hexylene oxide, 3-methyl-1,2-pentylene oxide, 2,3-hexylene oxide, 4-methyl-2,3-pentylene oxide, allyl glycidyl ether, 1,2-heptylene oxide, styrene oxide, and phenyl glycidyl ether. Among these AO, PO, 1,2-BO, styrene oxide, and cyclohexene oxide are preferable, and PO, 1,2-BO, and cyclohexene oxide are more preferable. Moreover these AO may be used alone, or in combination.

Moreover, the isotacticity of the crystalline polyoxy alkylene polyol is preferably 70% or greater, more preferably 80% or greater, even more preferably 90% or greater, and even more preferably 95% or greater, in view of high sharp melting, and blocking resistance of a resulting crystalline polyether resin.

The isotacticity can be calculated by the method disclosed in Macromolecules, vol. 35, no. 6, pp. 2389-2392 (2002), and can be determined in the following manner.

A measuring sample (about 30 mg) is weight in a sample tube for $^{13}$C-NMR having a diameter of 5 mm. To this, about 0.5 mL of a deuterated solvent is added to dissolve the sample, to thereby prepare an analysis sample. Here, the deuterated solvent is appropriately selected from solvents that can dissolve the sample, without any limitation, and examples thereof include deuterated chloroform, deuterated toluene, deuterated dimethyl sulfoxide, and deuterated dimethyl formamide. Three signals of $^{13}$C-NMR due to a methine group are appeared at around the syndiotactic value (S) 75.1 ppm, around the heterotactic value (H) 75.3 ppm, and around isotactic value (I) 75.5 ppm, respectively. The isotacticity is calculated by the following calculating formula (I).

$$\text{Isotacticity (\%)}=[I/(I+S+H)]\times 100 \qquad \text{Calculating Formula (I)}$$

In the calculating formula (I), "I" denotes an integral value of the isotactic signal, "S" denotes an integral value of the syndiotactic signal, and "H" denotes an integral value of the heterotactic signal.

—Vinyl Resin—

The vinyl resin as the crystalline resin in the second resin is appropriately selected depending on the intended purpose without any limitation, provided that it has crystallinity, but it is preferably a vinyl resin having as a constitutional unit a crystalline vinyl monomer, and optionally non-crystalline vinyl monomer.

The crystalline vinyl monomer is appropriately selected depending on the intended purpose without any limitation, and preferable examples thereof include C12-C50 straight chain alkyl(meth)acrylate (C12-C50 straight chain alkyl group is a crystalline group), such as lauryl (meth)acrylate, tetradecyl (meth)acrylate, stearyl (meth)acrylate, eicosyl (meth)acrylate, and behenyl (meth).

The non-crystalline vinyl monomer is appropriately selected depending on the intended purpose without any limitation, but it is preferably a vinyl monomer having a molecular weight of 1,000 or smaller. Examples thereof include styrenes, a (meth)acryl monomer, a vinyl monomer containing a carboxyl group, other vinyl ester monomers, and an aliphatic hydrocarbon-based vinyl monomer. These may be used alone, or in combination.

The styrenes are appropriately selected depending on the intended purpose without any limitation, and examples thereof include styrene, and alkyl styrene where the number of carbon atoms in the alkyl group is 1 to 3.

The (meth)acryl monomer is appropriately selected depending on the intended purpose without any limitation, and examples thereof include: C1-C11 alkyl (meth)acrylate, and C12-C18 branched alkyl (meth)acrylate, such as methyl (meth)acrylate, ethyl(meth)acrylate, butyl(meth)acrylate, and 2-ethylhexyl(meth)acrylate; hydroxylalkyl(meth)acrylate where the alkyl group has 1 to 11 carbon atoms, such as hydroxylethyl(meth)acrylate; and alkylamino group-containing (meth)acrylate where the alkyl group contains 1 to 11 carbon atoms, such as dimethylaminoethyl(meth)acrylate, and diethylaminoethyl(meth)acrylate.

The carboxyl group-containing vinyl monomer is appropriately selected depending on the intended purpose without any limitation, and examples thereof include: C3-C15 monocarboxylic acid such as (meth)acrylic acid, crotonic acid, and cinnamic acid; C4-C15 dicarboxylic acid such as maleic acid (anhydride), fumaric acid, itaconic acid, and citraconic acid; dicarboxylic acid monoester, such as monoalkyl (C1-C18) ester of dicarboxylic acid (e.g., maleic acid monoalkyl ester, fumaric acid monoalkyl ester, itaconic acid monoalkyl ester, and citraconic acid monoalkyl ester).

Other vinyl monomers are appropriately selected depending on the intended purpose without any limitation, and examples thereof include: C4-C15 aliphatic vinyl ester such as vinyl acetate, vinyl propionate, and isopropenyl acetate; C8-C50 unsaturated carboxylic acid polyhydric (dihydric to trihydric or higher) alcohol ester such as ethylene glycol di (meth)acrylate, propylene glycol di(meth)acrylate, neopentyl glycol di (meth)acrylate, trimethylolpropane tri (meth) acrylate, 1,6-hexanediol diacrylate, and polyethylene glycol di(meth)acrylate; and C9-C15 aromatic vinyl ester such as methyl-4-vinylbenzoate.

The aliphatic hydrocarbon vinyl monomer is appropriately selected depending on the intended purpose without any limitation, and examples thereof include: C2-C10 olefin such as ethylene, propylene, butene, and octene; and C4-C10 diene such as butadiene, isoprene, and 1,6-hexadiene.

—Modified Crystalline Resin—

The modified crystalline resin as the crystalline resin in the second resin is appropriately selected depending on the intended purpose without any limitation, provided that it is a reaction product from a crystalline resin having a functional group reactive with the active hydrogen group, and a compound having an active hydrogen group.

Examples of the crystalline resin having a functional group reactive with the active hydrogen group include a crystalline polyester resin having a functional group reactive with the active hydrogen group, a crystalline polyurethane resin having a functional group reactive with the active hydrogen group, a crystalline polyurea resin having a functional group reactive with the active hydrogen group, a crystalline polyamide resin having a functional group reactive with the active hydrogen group, a crystalline polyether resin having a functional group reactive with the active hydrogen group, and a crystalline vinyl resin having a functional group reactive with the active hydrogen group. The crystalline resin having a functional group reactive with the active hydrogen group is allowed to react with a resin containing an active hydrogen group, or a catalyst containing an active hydrogen group (e.g., a crosslinking agent or elongation agent containing an active hydrogen group) during the production of a toner, so that the molecular weight of the resulting resin is increased to form a binder resin. Therefore, the crystalline resin having a functional group reactive with the active hydrogen group can be used as a binder resin precursor during the production of a toner.

Note that, the binder resin precursor denotes a compound capable of undergoing an elongation reaction or crosslink reaction, including the aforementioned monomers, oligomers, modified resins having a functional group reactive with an active hydrogen group, and oligomers for constituting the binder resin. The binder resin precursor may be a crystalline resin or a non-crystalline resin, provided that it satisfies these conditions. Among them, the binder resin precursor is preferably the modified crystalline resin containing an isocyanate group at least at a terminal thereof, and it is preferred that the binder resin precursor undergo an elongation and/or crosslink reaction with an active hydrogen group during granulating toner particles by dispersing and/or emulsifying in an aqueous medium, to thereby form a binder resin.

As for the binder resin formed from the binder resin precursor in the aforementioned manner, a crystalline resin obtained by an elongation reaction and/or crosslink reaction of the modified resin containing a functional group reactive with an active hydrogen group and the compound containing an active hydrogen group is preferable. Among them, a urethane-modified polyester resin obtained by an elongation and/or crosslink reaction of the polyester resin containing a terminal isocyanate group and the polyol; and a urea-modified polyester resin obtained by an elongation reaction and/or crosslink reaction of the polyester resin containing a terminal isocyanate group and the amines are preferable.

The functional group reactive with an active hydrogen group is appropriately selected depending on the intended purpose without any limitation, and examples thereof include functional groups such as an isocyanate group, an epoxy group, a carboxylic group, and an acid chloride group. Among them, the isocyanate group is preferable in view of the reactivity and stability.

The compound containing an active hydrogen group is appropriately selected depending on the intended purpose without any limitation, provided that it contains an active hydrogen group. In the case where the functional group reactive with an active hydrogen group is an isocyanate group, for example, the compound containing an active hydrogen group includes compounds containing a hydroxyl group (e.g., alcoholic hydroxyl group and phenolic hydroxyl group), an amino group, a carboxyl group, and a mercapto group as the active hydrogen group. Among them, the compound containing an amino group (e.g., amines) is particularly preferable in view of the reaction speed.

The amine is appropriately selected depending on the intended purpose without any limitation, and examples thereof include phenylene diamine, diethyl toluene diamine, 4,4' diaminodiphenylmethane, 4,4'-diamino-3,3' dimethyldicyclohexylmethane, diaminocyclohexane, isophorone diamine, ethylene diamine, tetramethylene diamine, hexamethylene diamine, diethylene triamine, triethylene tetramine, ethanol amine, hydroxyethyl aniline, aminoethylmercaptan, aminopropylmercaptan, amino propionic acid, and amino caproic acid. Moreover, a ketimine compound and oxazoline compound where amino groups of the preceding amines are blocked with ketones (e.g., acetone, methyl methyl ketone, and methyl isobutyl ketone) are also included as the examples of the amines.

The crystalline resin may be a block copolymer resin having a crystalline segment and a non-crystalline segment, and the crystalline resin can be used as the crystalline segment. A resin used for forming the non-crystalline segment is appropriately selected depending on the intended purpose without any limitation, and examples thereof include a polyester resin, a polyurethane resin, a polyurea resin, a polyamide resin, a polyether resin, a vinyl resin (e.g., polystyrene, and a styrene acryl-based polymer), and an epoxy resin.

Since the crystalline segment is preferably at least one selected from the group consisting of a polyester resin, a polyurethane resin, a polyurea resin, a polyamide resin, and a polyether resin, in view of compatibility, the resin used for forming the non-crystalline segment is also preferably selected from a polyester resin, a polyurethane resin, a polyurea resin, a polyamide resin, a polyether resin, and a composite resin thereof, more preferably a polyurethane resin, or a polyester resin. The formulation of the non-crystalline segment can be any combinations of materials which are appropriately selected depending on the intended purpose without any limitation, provided that it is a non-crystalline resin. Examples of a monomer for use include the aforementioned polyol, the aforementioned polycarboxylic acid, the aforementioned polyisocyanate, the aforementioned polyamine, and the aforementioned AO.

Examples of the resin having a crystalline polyester unit include a resin composed only of a crystalline polyester unit (may be referred to merely as a crystalline polyester resin), a resin in which crystalline polyester units are linked, and a resin in which a crystalline polyester unit is bonded to another polymer (e.g., a block polymer, and a graft polymer). The resin composed only of a crystalline polyester unit has a high proportion of parts thereof having a crystalline structure, but it may be easily deformed by external force. This is because it is difficult to crystallize the entire part of the crystalline polyester, and the molecular chains in the part where it is not crystallized (amorphous part) have high freedom, therefore it is easily deformed. As another reason, a super-order structure of the part having a crystalline structure typically has a so-called lamella structure, in which a molecular chain is folded to form a plain, and theses planes are laminated. The lamella layer is easily moved off as a strong binding force does not act between lamella layers. If the binder resin of the toner is easily deformed by external force, it is possible to cause problems, such as deformations and aggregations of the toner inside an image forming apparatus, deposition or solidification of the toner to the member, and damage easily formed in an output final image. Therefore, it is desirable that the binder resin is resistant to a certain degree of the deformation caused by the application of external force, and has toughness.

In view of application of toughness to the resin, preferred are a resin crystalline polyester units having a segment having high aggregation energy (e.g., a urethane bond segment, a urea bond segment, and a phenylene segment) are linked, and a resin (e.g., a block polymer, and a graft polymer) in which a crystalline polyester unit is bonded to another polymer. Among them, use of the urethane bond segment or the urea bond segment in a molecular chain is particularly preferable, because it can form a quasi-crosslink point due to a strong intermolecular force in a non-crystalline segment or between lamella layers, and it also contribute to give desirable wettability of a resulting toner to paper after fixing, and to enhance fixing strength.

—Non-Crystalline Resin—

The non-crystalline resin is appropriately selected from conventional resin depending on the intended purpose without any limitation, and examples thereof include: homopolymer of styrene or substitution thereof (e.g., polystyrene, poly-p-styrene, and polyvinyl toluene), styrene copolymer (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and other resins (e.g., a polymethyl methacrylate resin, a polybutyl methacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, a polyacrylic acid resin, a rosin resin, a modified rosin resin, a terpene resin, an aliphatic or alicyclic hydrocarbon resin, and an aromatic petroleum resin). These may be used alone, or in combination.

<First Resin (a)>

The first resin (a) is appropriately selected depending on the intended purpose without any limitation, but it is preferably a polyester resin.

An acid value of the polyester resin is preferably 10 mgKOH/g to 40 mgKOH/g, more preferably 10 mgKOH/g to 35 mgKOH/g. When the acid value thereof is greater than 40 mgKOH/g, a resulting coating film tends to have insufficient water resistance. When the acid value thereof is less than 10 mgKOH/g, an amount of carboxyl groups contributing to formation of the polyester resin into a polyester resin aqueous dispersion liquid is not sufficient, and therefore an excellent water dispersion liquid may not be attained. Moreover, it is preferred that the weight average molecular weight thereof as measured by gel permeation chromatography (GPC, polystyrene-conversion) be 9,000 or greater, or the relative viscosity thereof as measured at 20° C. with a 1% sample solution, in which the polyester resin is dissolved in a mixed solution of phenol and 1,1,2,2-tetrachloroethane at the equivalent mass ratio to give a concentration of 1% by mass, be preferably 1.20 or greater. When the weight average molecular weight is smaller than 9,000, or the relative viscosity is less than 1.20, a sufficient processability may not be imparted to a coating film formed from an aqueous dispersion liquid of the polyester resin. Moreover, the weight average molecular weight of the polyester resin is preferably 12,000 or greater, more preferably 15,000 or greater. The upper limit of the weight average molecular weight is preferably 45,000 or smaller. When the weight average molecular weight thereof is greater than 45,000, the runnability for the production of the polyester resin may be impaired, and an aqueous dispersion liquid using such polyester resin tends to have excessively high viscosity. Moreover, the relative viscosity thereof is preferably 1.22 or greater, more preferably 1.24 or greater. The upper limit thereof is preferably 1.95 or less. When the relative viscosity thereof is greater than the aforementioned upper limit, the runnability for the production of the polyester resin may be impaired, and an aqueous dispersion liquid using such polyester resin tends to have excessively high viscosity.

The polyester resin is substantially insoluble to water, and is not dispersed or solved in water per se. The polyester resin is substantially synthesized from polybasic acid, and polyhydric alcohol. Constitutional components of the polyester resin will be explained below.

Examples of the polybasic acid include aromatic dicarboxylic acid, aliphatic dicarboxylic acid, and alicyclic dicarboxylic acid. Examples of the aromatic dicarboxylic acid include terephthalic acid, isophthalic acid, ortho-phthalic acid, naphthalene dicarboxylic acid, and biphenyl dicarboxylic acid. Moreover, a small amount of 5-sodium sulfoisophthalic acid or 5-hydroxyisophthalic acid can be optionally used, provided that it does not impair water resistance. Examples of the aliphatic dicarboxylic acid include: saturated dicarboxylic acid, such as oxalic acid, succinic acid (anhydride), adipic acid, azelaic acid, sebacic acid, dodecane diacid, and hydrogenated dimer acid; and unsaturated dicarboxylic acid, such as fumaric acid, maleic acid (anhydride), itaconic acid (anhydride), citraconic acid (anhydride), and dimer acid. Examples of the alicyclic dicarboxylic acid include 1,4-cyclohexanedicarboxylic acid, 1,3-cyclohexanedicarboxylic acid, 1,2-cyclohexanedicarboxylic acid, 2,5-norbornene dicarboxylic acid (anhydride), and tetrahydrophthalic acid (anhydride).

In the polyester resin, an amount of the aromatic polybasic acid is preferably 50 mol % or greater relative to the total amounts of the acid components. When the amount thereof is smaller than 50 mol %, the structures derived from the aliphatic polybasic acid and the alicyclic polybasic acid occupies more than a half of the resin skeleton, and therefore a resulting coating film may have insufficient hardness, pollution resistance, and water resistance, and moreover, storage stability of an aqueous dispersion liquid may be low, as the ester bonds of aliphatic and/or alicyclic have low hydrolysis resistance compared to the aromatic ester bonds. In order to secure desirable storage stability of the aqueous dispersion liquid, the amount of the aromatic polybasic acid is preferably 70 mol % or greater relative to a total amount of the acid components. To achieve the object of the present invention, it is particularly preferred that 65 mol % or greater of the total amount of the acid components be tetraphthalic acid, in order to improve processing ability, water resistance, chemical resistance, and weather resistance with balancing with other properties of a coating film to be formed.

Examples of the polyhydric alcohol include glycol (e.g., C2-C10 aliphatic glycol, C6-C12 alicyclic glycol, and ether bond-containing glycol). Examples of the C2-C10 aliphatic glycol include ethylene glycol, 1,2-propylene glycol, 1,3-propanediol, 1,4-butanediol, 2-methyl-1,3-propanediol, 1,5-pentanediol, neopentyl glycol, 1,6-hexanediol, 3-methyl-1,5-pentanediol, 1,9-nonanediol, and 2-ethyl-2-butylpropanediol. Examples of the C6-C12 alicyclic glycol include 1,4-cyclohexanedimethanol. Examples of the ether bond-containing glycol include diethylene glycol, triethylene glycol, dipropylene glycol, and glycol obtained by adding 1 or more moles of ethylene oxide or propylene oxide to two phenolic hydroxyl groups of bisphenol (e.g., 2,2-bis (4-hydroxyethoxyphenyl)propane). Optionally, polyethylene glycol, polypropylene glycol, and polytetramethylene glycol may be used. However, the amount thereof is preferably kept to 10% by mass or smaller, more preferably 5% by mass or smaller relative to the entire polyhydric alcohol component, as the ether structure lowers water resistance and weather resistance of the coating film of the polyester resin.

In the present invention, 50 mol % or greater, particularly 65 mol % or greater of the entire polyhydric alcohol component of the polyester resin is preferably composed of at least either ethylene glycol, or neopentyl glycol. The ethylene glycol and neopentyl glycol are inexpensive, as they are industrially manufactured, and various properties of a coating film to be formed are desirably balanced, and particularly the ethylene glycol component improves chemical resistance, and the neopentyl glycol component improves weather resistance.

The polyester resin for use as the first resin (a) can be optionally copolymerized with at least one selected from tri- or higher functional polybasic acid and polyhydric alcohol. Examples of the tri- or higher functional polybasic acid include trimellitic acids (anhydride), pyromellitic acid (anhydride), benzophenone tetracarboxylic acid (anhydride), trimesic acid, ethylene glycol bis(anhydrotrimellitate), glycerol tris(anhydrotromellitate), and 1,2,3,4-butane tetracarboxylic acid. Examples of the tri- or higher functional polyhydric alcohol include glycerin, trimethylol ethane, trimethylol propane, and pentaerythritol. An amount of the tri or higher functional polybasic acid or polyhydric alcohol is preferably 10 mol % or smaller, more preferably 5 mol % or smaller, relative to the entire acid component or the entire alcohol component. When the amount thereof is greater than 10 mol %, high processability of a coating film, which is an advantage obtainable by use of the polyester resin, may not be exhibited.

Moreover, optionally used are fatty acid (e.g., lauric acid, myristic acid, palmitic acid, stearic acid, oleic acid, linoleic acid, and linolenic acid) or ester forming derivatives thereof, monocarboxylic acid having a high boiling point (e.g., benzoic acid, p-tert-butyl benzoate, cyclohexanoic acid, and 4-hydroxyphenylstearic acid), monoalcohol having a high boiling point (e.g., stearyl alcohol, and 2-phenoxy ethanol), and hydroxyl carboxylic acid (e.g., ϵ-caprolactone, lactic acid, β-hydroxybutyrate, p-hydroxybenzoate) and ester forming derivatives thereof.

The polyester resin is synthesized from the monomers using a conventional method. Examples thereof include the following methods:

(a) a method containing reacting the entire monomer component and/or low polymers thereof for 2.5 hours to 10 hours at 180° C. to 250° C. in an inert atmosphere to perform an esterification reaction, followed by carrying out a polycondensation reaction in the presence of a catalyst at 220° C. to 280° C. under the reduced pressure of 1 Torr or lower until it reaches a desirable melt viscosity, to thereby produce a polyester resin, (b) a method containing terminating the polycondensation reaction before it reaches the targeted melt viscosity, mixing the reaction product with a chain elongation agent selected from a polyfunctional epoxy-based compound, an isocyanate-based compound, and an oxazoline-based compound, and allowing the mixture to react for a short period to thereby increase the molecular weight of the polyester resin, and (c) a method containing carrying out the polycondensation reaction until the melt viscosity of the reaction product becomes the equal to or above the targeted melt viscosity, further adding a monomer component, and allowing the resulting mixture to carry out depolymerization in an inert atmosphere under the atmospheric pressure or in a pressurized state, to thereby obtain a polyester resin having the targeted melt viscosity.

It is preferred that a carboxyl group required for the formation of the polyester resin into the polyester resin aqueous dispersion liquid be locally present at a terminal of a molecular chain of the resin, rather than present within the skeleton of the resin, in view of water resistance of a coating film to be formed. As a method for introducing a certain amount of carboxyl groups at terminals of molecular chains of a high molecular weight polyester resin, preferred are, in case of a production of a polyester resin, a method for adding tri- or higher functional polybasic acid component at the same time or after initiation of a polycondensation reaction, or adding acid anhydride of the polybasic acid just before the completion of the polycondensation reaction in the method (a), a method for increasing a molecular weight of a low molecular weight polyester resin, a majority of which has a terminal carboxyl group in the molecular chain, using a chain elongation agent in the method (b), and a method for using a polybasic acid component as a depolymerization agent in the method (c).

An amount of the polyester resin in the polyester resin aqueous dispersion resin during the formation of the toner is appropriately selected depending on the intended use, film thickness on dry bases, and forming method, but it is typically 0.5% by mass to 50% by mass, preferably 1% by mass to 40% by mass. In the present invention, an aqueous dispersion liquid of the polyester resin has an advantage that it has excellent storage stability even through having a high solid content, such that an amount of the polyester resin is 20% by mass or greater. However, when the amount of the polyester resin is greater than 50% by mass, the viscosity of the polyester resin aqueous dispersion liquid increases significantly, and therefore it may be difficult to substantially form a coating film.

[Basic Compound]

The polyester resin of the first resin (a) for use in the present invention is preferably neutralized with a basic compound. In the present invention, a driving force for forming the polyester resin into a polyester resin aqueous dispersion liquid (formation of resin particles) is a neutralization reaction between a carboxyl group in the polyester resin and the basic compound, and moreover electric repulsive force generated carboxy anions as generated can prevent aggregation of the particles with using a small amount of protective colloid in combination.

The basic compound is preferably a compound that evaporates during formation of a coating film, or during baking and curing in a formulation thereof containing a curing agent, and examples thereof include ammonia, and an organic amine compound having a boiling point of 250° C. or lower. Preferable examples of the organic amine compound include triethyl amine, N,N-diethylethanol amine, N,N-dimethylethanol amine, aminoethanol amine, N-methyl-N,N-diethanol amine, isopropyl amine, iminobispropyl amine, ethyl amine, diethyl amine, 3-ethoxypropyl amine, 3-diethylaminopropyl amine, sec-butyl amine, propyl amine, methylaminopropyl amine, dimethylaminopropyl amine, methyliminobispropyl amine, 3-methoxypropyl amine, monoethanol amine, diethanol amine, triethanol amine, morpholine, N-methylmorpholine, and N-ethylmorpholine.

The basic compound is preferably used in an amount with which at least part of the polyester resin is neutralized, depending on the number of carboxyl groups contained in the polyester. Specifically, the amount of the basic compound is preferably 0.2 times to 1.5 times the equivalent amount of the carboxyl groups, more preferably 0.4 times to 1.3 times the equivalent amount. When the amount thereof is smaller than 0.2 times the equivalent amount, an effect obtainable by adding the basic compound may not be attained. When the amount thereof is greater than 1.5 times the equivalent amount, the viscosity of the polyester resin aqueous dispersion liquid may significantly increase.

[Amphipathic Organic Solvent]

In order to accelerate the formation of the polyester resin into the polyester resin aqueous dispersion liquid, an amphipathic organic solvent having a plasticizing capacity is preferably used with the polyester resin in the formation of the polyester resin into the polyester resin aqueous dispersion liquid. However, the organic solvent having a boiling point of higher than 250° C. is not preferably used because such solvent has extremely slow evaporating speed, and the solvent cannot be sufficiently removed during drying of a coating film. Accordingly, usable amphipathic organic solvents are readily available compounds, so-called organic solvents, having a boiling point of 250° C. or lower, and having low toxicity, explosivility, and inflammability.

The characteristics required for the organic solvent are being amphipathic, and having a plasticizing capacity for the polyester resin.

The amphipathic organic solvent means an organic solvent having solubility of 5 g/L or more to water at 20° C., more preferably 10 g/L or more. The organic solvent having solubility of less than 5 g/L has a poor effect of accelerating the formation of the polyester resin into the polyester resin aqueous dispersion liquid.

Moreover, the plasticizing capacity of the organic solvent can be judged by a simple method as described below. The organic solvent, which is judged as having no plasticizing capacity, has a poor effect of accelerating the formation of the polyester resin into the polyester resin aqueous dispersion liquid.

—Plasticizing Capacity Test—

A square plate having a size of 3 cm×3 cm×0.5 cm (thickness) was prepared from a target polyester resin, and the prepared sample is immersed in 50 mL of an organic solvent in an atmosphere of 25° C. to 30° C. Three hours later, whether or not the shape of the square plate has been deformed is confirmed by bringing a stainless steel round bar having a diameter of 0.2 cm into contact with the square plate, while statically applying a force of 1 kg/cm$^2$. When 0.3 cm or more of the round bar penetrates into the square plate, such organic solvent is judged as having a plasticizing capacity.

Examples of the organic solvent include: alcohol, such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-propanol, n-hexanol, cyclohexanol; ketone, such as methyl ethyl ketone, methyl isobutyl ketone, ethylbutyl ketone, cyclohexanone, and isophorone; ether, such as tetrahydrofuran, and dioxane; ester, such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate, and dimethyl carbonate; a glycol derivative, such as ethylene glycol, ethylene glycol monomethyl ether, ethylene glycol monoethyl ether, ethylene glycol monobutyl ether, ethylene glycolethyl ether acetate, diethylene glycol, diethylene glycol monomethyl ether, diethylene glycol monoethyl ether, diethylene glycol monobutyl ether, diethylene glycolethyl ether acetate, propylene glycol, propylene glycol monomethyl ether, propylene glycol monobutyl ether, and propylene glycolmethyl ether acetate; and others, such as 3-methoxy-3-methyl butanol, 3-methoxy butanol, acetonitrile, dimethyl formamide, dimethyl acetoamide, diacetone alcohol, and ethyl acetoacetate. These solvents may be used alone, or in mixture.

Among the above-listed organic solvent, use of the compound satisfying the following two conditions alone, or in combination can give an excellent effect of accelerating the formation of the polyester resin into the polyester resin aqueous dispersion liquid, and contributes to formation of a polyester resin aqueous dispersion liquid having excellent storage stability. (Condition 1) To have a hydrophobic structure, in which four or more carbon atoms are directly bonded, in a molecular. (Condition 2) To have a substitute having at least one atom having Pauling electronegativity of 3.0 or more at a terminal of a molecular chain, and to have a carbon atom directly bonded to the atom having Pauling electronegativity of 3.0 or more of the aforementioned substitute, in which a chemical shift of the $^{13}$C-NMR (nuclear magnetic resonance) spectrum of the carbon atom is 50 ppm or greater as measured in $CDCl_3$, at room temperature.

The substituent specified in the condition 2 include, for example, an alcoholic hydroxyl group, a methyl ether group, a ketone group, an acetyl group, and a methyl ester group. Among the compounds satisfying these two conditions, particularly preferred organic solvents are: alcohol, such as n-butanol, isobutanol, sec-butanol, tert-butanol, n-amyl alcohol, isoamyl alcohol, sec-amyl alcohol, tert-amyl alcohol, n-hexanol, and cyclohexanol; ketone, such as methyl isobutyl ketone, and cyclohexanone; ester, such as n-butyl acetate, isobutyl acetate, sec-butyl acetate, and 3-methoxybutyl acetate; a glycol derivative, such as ethylene glycol monobutyl ether, diethylene glycol monobutyl ether, and propylene glycol monobutyl ether; and others, such as 3-methoxy-3-methyl butanol, and 3-methoxy butanol.

The organic solvent can be partially or entirely removed (stripped) from the system during the formation of the polyester resin into the polyester resin aqueous dispersion liquid or sequential step, provided that the organic solvent has a boiling point of 100° C. or lower, or the organic solvent can form azeotrope with water. A definitive amount of the organic solvent in the polyester resin aqueous dispersion liquid is preferably 0.5% by mass to 10% by mass, more preferably 0.5% by mass to 8.0% by mass, and even more preferably 1.0% by mass to 5.0% by mass. When the amount thereof is 0.5% by mass to 10% by mass, the polyester resin aqueous dispersion liquid has excellent storage stability, and excellent formability of a coating film. When the amount thereof is smaller than 0.5% by mass, it may take a long time for the formation of the polyester resin into the polyester resin aqueous dispersion liquid, and polyester resin particles having a desirable particle size distribution may not be formed. When the amount thereof is greater than 10% by mass, an original purpose for making the polyester resin aqueous dispersion liquid is impaired, and a proportion of secondary particles in the aqueous dispersion liquid, which will be explained later, increases, which may lead to excessively high viscosity of the aqueous dispersion liquid, poor storage stability, and undesirable formability of a coating film.

[Compound Having Function of Protective Colloid]

In the present invention, a protective colloid is optionally used for securing stability of the aqueous dispersion liquid during a process for removing (stripping) the organic solvent from the system, or during storage. In the present specification, the protective colloid means a colloid, which is adsorbed on surfaces of resin particles in an aqueous medium, and exhibits stabilizing effects, i.e., "mixing effect," "osmotic pressure," and "volume limiting effect" to prevent adsorption between the resin particles. Examples of the compound having a function of protective colloid include polyvinyl alcohol, carboxymethyl cellulose, hydroxyethyl cellulose, hydroxypropyl cellulose, modified starch, polyvinylpyrrolidone, polyacrylic acid, a polymer of a vinyl monomer using acrylic acid and/or methacrylic acid as one component, polyitaconic acid, gelatine, Arabian gum, casein, and swelling mica. The compound having a function of protective colloid is made water soluble, or partially neutralized with the basic compound. In order to maintain water resistance of a resulting coating film, however, the basic compound is desirably ammonia and/or the aforementioned organic amine compound. Moreover, in order to exhibit a function of the protective colloid with a small amount, and secure water resistance and chemical resistance of a resulting coating film, the number average molecular weight of the compound having a function of protective colloid is preferably 1,500 or greater, more preferably 2,000 or greater, and even more preferably 2,500 or greater.

An amount of the compound having a function of protective colloid is preferably 0.01% by mass to 3% by mass, more preferably 0.03% by mass to 2% by mass, relative to the polyester resin. When the amount thereof is within the aforementioned range, the stability of the polyester resin aqueous dispersion liquid can be significantly improved during the formation of the polyester resin into the polyester resin aqueous dispersion liquid and during storage, without adversely affecting various properties of a resulting coating film. Moreover, use of the compound having a function of protective colloid can reduce the acid value of the polyester resin, and the amount of the organic solvent used. Moreover, an amount of the compound having a function of protective colloid relative to the polyester resin is preferably 0.05% by mass or smaller, and more preferably 0.03% by mass or smaller. When the amount thereof is 0.05% by mass or smaller, the stability of the polyester resin aqueous dispersion liquid can be significantly improved during the formation of the polyester resin into the polyester resin aqueous dispersion liquid and during storage, without adversely affecting various properties of a resulting coating film.

<Production Method of Resin Particles (C)>

The resin particles (C) for use in the present invention can be formed by any production method, provided that each resin particle (C) contains the resin particle (B) containing the second resin (b) and the filler (f), and the resin particles (A) containing the first resin (a) or the coating film (P) containing the first resin (a) covering a surface of the resin particle (B).

The resin particles (C) for use in the present invention may be any resin particles produced by any method or process, but examples of a production method of resin particles include the following methods (I) and (II):

(I): A method containing mixing an aqueous dispersion liquid (W) of resin particles (A) containing the first resin (a), [the second resin (b), or an organic solvent solution or dispersion liquid thereof] (referred to as (O1) hereinafter) or [a precursor (A) of the second resin (b) or an organic solvent solution or dispersion liquid thereof] (referred to as (O2) hereinafter), and the filler (f), to dispersed (O1) or (O2), and the filler (f) in (W), and forming resin particles (B) containing the first resin (b) and the filler (f) in the aqueous dispersion liquid (W).

In this case, at the same time as the granulation of the resin particles (B), the resin particles (A) or the coating film (P) is deposited on a surface of the resin particle (B), to thereby yield an aqueous dispersion liquid (X) of the resin particles (C). By removing the aqueous medium from the aqueous dispersion liquid (X), the resin particles (C) are obtained.

(II): A method containing coating previously prepared resin particles (B), each of which contains the second resin (b) and the filler (f), with a coating agent (W') containing the first resin (a), to thereby obtain the resin particles (C).

In this case, the coating agent (W') may be in any state, such as a liquid, and a solid. Moreover, the first resin (a) may be obtained by coating with a precursor (a') of the first resin (a), followed by allowing the precursor (a') to react. Further, the resin particles (B) for use may be resin particles produced by an emulsification polymerization aggregation method, or resin particles produced by a pulverization method, or resin particles produced by any other methods. The coating method is not particularly limited, and examples thereof include: a method containing dispersing, in an aqueous dispersion liquid (W) of the resin particles (A) containing the first resin (a), the resin particles (B) prepared in advance, or a dispersion liquid of the resin particles (B); and a method containing sprinkling, as a coating agent, a solution of the first resin (a) to the resin particles (B).

Among them, the production method (I) is preferable.

The resin particles (C) are more preferably obtained by the following production method, as the resin particles having uniform particle diameters can be attained.

Specifically, the method contains mixing the aqueous dispersion liquid (W) of the resin particles (A), the (O1) [the second resin (b) or organic solvent solution or dispersion liquid thereof] or the (O2) [the precursor (b0) of the second resin (b), or organic solvent solution or dispersion liquid thereof], and the filler (f), to disperse the (O1) or (O2) in the aqueous dispersion liquid (W), to thereby form resin particles (B) containing the second resin (b) and the filler (f). By adsorbing the resin particles (A) on surfaces of the resin particles (B) during the formation as mentioned above, cohesion between resulting resin particles (C) can be presented, and moreover, the resin particles (C) are made difficult to be divide under the high shear condition. As a result of this the particle diameters of the resin particles (C) are adjusted in a certain range, and an effect for increasing uniformity of particle diameters is exhibited. Accordingly, preferable properties of the resin particles (A) are having a strength to a degree at which the resin particles (A) are not crashed by shearing at temperature during dispersion, being insoluble or not swollen with water, and being not dissolved with the second resin (b) or organic solvent solution or dispersion liquid thereof, or the precursor (b0) of the second resin (b) or organic solvent solution or dispersion liquid thereof.

Moreover, other toner components to be contained, such as a colorant, a releasing agent, and a modified layered inorganic mineral, are encapsulated in the resin particles (B). To this end, these toner components are dispersed in a solution of (O) before mixing the aqueous dispersion liquid (W) and (O) (O1 or O2) together. Moreover, the charge controlling agent may be encapsulated in the resin particles (B), or externally added to the resin particles (B). In the case where the charge controlling agent is encapsulated, similarly to the colorant, etc., the charge controlling agent can be dispersed in the solution of (O). In the case where the charge controlling agent is externally added, the charge controlling agent is externally added after formation of particles C.

It is preferred that a molecular weight, sp value (a calculation method of the sp value is referred to Polymer Engineering and Science, February, 1974, vol. 14, no. 2, pp. 147-154), crystallinity, and molecular weight between cross-link points of the first resin (a) be appropriately adjusted in order to reduce dissolution or swelling of the resin particles (A) to water, or a solvent used for dispersing.

In the present invention, the number average molecular weight (Mn) and the weight average molecular weight (Mw) of the resin exclusive of the polyurethane resin, such as a polyester resin, can be measured by measuring a tetrahydrofuran (THF) soluble component by gel permeation chromatography (GPC) under the following conditions.

Device (one example): HLC-8120, manufactured by TOSOH CORPORATION
Column (one example): TSKgelGMHXL (2 columns), TSKgelMultiporeHXL-M (1 column)
Sample solution: 0.25% by mass THF solution
Solution supply amount: 100 μL
Flow rate: 1 mL/min
Measuring temperature: 40° C.
Detector: reflective index detector
Standard material: Standard polystyrene polystyrene (TSK standard POLYSTYRENE) of TOSOH CORPORATION, 12 materials (molecular weight: 500, 1,050, 2,800, 5,970, 9,100, 18,100, 37,900, 96,400, 190,000, 355,000, 1,090,000, 2,890,000)

Moreover, Mn and Mw of the polyurethane resin are measured by means of GPC under the following conditions.

Device (one example): HLC-8220GPC, manufactured by TOSOH CORPORATION
Column (one example): GuardcolumnaTSKgelα-M
Sample solution: a 0.125% by mass dimethyl formamide solution
Solution supply amount: 100 μL
Flow rate: 1 mL/min
Temperature: 40° C.
Detector: reflective index detector
Standard material: Standard polystyrene polystyrene (TSK standard POLYSTYRENE) of TOSOH CORPORATION, 12 materials (molecular weight: 500, 1,050, 2,800, 5,970, 9,100, 18,100, 37,900, 96,400, 190,000, 355,000, 1,090,000, 2,890,000)

The glass transition temperature (Tg) of the first resin (a) is preferably 50° C. to 100° C., more preferably 51° C. to 90° C., and even more preferably 52° C. to 75° C., in view of uniform particle size of the resin particles (C), powder flowability, heat resistance during storage, and stress resistance. When the Tg thereof is lower than the temperature at which an aqueous resin dispersion liquid is prepared, an effect of preventing cohesion and cracking may become small, and therefore an effect of enhancing uniformity of particle diameters becomes small. From the same reasons to the above, the Tg of the resin particles (A) containing the first resin (a) and the coating film (P) containing the first resin (a) is preferably 50° C. to 100° C., more preferably 51° C. to 90° C., and even more preferably 52° C. to 75° C. Note that, in the present specification, Tg is a value obtained by DSC or a measurement performed with a flow tester (in the case where the measurement is not performed by DSC).

In the case of the measurement by DSC, the measurement of performed in accordance with a method (DSC) specified in ASTMD3418-82 by means of DSC20, SSC/580 manufactured by Seiko Instruments Inc.

For the flow tester measurement, an elevated flow tester CFT500 manufactured by Shimadzu Corporation is used. Conditions for the flow tester are as described below, and all the measurements are performed under these conditions hereinafter.

(Conditions for Flow Tester Measurement)
Load: 30 kg/cm$^2$
Heating rate: 3.0° C./min
Diameter of die: 0.50 mm
Length of die: 10.0 mm As mentioned earlier, the first resin (a) is selected from conventional resins. In the case where the glass transition temperature (Tg) of the first resin (a) is adjusted, the glass transition temperature (Tg) thereof can be easily adjusted by adjusting the molecular weight of the first resin (a) and/or changing a formulation of monomers constituting the first resin (a). As for a method for adjusting the molecular weight of the first resin (a) (Tg increases, as the molecular weight increases), a conventional method can be used. For example, in the case where polymerization is performed by a successive reaction, such as the case of a polyester resin, a blending ratio of monomers is adjusted to adjust the molecular weight of the first resin (a).

Other than water, the aqueous dispersion liquid (W) of the resin particles (A) may contain therein an organic solvent (u) miscible with water (e.g., acetone, and methyl ethyl ketone). The organic solvent contained may be any organic solvent, provided that it does not cause aggregations of the resin particles (A), does not dissolve the resin particles (A), and does not prevent granulation of the resin particles (C). Moreover, an amount thereof is not particularly limited, but it is preferably an amount that is 40% by mass or smaller relative to the total amount of the water and the organic solvent, and does not remain in the resin particles (C) after drying.

The organic solvent (u) for use in the present invention may be optionally added to an aqueous medium during the emulsification dispersion, or added to a dispersion liquid to be emulsified [an oil phase (O1) containing the second resin (b)]. Specific examples of the organic solvent (u) include: an aromatic hydrocarbon-based solvent, such as toluene, xylene, ethyl benzene, and tetralin; an aliphatic or alicyclic hydrocarbon-based solvent, such as n-hexane, n-heptane, and mineral sprit cyclohexane; a halogen-based solvent, such as methyl chloride, methyl bromide, methyl iodide, methylene dichloride, carbon tetrachloride, trichloroethylene, and perchloroethylene; an ester, or ester ether-based solvent, such as ethyl acetate, butyl acetate, methoxybutyl acetate, methyl cellosolve acetate, and ethyl cellosolve acetate; an ether-based solvent, such as ethyl ether, tetrahydrofuran dioxane, ethyl cellosolve, butyl cellosolve, and propylene glycol monomethyl ether; a ketone-based solvent, such as acetone, methyl ethyl ketone, methyl isobutyl ketone, di-n-butyl ketone, and cyclohexanone; an alcohol-based solvent, such as methanol, ethanol, n-propanol, isopropanol, n-butanol, isobutanol, t-butanol, 2-ethylhexyl alcohol, and benzyl alcohol; an amide-based solvent, such as dimethyl formamide, and dimethyl acetoamide; a sulfoxide-based solvent, such as dimethyl sulfoxide; a heterocylic compound-based solvent, such as N-methylpyrrolidone; and a mixed solvent containing a combination of any two or more of the above-listed solvents.

A plasticizer (v) may be optionally added to an aqueous medium during the emulsification dispersion, or added to a dispersion liquid to be emulsified [an oil phase (O1) containing the second resin (b)]. The plasticizer (v) is not particularly limited, and examples thereof include those as listed below:

(v1) phthalic acid ester [e.g., dibutyl phthalate, dioctyl phthalate, butylbenzyl phthalate, and diisodecyl phthalate];

(v2) aliphatic dibasic acid ester [e.g., di-2-ethylhexyl adipate, and 2-ethylhexyl sebacate];

(v3) trimellitic acid ester [e.g., tri-2-ethylhexyl trimellitate, and trioctyl trimellitate];

(v4) phosphoric acid ester [e.g., triethyl phosphate, tri-2-ethylhexyl phosphate, and tricresyl phosphate];

(v5) fatty acid ester [e.g., butyl oleate];

(V6) a mixture containing any combination of the above-listed plasticizes.

The particle diameter of the resin particle (A) for use in the present invention is typically smaller than a particle diameter of a resin particle (B) to be formed. In view of uniformity of particle diameters, a particle size ratio [the volume average particle diameter of the resin particles (A)]/[the volume average particle diameter of the resin particles (B)] is preferably in the range of 0.001 to 0.3. The lower limit of the particle size ratio is more preferably 0.003, and the upper limit thereof is more preferably 0.25. When the particle size ratio is greater than 0.3, the resin particles (A) are not efficiently adsorbed on a surface of the resin particle (B), and therefore a particle size distribution of resulting resin particles (C) tends to be wide.

The volume average particle diameter of the resin particles (A) can be appropriately adjusted in the aforementioned range of the particle size ratio to be suitable for giving a predetermined particle size of resin particles (C).

The volume average particle diameter of the resin particles (A) is typically, preferably 0.0005 μm to 1 μm. The upper limit thereof is more preferably 0.75 μm, and even more preferably 0.5 μm. The lower limit thereof is more preferably 0.01 μm, even more preferably 0.02 μm, and particularly preferably 0.04 μm. In the case where a target to be produced is resin particles (C) having the volume average particle diameter of 1 μm, for example, the volume average particle diameter of the resin particles (A) is preferably 0.0005 μm to 0.30 μm, more preferably 0.001 μm to 0.2 μm. In the case where resin particles (C) having the volume average particle diameter of 10 μm are produced, the volume average particle diameter of the resin particles (A) is preferably 0.005 μm to 0.8 μm, more preferably 0.05 μm to 1 μm.

Note that, the volume average particle diameter can be measured by means of a laser particle size distribution measuring device LA-920 (manufactured by HORIBA Ltd.), Multisizer III (manufactured by Beckman Coulter Inc.), or ELS-800 (manufactured by Otsuka Electronics Co., Ltd.) using a laser Doppler method for an optical system. In the case where there is a difference in the measurement value of the particle diameter between the aforementioned measuring devices, the measurement value of ELS-800 is used. The volume average particle diameter of the below-mentioned resin particles (B) is preferably 0.1 μm to 15 μm, as the aforementioned particle size ratio can be achieved. The volume average particle diameter of the resin particles (B) is more preferably 0.5 μm to 10 μm, and even more preferably 1 μm to 8 μm.

An amount of the aqueous dispersion liquid (W) relative to 100 parts by mass of the second resin (b) is preferably 50 parts by mass to 2,000 parts by mass, more preferably 100 parts by mass to 1,000 parts by mass. When the amount thereof is 50 parts by mass or greater, an excellent dispersion state of the second resin can be achieved. When the amount thereof is 2,000 parts by mass or smaller, it is economical.

The resin particles (C) are obtained, for example, by mixing an aqueous dispersion liquid (W) of the resin particles (A) containing the first resin (a), the second resin (b) or organic solvent solution or dispersion liquid thereof (O1), and the filler (f), to disperse (O1) in the aqueous dispersion liquid (W), preparing an aqueous dispersion liquid (X) of the resin particles (C) each having a structure in which the first resin (a) is deposited on a surface of the resin particle (B) containing the second resin (b) and the filler (f), and removing the aqueous medium from the aqueous dispersion liquid (X). The state of the first resin (a) deposited on the surface of the resin particle (B) may be the resin particles (A) or the coating film (P). Whether the first resin (a) takes the state of the resin particles (A) or the coating film (P) is determined depending on the Tg of the first resin (a), and production conditions (temperature for removing the solvent) for the resin particles (C).

In the present specification, the resin particles (A) are particles in the state where an interface between the resin particles (A) present on a surface of the resin particle (C) can be confirmed. Moreover, in the present specification, the coating film (P) is the state where an interface between the resin particles (A) present on a surface of the resin particle (C) cannot be confirmed The surface state of the resin particle (C) can be confirmed, for example, by a scanning electron microscope.

The shapes or surface configurations of the resin particles (C) obtained by the production method (I) can be controlled by controlling a difference in the sp value of the first resin (a) and that of the second resin (b), and controlling a molecular weight of the first resin (a). When the difference in the sp value is small, particles having irregular shapes and smooth surfaces tend to be obtained. When the difference in the sp value is large, spherical particles having rough surfaces tend to be obtained. Moreover, when the molecular weight of the first resin (a) is large, particles having rough surfaces tend to be obtained. When the molecular weight thereof is small, particles having smooth surfaces tend to be obtained. Note that, however, particles cannot be formed with too small or too large difference on the sp value between the first resin (a) and the second resin (b). Moreover, an excessively small molecular weight of the first resin (a) also makes granulation difficult. Accordingly, the difference in the sp value between the first resin (a) and the second resin (b) is preferably 0.01 to 5.0, more preferably 0.1 to 3.0, and even more preferably 0.2 to 2.0.

In the case of the production method (II), the shapes of the resin particles (C) are largely influenced by the shapes of the resin particles (B) that have been formed in advance, and the resin particle (C) has a substantially same shape as that of the resin particle (B). In the case where the resin particles (B) have irregular shapes, however, special particles can be obtained by a larger amount of a coating agent (W') is used in the production method (II).

In view of the uniform particle diameters of the resin particles (C) and storage stability, the resin particles preferably contain 0.01% by mass to 60% by mass of the resin particles (A) or coating film (P) containing the first resin (a), and 40% by mass to 99.99% by mass of the resin particles (B) containing the second resin (b) and the filler, more preferably 0.1% by mass to 50% by mass of the resin particles (A) or coating film (P) and 50% by mass to 99.9% by mass of the resin particles (B), and even more preferably 1% by mass to 45% by mass of the resin particles (A) or coating film (P) and 55% by mass to 99% by mass of the resin particles (B). When the amount of the resin particles (A) or coating film (P) is 0.01% by mass or greater, excellent blocking resistance can be attained. When the amount thereof is 60% by mass or smaller, excellent fixing properties, especially excellent low temperature fixing ability, can be attained.

In view of uniform particle diameters of the resin particles (C), powder flowability, and storage stability, moreover, in the resin particle (C), 5% or greater, preferably 30% or greater, more preferably 50% or greater, and even more preferably 80% or greater of the surface of the resin particle (B) is covered with the resin particles (A) containing the first resin (a) or the coating film (P) containing the first resin (a). The surface covering rate of the resin particles (C) can be determined by the following formula based on an analysis of an image obtained by scanning electron microscopy (SEM).

Surface covering rate (%)=[area of the parts covered with resin particles (*A*) or coating film (*P*)/(area of the parts covered with resin particles (*A*) or coating film (*P*)+area of the parts where the resin particle (*B*) is exposed)]×100

In view of uniformity of particle diameters, the variation coefficient of the volume distribution of the resin particles (C) is preferably 30% or less, more preferably 0.1% to 15%. In view of uniformity of particle diameters, moreover, a value [volume average particle diameter/number average particle diameter] of the resin particles (C) is preferably 1.0 to 1.4, more preferably 1.0 to 1.3. The volume average diameter of the resin particles (C) is determined depending on the intended use, but it is typically preferably 0.1 μm to 16 μm. The upper limit thereof is more preferably 11 μm, and even more preferably 9 μm. The lower limit thereof is more preferably 0.5 μm, and even more preferably 1 μm. Note that the volume average particle diameter and number average particle diameter can be simultaneously measured by means of Multisizer III (manufactured by Beckman Coulter Inc.).

To the resin particles (C) for use in the present invention, desirable irregularities can be provided onto surfaces of the particles (C) by varying particle diameters of the resin particles (A) and the particle diameters of the resin particles (B), and covering rate of the surface of the resin particles (B) with the coating resin film (P) containing the first resin (a). In order to improve powder flowability, the BET specific surface area of the resin particles (C) is preferably 0.5 $m^2/g$ to 5.0 $m^2/g$. The BET specific surface area is the value measured (measuring gas: He/Kr=99.9 vol %/0.1 vol %, calibration gas: nitrogen) by means of a specific surface area analyzer, such as QUANTASORB (manufactured by Yuasa Ionics Inc.). Similarly in view of powder flowability, the centerline average surface roughness Ra of the resin particles (C) is preferably 0.01 μm to 0.8 μm. The Ra is an arithmetic average value of an absolute value of the deviation between the roughness curve and the center line thereof, and can be measured, for example, by a scanning probe microscopic system (manufactured by TOYO Corporation).

The shapes of the resin particles (C) are preferably spherical in view of powder flowability, and melt leveling. In this case, the resin particles (B) are also preferably spherical. The average circularity of the resin particles (C) is preferably 0.95 to 1.00, more preferably 0.96 to 1.0, and even more preferably 0.97 to 1.0. Note that, the average circularity is the value obtained by optically detecting the particles, and dividing by he boundary length of an equivalent circle having the same area to the projected area.

Specifically, the average circularity is measured by means of a flow particle analyzer (FPIA-2000; manufactured by Symex Corporation). A predetermined container is charged with 100 mL to 150 mL of water from which solid impurities have been removed. To this, 0.1 mL to 0.5 mL of a surfactant (Drywell, manufactured by Fujifilm Corporation) is added as a dispersing agent, and 0.1 g to 9.5 g of a measuring sample is further added. The suspension liquid in which the sample is dispersed is dispersed by an ultrasonic disperser (Ultrasonic Cleaner Model VS-150, manufactured by VELVO-CLEAR) for about 1 minute to about 3 minutes, to adjust the dispersion concentration to 3,000 particles/μL to 10,000 particles/μL. The resultant is then subjected to the measurement of the shapes and distribution of the resin particles.

—Charge Controlling Agent:CCA—

The toner of the present invention optionally contains a charge controlling agent therein.

Examples of the charge controlling agent include: a nigrosin dye; an azine-based dye containing a C2-C16 alkyl group (JP-B No. 42-1627); a basic dye, such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000), and a lake pigment of any of these basic dyes; C.I. Solvent Black 8 (C.I. 26150); a quaternary ammonium salt, such as benzoylmethylhexadecyl ammonium chloride, and decyltrimethyl chloride; a dialkyl tin compound, such as a dibutyl or dioctyl tin compound; a dialkyl tin borate compound; a guanidine derivative; a vinyl-based polymer containing an amino group; a polyamine resin, such as a condensate polymer containing an amino group; a metal complex salt of a monoazo dye, such as those disclosed in JP-B Nos. 41-20153, 43-27596, 44-6397, and 45-26478; a metal (e.g., Zn, Al, Co, Cr, and Fe) complex of salicylic acid, dialkyl salicylate, naphthoic acid, or dicarboxylic acid, such as those disclosed in JP-B Nos 55-42752, and 59-7385; a sulfonated copper phthalocyanine pigment; organic boron salts; fluorine-containing quaternary ammonium salts; and a calixarene-based compound. In a color toner other than black, use of a charge controlling agent that may impair intended color is naturally avoided. A metal salt of a salicylic acid derivative, which is white, is suitably used.

An amount of the charge controlling agent is preferably 0.01 parts by mass to 2 parts by mass, more preferably 0.02 parts by mass to 1 part by mass, relative to 100 parts by mass of the binder resin. When the amount thereof is 0.01 parts by mass or greater, charge controlling ability can be attained. When the amount thereof is 2 parts by mass or smaller, the charging ability of the toner is remained not to be large, an effect of the main charge controlling agent is not impaired, and a problems, such as low flowability of the toner or low image density due to increased electrostatic suction force with a developing roller can be prevented.

—Filler (f)—

In the present invention, the filler (f) is internally added to the toner in order to stabilize thermal properties of the toner, such as offset resistance, heat resistant storage stability, and low temperature fixing ability. The presence of the filler inside the toner gives the following effects.

Compared to resins used as a binder resin of a conventional toner, such as a non-crystalline polyester resin and a styrene acryl resin, the binder rein containing the crystalline resin has less elasticity at high temperature, and therefore there is a problem that a resulting toner has low offset resistance. By adding the filler (f) to the toner, a structure of the filler (f) can be formed in a resin matrix inside the toner, and therefore hot offset resistance of the toner improves. The hot offset resistance can be controlled by adjusting an amount and particle diameters of the filler (f).

Moreover, the filler (f) is internally added to the toner in order to stabilize thermal properties of the toner (e.g., offset resistance, heat resistant storage stability, and low temperature fixing ability) achievement of which is a problem when a resin containing a polyhydroxycarboxylic acid skeleton is used. The resin containing the polyhydroxycaroxylic acid skeleton tends to be crystallized when a monomer has high optical purity, and the glass transition temperature tends to gradually change over time. As the filler (f) is present inside the toner, the filler (f) present inside the toner acts as a crystalline nucleus agent, to thereby promptly terminate the change of the glass transition temperature within the duration for the toner production, or to thereby significantly reduce the variation with time, and therefore graduate change in the glass transition temperature, which is unique to the polyhydroxycarboxylic acid skeleton, can be presented. In addition, the presence of the filler (f) within the toner can give the following effects.

The resin containing the polyhydroxycarboxylic acid skeleton can stabilized the thermal properties of the toner by reducing crystallization of the resin, but it has less elasticity at high temperature, compared to a resin used for a conventional binder resin of a toner (e.g., a polyester resin, and a styrene acryl resin) and therefore hot offset resistance of a resulting toner is poor. By adding the filler (f) to the toner, a structure of the filler (f) can be formed in the resin matrix inside the toner, and therefore offset resistance of the toner improves. The hot offset resistance can be controlled by adjusting an amount and particle diameters of the filler (f).

Examples of the filler (f) used as an internal additive in the present invention include silica, alumina, titanium oxide, barium titanate, magnesium titanate, calcium titanate, strontium titanate, zinc oxide, tin oxide, quartz sand, clay (e.g., montmorillonite, and an organic modified product thereof), mica, wollastonite, diatomaceous earth, chromic oxide, cerium oxide, red iron oxide, antimony trioxide, magnesium oxide, zirconium oxide, barium sulfate, carbonate (e.g., barium carbonate, calcium carbonate, and magnesium carbonate) and stearic acid modified products thereof, silicon carbide, and silicon nitride. Among them, preferred are silica, quartz sand, clay (e.g., montmorillonite, and an organic modified product thereof), mica, wollastonite, diatomaceous earth, carbonate (e.g., barium carbonate, calcium carbonate, and magnesium carbonate) and stearic acid modified products thereof, and more preferred are carbonate (e.g., barium carbonate, calcium carbonate, and magnesium carbonate) and stearic acid modified products thereof.

In view of the dispersibility of the filler (f) in the second resin (b), it is preferred that a filler surface of which has been treated with a hydrophobic treatment agent be used as the filler (f). As for the hydrophobic treatment agent, preferred are surface-treating agents, such as a silane-coupling agent, a sililation agent, a silane-coupling agent containing a fluoroalkyl group, an organic titanate-based coupling agent, and an aluminum-based coupling agent. Moreover, use of silicone oil as the hydrophobic treatment agent can give a sufficient effect.

Moreover, the dielectric constant of the filler (f) is preferably 0.2 to 7.5, more preferably 1.3 to 3.5, and even more preferably 1.7 to 2.5. When the dielectric constant of the filler (f) is within the aforementioned range, abnormal increase in the charge of the toner can be prevented in a low temperature low humidity environment in which an accumulated amount of the charge is appropriately maintained. As a result of this, an image can be stably provided.

The dielectric constant of the filler (f) for use in the present invention is measured in the following manner. First, a cylindrical cell having an inner diameter of 18 mm connected to an electrode is charged with the filler, and the filler is pressed into a disk shape having a thickness of 0.65 mm, and diameter of 18 mm and is subjected to a measurement by means of TR-10C dielectric loss measuring device (manufactured by Yokogawa Electric Corporation). Note that, a frequency is 1 KHz, and a ratio is $11\times10^{-9}$.

The filler (f) is preferably internally added to the second resin (b) after dispersed with raw materials, such as a resin, colorant, and wax (a releasing agent) in advance. By dispersing the filler with the raw materials in advance, dispersibility of the filler (f) is improved in the toner.

The resin particles (B) contains the filler (f) in an amount of 15% by mass or greater, preferably 15% by mass to 60% by mass, more preferably 20% by mass to 50% by mass. When the amount of the filler (f) in the resin particles (B) is smaller than 15% by mass, the filler (f) content in the resin particles (B) is insufficient, and therefore the aforementioned effect cannot be attained. When the amount thereof is greater than 60% by mass, on the other hand, aggregation of the filler (f) is caused, and therefore the filler (f) is not uniformly dispersed and not evenly present, which may lead to undesirable charging property and fixing ability of the toner.

The average primary particle diameter of the filler (f) is preferably 5 nm to 1,000 nm, more preferably 10 nm to 500 nm. The filler (f) having the average primary particle diameter in the aforementioned range can improve the charging property of the toner. When the average primary particle diameter thereof is smaller than 5 nm, aggregation of the filler is cause, and therefore the filler is not uniformly dispersed in the toner, which may impair uniformity of charging property of the toner. When the average primary particle diameter thereof is greater than 1 μm, it is necessary to add a large amount of the filler to attain the aforementioned effect. The average particle diameter is a number average particle diameter, and can be measured by means of a particle size distribution measuring device using dynamic light scattering, such as DSL-700 manufactured by Otsuka Electronics Co., Ltd., and Coulter N4 manufactured by Coulter Electronics, Inc. In the case where it is difficult to separate secondary aggregations, it is possible to determine a particle diameter directly from a photograph obtained by a transmission electron microscope. In this case, it is preferred that at least 100 particles or more be observed, and the average value of particle lengths be determined as a particle diameter. The filler may be used alone, or in combination.

The filler (f) and the second resin (b) can constitute the resin particles (B) as a result of any granulation method. Preferred is a method for granulating the resin particles (B), which containing kneading the filler (f) and the second resin (b). It is preferable because the filler is uniformly dispersed by going through the kneading process.

—Colorant—

As for the colorant for use in the toner of the present invention, for example, conventional pigments and dye that can provide a toner of each color, yellow, magenta, cyan black can be used.

Examples of the yellow pigment include cadmium yellow, mineral fast yellow, nickel titanium yellow, naples yellow, naphthol yellow S, Hansa yellow G, Hansa yellow 10G, benzidine yellow GR, quinoline yellow lake, permanent yellow NCG, and tartrazine lake.

Examples of the orange pigment include molybdenum orange, permanent orange GTR, pyrazolone orange, Vulcan orange, indanthrene brilliant orange RK, benzidine orange G, and indanthrene brilliant orange GK.

Examples of the red pigment include iron red, cadmium red, permanent red 4R, lithol red, pyrazolone red, watching red calcium salt, lake red D, brilliant carmine 6B, eosin lake, rhodamine lake B, alizarin lake, and brilliant carmine 3B.

Examples of the violet pigment include fast violet B, and methyl violet lake.

Examples of the blue pigment include cobalt blue, alkali blue, Victoria blue lake, phthalocyanine blue, metal-free phthalocyanine blue, phthalocyanine blue partial chloride, fast sky blue, and indanthrene blue BC.

Examples of the green pigment include chrome green, chromium oxide, pigment green B, and malachite green lake.

Examples of the black pigment include carbon black, oil furnace black, channel black, lamp black, acetylene black, azine dye such as aniline black, metal salt azo dye, metal oxide, and composite metal oxide.

These may be used alone or in combination.

An amount of the colorant in the toner is preferably 1% by mass to 15% by mass, more preferably 3% by mass to 10% by mass. When the amount thereof is smaller than 1% by mass, the coloring ability of the toner may be insufficient. When the amount thereof is greater than 15% by mass, the pigment may cause dispersion failures in the toner, which may lead to low coloring ability, and undesirable electric property of the toner.

The colorant may be used as a master batch, in which the colorant forms a composite with a resin. Examples of such resin include: polyester; a styrene polymer and substituted products thereof; a styrene-based copolymer; polymethyl methacrylate; polybutyl methacrylate; polyvinyl chloride; polyvinyl acetate; polyethylene; polypropylene; an epoxy resin; an epoxy polyol resin; polyurethane; polyamide; polyvinyl butyral; a polyacrylic acid; rosin; modified rosin; a terpene resin; an aliphatic hydrocarbon resin; an alicyclic hydrocarbon resin; an aromatic petroleum resin; chlorinated paraffin; and paraffin wax. These may be used alone, or in combination. Among them, a styrene polymer and substituted products thereof are particularly preferable.

Examples of the styrene polymer and substituted product thereof include polystyrene, poly(p-chlorostyrene), and polyvinyl toluene. Examples of a styrene-based copolymer include a styrene-p-chlorostyrene copolymer, a styrene-propylene copolymer, a styrene-vinyltoluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, styrene-methyl-α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, and a styrene-maleic acid ester copolymer.

The master batch can be prepared by mixing or kneading a colorant with the resin for use in the master batch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, a high-shearing disperser (e.g., a three-roll mill) is preferably used.

—Releasing Agent—

The releasing agent for use in the toner of the present invention can be selected from those known in the art. Particularly, carnauba wax free from free fatty acid, polyethylene wax, montan wax, and oxidized rice wax can be used alone or in combination as the releasing agent. As for the carnauba wax, those of microcrystalline are preferred, and those having an acid value of 5 mgKOH/g or lower, having particle diameter of 1 μm or smaller as dispersed in a toner binder (a toner binder resin) are preferable. The montan wax generally denotes montan wax purified with mineral. Similarly to the carnauba wax, it is preferred that the montan wax be microcrystalline, and have an acid value of 5 mgKOH/g to 14 mgKOH/g. The oxidized rice wax is rice bran wax which has been oxidized with air, and the acid value thereof is preferably 10 mgKOH/g to 30 mgKOH/g. These types of wax are preferable, because they are appropriately finely dispersed in the binder resin of the toner of the present invention, and therefore a resulting toner can be easily provided with excellent offset resistance, transfer properties and durability, which will be described later. These may be used alone, or in combination.

As for other releasing agents, any of conventional releasing agents, such as solid silicone wax, higher fatty acid higher alcohol, montan ester wax, polyethylene wax, and polypropylene wax, can be used in combination.

Tg of the releasing agent for use in the present invention is preferably 70° C. to 90° C. When Tg thereof is lower than 70° C., heat resistant storage stability of the toner may be impaired. When Tg thereof is higher than 90° C., releasing property may not be exhibited at low temperature, which may cause reduction in cold offset resistance, and may cause paper to wrap around a fixing device. An amount of the releasing agent is preferably 1% by mass to 20% by mass, more preferably 3% by mass to 10% by mass, relative to an amount of the resin component of the toner. When the amount thereof is smaller than 1% by mass, an effect of preventing offset may be insufficient. When the amount thereof is greater than 20% by mass, transfer property and durability of the toner may be impaired.

(Developer)

The developer of the present invention contains at least the toner for developing an electrostatic image, and may further contain appropriately selected other components, such as carrier, if necessary. The developer may be a one-component developer or two-component developer, but it is preferably the two-component developer in view of improved service life, when the developer is used with a high speed printer that corresponds to the recent impotents in the information processing speed.

<Carrier>

The carrier is appropriately selected depending on the intended purpose without any limitation, but the carrier preferably contains carrier particles each containing a core and a resin layer covering the core.

A material of the core is appropriately selected from those known in the art without any limitation. For example, preferred are a manganese-strontium (Mn—Sr) based material of 50 emu/g to 90 emu/g, and a manganese-magnesium (Mn—Mg) based material of 50 emu/g to 90 emu/g. In order to secure a sufficient image density, use of a high magnetic material, such as iron powder (100 emu/g or higher) and magnetite (75 emu/g to 120 emu/g), is preferable. Moreover, a weak magnetic material such as a cupper-zinc (Cu—Zn) based material (30 emu/g to 80 emu/g) is preferable because the resulting carrier enables to reduce the impact of the toner brush onto a photoconductor, and therefore it is advantageous for forming high quality images. These may be used alone or in combination.

As for the particle diameters of the cores, the average particle diameter (weight average particle diameter (D50)) of the cores is preferably 10 μm to 200 μm, more preferably 40 μm to 100 μm. When the average particle diameter (weight average particle diameter (D50)) is smaller than 10 μm, a proportion of fine particles increases in the distribution of the carrier particles, and magnetic force per particle reduces, which may cause scattering of the carrier. When the average particle diameter thereof is greater than 200 μm, specific surface area thereof decreases, and therefore scattering of a toner may be caused. Especially in the case of a full color image having a large area of a solid image, reproducibility of the solid area may be impaired.

A material of the resin layer is appropriately selected from resins known in the art depending on the intended purpose without any limitation, and examples thereof include an amino-based resin, a polyvinyl-based resin, a polystyrene-based resin, a halogenated olefin resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride an acryl monomer, a copolymer of vinylidene fluoride and vinyl fluoride, a fluoro-terpolymer (e.g., a terpolymer of tetrafluoroethylene, vinylidene fluoride, and a non-fluoro monomer), and a silicone resin. These may be used alone, or in combination. Among them, a silicone resin is particularly preferable.

The silicone resin is appropriately selected from silicone resins commonly known in the art depending on the intended purpose without any limitation, and examples thereof include a straight silicone resin composed of organosiloxane bonds; and a modified silicone resin, which is modified with an alkyd resin, a polyester resin, an epoxy resin, an acryl resin, or a urethane resin.

The silicone resin can be selected from commercial products. Examples of commercial products of the straight silicone resin include: KR271, KR255, and KR152 manufactured by Shin-Etsu Chemical Co., Ltd.; and SR2400, SR2406, and SR2410 manufactured by Dow Corning Toray Co., Ltd.

As for the modified silicone resin, commercial products thereof can be used. Examples of the commercial products thereof include: KR206 (alkyd-modified), KR5208 (acryl-modified), ES1001N (epoxy-modified), and KR305 (urethane-modified) manufactured by Shin-Etsu Chemical Co., Ltd.; and SR2115 (epoxy-modified), SR2110 (alkyd-modified) manufactured by Dow Corning Toray Co., Ltd.

Note that, the silicone resin can be used along, but the silicone resin can be also used together with a component capable of performing a crosslink reaction, a component for adjusting charging value, or the like.

The resin layer optionally contains electric conductive powder, and examples thereof include metal powder, carbon black, titanium oxide, tin oxide, and zinc oxide. The average particle diameter of the electric conductive powder is preferably 1 μm or smaller. When the average particle diameter thereof is greater than 1 μm, it may be difficult to control electric resistance.

The resin layer can be formed, for example, by dissolving the silicone oil or the like in an organic solvent to prepare a coating solution, uniformly applying the coating solution to surfaces of core particles by a conventional coating method, and drying the coated solution, followed by baking. Examples of the coating method include dip coating, spray coating, and brush coating.

The organic solvent is appropriately selected depending on the intended purpose without any limitation, and examples thereof include toluene, xylene, methyl ethyl ketone, methyl isobutyl ketone, cellosolve, and butyl acetate.

Baking may employ an external heating system or an internal heating system, without any limitation. Examples thereof include a method using a fix electric furnace, a flow electric furnace, a rotary electric furnace, or a burner furnace, and a method using microwaves.

An amount of the resin layer in the carrier is preferably 0.01% by mass to 5.0% by mass. When the amount thereof is smaller than 0.01% by mass, a uniform resin layer may not be formed on a surface of a core material. When the amount thereof is greater than 5.0% by mass, a thickness of the resin layer becomes excessively thick so that a plurality of carrier particles may form into one particle, and therefore uniform carrier particles cannot be obtained.

In the case where the developer is a two-component developer, an amount of the carrier in the two-component developer is appropriately selected depending on the intended purpose without any limitation. As for a preferable blending ratio of the toner and the carrier in the two-component developer, an amount of the toner is typically 1 part by mass to 10.0 parts by mass relative to 100 parts by mass of the carrier.

(Image Forming Apparatus and Image Forming Method)

The outline of the image forming apparatus using the toner of the present invention will be described hereinafter.

The image forming apparatus of the present invention contains at least: a latent electrostatic image bearing member (photo conductor); a charging unit configured to charge a surface of the latent electrostatic image bearing member; an exposing unit configured to expose the charged surface of the latent electrostatic image bearing member to light to form a latent electrostatic image; a developing unit, which houses a toner, and is configured to develop the latent electrostatic image with the toner to form a visible image; a transferring unit configured to transfer the visible image to a recording medium; and a fixing unit configured to fix the transferred visible image to the recording medium, where the toner is the toner for developing an electrostatic image of the present invention.

The image forming method of the present invention contains at least: charging a surface of a latent electrostatic image bearing member; exposing the charged surface of the latent electrostatic image bearing member to light to form a latent electrostatic image; developing the latent electrostatic image with a toner to form a visible image; transferring the visible image to a recording medium; and fixing the transferred visible image to the recording medium, where the toner is the toner for developing an electrostatic image of the present invention.

Figure 3:
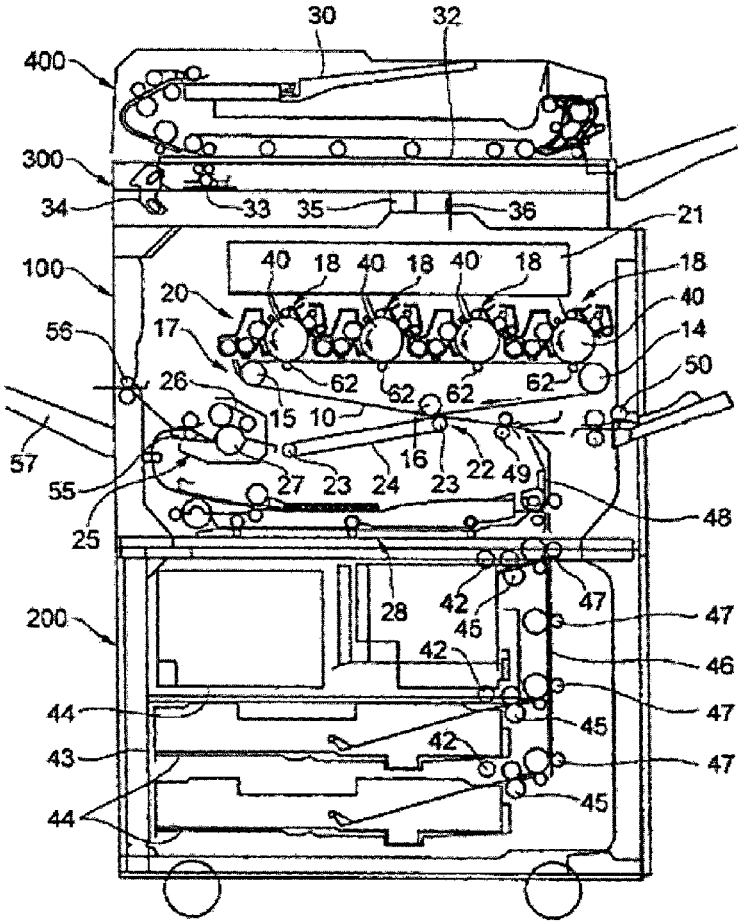
FIG. 3 is a schematic diagram illustrating one example of a structure of the image forming apparatus of the present invention.

As one example of the electrophotographic image forming apparatus of the present invention, a photocopier is illustrated in FIG. 3.

FIG. 3 depicts one example of an internal structural diagram of a color image forming apparatus of one embodiment of the present invention. This specific example is an electrophotographic copying device of a tandem indirect transfer system, but the image forming apparatus of the present invention is not restricted to this example.

In FIG. 3, "100" is an apparatus main body, "200" is a feeding table provided on the apparatus main body 100, "300" is a scanner (reading optical system) provided above the apparatus main body 100, and "400" is an automatic document feeder (ADF) provided above the scanner 300. In the central part of the apparatus main body 100, provided is an intermediate transfer member 10, which is an endless belt extending in the horizontal direction. In FIG. 3, the intermediate transfer member is rotatably supported by support rollers 14, 15, and 16 in the clockwise direction in the figure. In the example illustrated, an intermediate transfer member cleaning device 17, which is configured to remove the residual toner remained on the intermediate transfer member 10 after transferring an image, is provided at the left of the second supporting roller 15 among these three supporting rollers. Moreover, four image forming units 18 of black, yellow, magenta, and cyan are provided above the part of the intermediate transfer member 10 which is present between the first supporting roller 14 and the second supporting roller 15 among the three supporting roller, along the conveying direction, to thereby constitute a tandem image forming section 20. As illustrated in FIG. 3, directly above the tandem image forming section 20, an exposing device 21 is further provided. At the opposite side of the tandem image forming section 20 via the intermediate transfer member 10, a secondary transfer device 22 is provided. In the example illustrated, the secondary transfer device 22 is composed of a secondary transfer belt 24, which is an endless belt, supported by two rollers 23, and the secondary transfer device 22 is provided in the manner that it is pressed against the third supporting roller 16 over the intermediate transfer member 10, so that an image present on the intermediate transfer member 10 is transferred to a sheet. Next to the secondary transfer device 22, a fixing device 25, which is configured to fix the transferred image on the sheet, is provided. The fixing device 25 is composed of a fixing belt 26, which is an endless belt, and pressurizing roller 27 provided to press against the fixing belt 26. The aforementioned secondary transfer device 22 also has a function of transporting the sheet, on which an image has been transferred, to the fixing device 25. In the illustrated example, below the secondary transfer device 22 and the fixing device 25, a sheet reverser 28, which is configured to reverse a sheet to record image on the both sides of the sheet, is provided parallel to the aforementioned tandem image forming section 20.

Upon producing a photocopy using the color electrophotographic device, first, a document is set on a document table 30 of the automatic document feeder 400. Alternatively, the automatic document feeder (ADF) 400 is opened, a document is set on a contact glass 32 of the scanner 300, and then the ADF 400 is closed to press down the document. In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from a light source of the first carriage 33 is reflected on the surface of the document, the reflected light from the document is further reflected by a mirror of the second carriage 34, and passed through an image formation lens 35, which is then received by a read sensor 36 to read the image. Moreover, once the start switch (not illustrated) is pressed, one of the supporting rollers 14, 15, 16 is driven to rotate by a driving motor (not illustrated) to thereby rotate the other two rollers. In this manner the intermediate transfer member 10 is rotated. Simultaneously, in each of the image forming units 18, the photoconductor 40 is rotated to form an image of a respective color, black, yellow, magenta, or cyan thereon.

Along the rotation of the intermediate transfer member 10, these single color images are sequentially transferred onto the intermediate transfer member 10, to thereby form a composite color image. Meanwhile, once the start switch (not illustrated) is pressed, one of the feeding rollers 42 of the feeding table 200 is selectively rotated to eject a sheet (recording paper) from one of multiple feeder cassettes 44 of a paper bank 43, the ejected sheets are separated one by one by a separation roller 45 to send to a feeder path 46, and then transported by a transport roller 47 into a feeder path 48 within the apparatus main body 100. The sheet transported in the feeder path 48 is then bumped against a registration roller 49 to stop. Next, the registration roller 49 is rotated synchronously with the movement of the composite color image on the intermediate transfer member 10, to thereby send the sheet between the intermediate transfer member 10 and the secondary transfer device 22 to record the color image on the sheet. The sheet on which the color image has been transferred is transported by the secondary transfer device 22 to the fixing device 25 to fix the transferred image with heat and pressure applied by the fixing device 25. Thereafter, the sheet is changed its traveling direction by a switch craw 55, ejected by a discharge roller 56, and then stacked on an output tray 57. Alternatively, the sheet is changed its traveling direction by the switch craw 55, reversed by the sheet reverser 28 to send to a transfer position, to thereby record an image on the back side thereof. Then, the sheet is ejected by the ejecting roller 56, and stacked on the output tray 57. After transferring the image, the residual toner remained on the intermediate transfer member 10 is removed by the intermediate transfer member cleaning device 17 to be ready for a following image formation procedure performed by the tandem image forming section 20.

In the aforementioned tandem image forming section 20, each image forming unit 18 is equipped with a charging device (not illustrated), a developing device (not illustrated), a primary transfer device 62, a diselectrification device (not illustrated), etc. in the surrounding area of the drum-shaped photoconductor 40. The photoconductor cleaning device (not illustrated) contains at least a blade cleaning member.

(Process Cartridge)

The toner for developing an electrostatic image of the present invention may be used by housing the toner in a process cartridge, which contains at least the latent electrostatic image bearing member and the developing unit, and is detachably mounted in a main body of an image forming apparatus.

Figure 4:
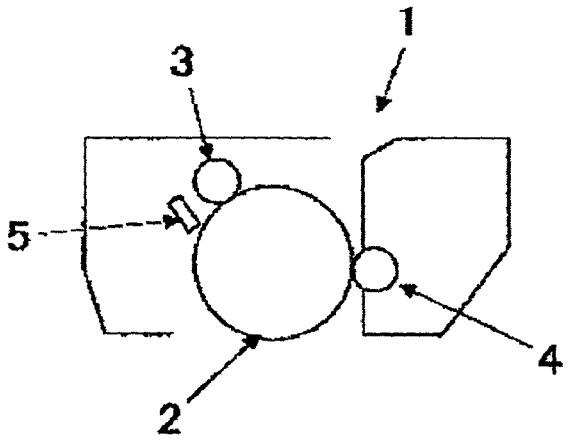
FIG. 4 is a schematic diagram illustrating one example of a structure of the process cartridge.

FIG. 4 depicts a schematic structure of an image forming apparatus equipped with a process cartridge having the toner for developing an electrostatic image of the present invention.

In FIG. 4, "1" represents an entire process cartridge, "2" is a photoconductor, "3" is a charging unit, "4" is a developing unit, and "5" is a cleaning unit.

In the present invention, a plurality of constitutional elements, such as the photoconductor 2, charging unit 3, developing unit 4, and cleaning unit 5 are integrally mounted to constitute the process cartridge, and the process cartridge is detachably mounted in a main body of an image forming apparatus, such as a photocopier, and a printer.

The operations of the image forming apparatus equipped with the process cartridge housing the toner of the present invention therein will be explained next.

The photoconductor 2 is rotationally driven at a certain rim speed. During the rotation of the photoconductor 2, the peripheral surface of the photoconductor 2 is uniformly charged with the predetermined positive or negative potential by the charging unit 3. Next, imagewise exposure light is applied from an image exposing unit (e.g., slit exposure, and laser beam scanning exposure) to thereby sequentially form a latent electrostatic image on the peripheral surface of the photoconductor 2. The formed latent electrostatic image is developed with the toner into a toner image by means of the developing unit 4, and the developed toner image is sequentially transferred to a recording medium fed between the photoconductor 2 and the transferring unit synchronously to the rotation of the photoconductor 2 from the paper feeding section. The recording medium on which the image has been transferred is separated from the surface of the photoconductor and guided to an image fixing unit, and then is discharged from the device as a photocopy. The surface of the photoconductor 2 after the image transfer is cleaned by means the cleaning unit 5 by removing the residual toner from the transfer. Further, the surface of the photoconductor 2 is diselectrified, followed by being repeatedly used for image formation.

EXAMPLES

The present invention is explained further through Examples below, but Examples shall not be construed as to limit the scope of the present invention.

In the following description, "part(s)" denotes "part(s) by mass."

Production Example 1-1

Production of Resin (b-1)

A reaction vessel equipped with a cooling tube, a stirrer, and a nitrogen inlet tube was charged with 241 parts of sebacic acid, 31 parts of adipic acid, 164 parts of 1,4-butanediol, and as a condensation catalyst, 0.75 parts of titanium dihydroxybis(triethanol aminate), and the mixture was allowed to react for 8 hours at 180° C. under a nitrogen gas stream while removing water as generated. Next, the resulting mixture was gradually heated to 225° C., and was allowed to react for 4 hours under a nitrogen gas stream while removing water as generated and 1,4-butanediol, followed by reacting under the reduced pressure of 5 mmHg to 20 mmHg until Mw of a reaction product reached about 19,000. The resulting reaction product was then taken out in the form of a sheet. After sufficiently cooling the sheet product to room temperature, it was pulverized by a crasher, and the resultant was classified with a sieve having an opening size of 1 mm to 6 mm, to thereby obtain a crystalline polyester resin as Resin b-1. Resin b-1 had a melting point of 59° C.

Production Example 1-2

Production of Resin (b-2)

A reaction vessel equipped with a cooling tube, a stirrer, and a nitrogen inlet tube was charged with 241 parts of sebacic acid, 31 parts of adipic acid, 164 parts of 1,4-butanediol, and as a condensation catalyst, 0.75 parts of titanium dihydroxybis(triethanol aminate), and the mixture was allowed to react for 8 hours at 180° C. under a nitrogen gas stream while removing water as generated. Next, the resulting mixture was gradually heated to 225° C., and was allowed to react for 4 hours under a nitrogen gas stream while removing water as generated and 1,4-butanediol, followed by reacting under the reduced pressure of 5 mmHg to 20 mmHg until Mw of a reaction product reached about 42,000. The resulting reaction product was then taken out in the form of a sheet. After sufficiently cooling the sheet product to room temperature, it was pulverized by a crasher, and the resultant was classified with a sieve having an opening size of 1 mm to 6 mm, to thereby obtain a crystalline polyester resin as Resin b-2. Resin b-2 had a melting point of 88.5° C.

Production Example 1-3

Production of Resin (b-3)

A reaction vessel equipped with a cooling tube, a stirrer, and a nitrogen inlet tube was charged with 185 parts (0.91 mol) of sebacic acid, 13 parts (0.09 mol) of adipic acid, 106 parts (1.18 mol) of 1,4-butanediol, and as a condensation catalyst, 0.5 parts of titanium dihydroxybis(triethanol aminate), and the mixture was allowed to react for 8 hours at 180° C. under a nitrogen gas stream while removing water as generated. Next, the resulting mixture was gradually heated to 220° C., and was allowed to react for 4 hours under a nitrogen gas stream while removing water as generated and 1,4-butanediol, followed by reacting under the reduced pressure of 5 mmHg to 20 mmHg until Mw of a reaction product reached about 14,000, to thereby obtain Crystalline Polyester Resin b'-3. Crystalline Polyester Resin b'-3 had Mw of 14,000.

Subsequently, Crystalline Polyester Resin b'-3 was transferred to a reaction vessel equipped with a cooling tube, a stirrer, and a nitrogen inlet tube. To the reaction vessel, 250 parts of ethyl acetate, and 12 parts (0.07 mol) of hexamethylene diisocyanate (HDI) were added, and the resulting mixture was allowed to react for 5 hours at 80° C. under a nitrogen gas stream. Next, ethyl acetate was removed from the reaction mixture under the reduced pressure, to thereby obtain Urethane-Modified Crystalline Polyester Resin b-3. Urethane-Modified Crystalline Polyester Resin b-3 had Mw of 40,600, and a melting point of 74.3° C.

Production Example 1-4

Production of Resin (b-4)

A reaction vessel equipped with a cooling tube, a stirrer, and a nitrogen inlet tube was charged with 79 parts (0.90 mol) of 1,4-butanediamine, 116 parts (1.00 mol) of 1,6-hexanediamine, and 600 parts of methyl ethyl ketone (MEK), and the mixture was stirred, Then, to the mixture, 475 parts (1.90 mol) of 4,4'-diphenyl methane diisocyanate (MDI) was added, and the resulting mixture was allowed to react for 5 hours at 60° C. under a nitrogen gas stream. Next, MEK was removed from the reaction mixture under the reduced pressure, to thereby obtain Crystalline Polyurea Resin b-4. Crystalline Polyurea Resin b-4 had Mw of 41,100, and a melting point of 72.9° C.

Production Example a

Production of Colorant Master Batch

By means of HENSCHEL MIXER (manufactured by Mitsui Mining Co., Ltd.), 1,000 parts of water, 530 parts of carbon black having DBP oil absorption value of 42 mL/100 g and pH of 9.5 (Printex35, manufactured by Evonik Degussa Japan Co., Ltd.), and 1,200 parts of Resin b-1 were mixed. The resulting mixture was kneaded for 30 minutes at 150° C. with a two-roll kneader, and then was rolled and cooled, followed by pulverized with a pulverizer (manufactured by Hosokawa Micron Corporation), to thereby produce a colorant master batch.

Production Example 2

Production of Resin (a-1)

A mixture composed of 67.8 mol of terephthalic acid, 39.8 mol of ethylene glycol, and 60.2 mol of neopentyl glycol was heated for 2.5 hours at 260° C. in an autoclave to perform esterification. To the resultant, 0.0025 mol of germanium dioxide was added as a catalyst, and the temperature of the system was increased to 280° C. over 30 minutes. Then, the pressure of the system was gradually reduced, and in 1 hour time, the pressure of the system was made 0.1 Torr. Under the aforementioned conditions, the mixture was further allowed to carry out a polycondensation reaction. One and a half hours later, the pressure of the system was returned to ambient pressure with nitrogen gas, and the temperature of the system was increased. When the temperature of the system became 260° C., 32.9 mol of isophthalic acid, and 2.1 mol of trimellitic anhydride were added, and the resulting mixture was stirred for 30 minutes at 255° C. The resulting reaction product was taken out in the form of a sheet. After sufficiently cooling the sheet product to room temperature, it was pulverized by a crasher, and the resultant was classified with a sieve having an opening size of 1 mm to 6 mm, to thereby obtain a polyester resin as Resin a-1. The analysis result of Resin a-1 is presented in Table 1.

TABLE 1

| | Acid component | | | Alcohol component | | Properties | | | |
|---|---|---|---|---|---|---|---|---|---|
| | Terephthalic acid (mol) | Isophthalic acid (mol) | Trimellitic acid (mol) | Ethylene glycol (mol) | Neopentyl glycol (mol) | Acid value mgKOH/g | Mw | V | Tg ° C. |
| Resin a-1 | 67.8 | 32.9 | 2.1 | 39.8 | 60.2 | 22.3 | 13,500 | 1.33 | 63 |

In Table 1,
"V" denotes a relative viscosity, and
"Tg" denotes glass transition temperature.

Production Example 3

Production of Particle Dispersion Liquid (W-1)

A 2 L glass container with a jacket was charged with 200 parts of Resin a-1, 37 parts of ethylene glycol mono-n-butyl ether, 460 parts of a 0.5% by mass polyvinyl alcohol (UNITILA POVAL 050G, manufactured by UNITIKA LTD.) aqueous solution (referred to as "PVA-1" hereinafter), and triethyl amine in an amount that was 1.2 time the equivalent amount of a total amount of carboxyl groups contained in the polyester resin (Resin a-1), and the mixture was stirred by means of a desk top type homodisper (TK ROBOMIX, manufactured by PRIMIX Corporation) in an open system at 6,000 rpm. As a result, it was confirmed that there was no segmentation of resin particles on the bottom of the container, and the resin particles were completely in a floated state. This state was maintained. Ten minutes later, hot water was supplied to the jacket, to thereby heat the mixture. When the internal temperature of the container reached 58° C., the mixture was stirred at 7,000 rpm, and the stirring was performed for 20 minutes with maintaining the internal temperature of the container in the range of 58° C. to 60° C., to thereby obtain a homogenous milky white aqueous dispersion liquid. Then, the dispersion liquid was cooled to room temperature by supplying cold water into the jacket, while stirring at 3,500 rpm. The resultant was filtered through a stainless steel filter (635 mesh, plain weave), and as a result resin particles were hardly left on the filter. The analysis result of the obtained filtrate (Particle Dispersion Liquid W-1) is presented in Table 2.

TABLE 2

| | Dispersion liquid components | | | | | | Properties | |
|---|---|---|---|---|---|---|---|---|
| | Type of Resin a | Amount of Resin a (mass part) | Dimethyl ethanol amine (eq./—COOH) | Triethyl amine (eq./—COOH) | Ethylene glycol mono-n-butyl ether (mass part) | PVA-1 (mass part) | Solid content (%) | Dv (μm) |
| Particle dispersion liquid w-1 | Resin a-1 | 200 | 0 | 1.2 | 37 | 460 | 29.7 | 0.12 |

Production Example 4

Preparation of Aqueous Medium

By mixing and stirring together 300 parts of ion-exchanged water, 300 parts of Particle Dispersion Liquid W-1, and 0.2 parts of sodium dodecylbenzene sulfonate to homogeneously dissolve, Aqueous Medium Phase 1 was prepared.

Production Example 5

Preparation of Resin Filler Dispersion Liquids 1 to 5

A reaction vessel was charged with Resin b-1 and Filler f-1 (calcium carbonate, CS•3N-B, average primary particle diameter: 0.91 μm, manufactured by Ube Material Industries, Ltd.) in the amounts (parts) depicted in Table 3, and 80 parts of ethyl acetate, and the resulting mixture was stirred to thereby prepare Resin Filler Dispersion Liquids 1 to 5, respectively.

TABLE 3

| Resin filler dispersion liquid | Resin a (parts by mass) | | Additive (parts by mass) | |
|---|---|---|---|---|
| Resin Filler Dispersion Liquid 1 | Resin b-1 | 85 | Filler f-1 | 15 |
| Resin Filler Dispersion Liquid 2 | Resin b-1 | 80 | Filler f-1 | 20 |
| Resin Filler Dispersion Liquid 3 | Resin b-1 | 70 | Filler f-1 | 30 |
| Resin Filler Dispersion Liquid 4 | Resin b-1 | 50 | Filler f-1 | 50 |
| Resin Filler Dispersion Liquid 5 | Resin b-1 | 40 | Filler f-1 | 60 |
| Resin Filler Dispersion Liquid 6 | Resin b-1 | 70 | Filler f-2 | 30 |
| Resin Filler Dispersion Liquid 7 | Resin b-1 | 70 | Filler f-3 | 30 |
| Resin Filler Dispersion Liquid 8 | Resin b-1 | 70 | Filler f-4 | 30 |

Production Example 6

Preparation of Resin Filler Dispersion Liquid 6

A reaction vessel was charged with Resin b-1 and Filler f-2 (calcium carbonate, CS•3N-A, average primary particle diameter: 0.94 μm, manufactured by Ube Material Industries, Ltd.) in the amounts (parts) depicted in Table 3, and 80 parts of ethyl acetate, and the mixture was stirred to thereby prepare Resin Filler Dispersion Liquid 6.

Production Example 7

Preparation of Resin Filler Dispersion Liquid 7

A reaction vessel was charged with Resin b-1 and Filler f-3 (stearic acid-treated calcium carbonate, Filmlink100, average primary particle diameter: 0.70 μm, manufactured by IMERYS PIGMENT) in the amounts (parts) depicted in Table 3, and 80 parts of ethyl acetate, and the mixture was stirred to thereby prepare Resin Filler Dispersion Liquid 7.

Production Example 8

Preparation of Resin Filler Dispersion Liquid 8

A reaction container was charged with Resin b-1 and Filler f-4 (magnesium carbonate, MSS, average primary particle diameter: 1.2 μm, manufactured by Konoshima Chemical Co., Ltd.) in the amounts (parts) depicted in Table 3, and 80 parts of ethyl acetate, and the mixture was stirred to thereby prepare Resin Filler Dispersion Liquid 8.

Production Example 9

Preparation of Filler Master Batch (Filler MB) 1

By means of HENSCHEL MIXER (manufactured by Mitsui Mining Co., Ltd.) 30 parts of Filler f-1 (calcium carbonate, CS•3N-B, average primary particle diameter: 0.91 μm, manufactured by Ube Material Industries, Ltd.), and 30 parts of Resin b-1 were mixed. The resulting mixture was kneaded for 30 minutes at 150° C. by means of a two-roll kneader, and the kneaded product was then rolled and cooled, followed by pulverized with a pulverizer (manufactured by Hosokawa Micron Corporation), to thereby produce Filler Master Batch (Filler MB) 1.

Production Example 10

Production of Filler Master Batches (Filler MB) 2 to 12

Filler Master Batches (filler MB) 2 to 12 were each produced in the same manner as in Production Example 9, provided that the amounts (parts) of the components were changed as presented in Table 4.

TABLE 4

| | Resin (part by mass) | | Filler (parts by mass) | |
|---|---|---|---|---|
| Filler MB1 | Resin b-1 | 30 | Filler f-1 | 30 |
| Filler MB2 | Resin b-1 | 40 | Filler f-2 | 30 |
| Filler MB3 | Resin b-1 | 50 | Filler f-3 | 30 |
| Filler MB4 | Resin b-1 | 30 | Filler f-1 | 30 |
| Filler MB5 | Resin b-1 | 40 | Filler f-2 | 30 |
| Filler MB6 | Resin b-1 | 50 | Filler f-3 | 30 |
| Filler MB7 | Resin b-1 | 30 | Filler f-1 | 30 |
| Filler MB8 | Resin b-1 | 40 | Filler f-2 | 30 |
| Filler MB9 | Resin b-1 | 50 | Filler f-3 | 30 |
| Filler MB10 | Resin b-2 | 50 | Filler f-3 | 30 |
| Filler MB11 | Resin b-3 | 50 | Filler f-3 | 30 |
| Filler MB12 | Resin b-4 | 50 | Filler f-3 | 30 |

Production Example 11

Preparation of Resin Filler Dispersion Liquids 9 to 23

Resin Filler Dispersion Liquids 9 to 23 were each prepared in the following manner. A reaction container was charged with Resin b-1 and each of Filler MB 1 to 8 in the amount presented in Table 5, and 80 parts of ethyl acetate, and the mixture was stirred to prepare each Resin Filler Dispersion Liquid.

TABLE 5

| Resin filler dispersion liquid | Resin b (parts by mass) | | Additive (parts by mass) | |
|---|---|---|---|---|
| Resin Filler Dispersion Liquid 9 | Resin b-1 | 40 | Filler MB1 | 60 |
| Resin Filler Dispersion Liquid 10 | Resin b-1 | 30 | Filler MB2 | 70 |
| Resin Filler Dispersion Liquid 11 | Resin b-1 | 20 | Filler MB3 | 80 |
| Resin Filler Dispersion Liquid 12 | Resin b-1 | 40 | Filler MB4 | 60 |
| Resin Filler Dispersion Liquid 13 | Resin b-1 | 30 | Filler MB5 | 70 |
| Resin Filler Dispersion Liquid 14 | Resin b-1 | 20 | Filler MB6 | 80 |
| Resin Filler Dispersion Liquid 15 | Resin b-1 | 40 | Filler MB7 | 60 |
| Resin Filler Dispersion Liquid 16 | Resin b-1 | 30 | Filler MB8 | 70 |
| Resin Filler Dispersion Liquid 17 | Resin b-1 | 20 | Filler MB9 | 80 |
| Resin Filler Dispersion Liquid 18 | Resin b-2 | 20 | Filler MB10 | 80 |
| Resin Filler Dispersion Liquid 19 | Resin b-3 | 20 | Filler MB11 | 80 |
| Resin Filler Dispersion Liquid 20 | Resin b-4 | 20 | Filler MB12 | 80 |
| Resin Filler Dispersion Liquid 21 | Resin b-1 | 100 | — | — |
| Resin Filler Dispersion Liquid 22 | Resin b-1 | 90 | Filler f-1 | 10 |
| Resin Filler Dispersion Liquid 23 | Resin b-1 | 85 | Filler f-1 | 15 |

Production Example 12

Preparation of Emulsion

Next, to Resin Filler Dispersion Liquid 1, 5 parts of carnauba wax (molecular weight: 1,800, acid value: 2.7 mgKOH/g, penetration degree: 1.7 mm (40° C.)), and 5 parts of Colorant Master Batch were added, and the mixture was dispersed by means of a bead mill (ULTRA VISCOMILL, manufactured by AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain Toner Material Solution.

Next, a container was charged with 150 parts of Aqueous Medium Phase 1. To this, 100 parts of Toner Material Solution was added, while stirring at 12,000 rpm by means of TK Homomixer (manufactured by PRIMIX Corporation). The mixture was mixed for 10 minutes, to thereby obtain Emulsified Slurry. A flask equipped with a stirrer and a thermometer was charged with 100 parts of Emulsified Slurry, and the solvent was removed from Emulsified Slurry for 10 hours at 30° C. with stirring at the string rim speed of 20 m/min to thereby obtain Dispersed Slurry.

Next, 100 parts of Dispersed Slurry was subjected to filtration under the reduced pressure. To the obtained filtration cake, 100 parts of ion-exchanged water was added, and the mixture was mixed by means of TK Homomixer for 10 minutes at 12,000 rpm, followed by subjected to filtration, to thereby obtain a filtration cake. To the obtained filtration cake, 300 parts of ion-exchanged water was added, and the mixture was mixed by means of TK Homomixer for 10 minutes at 12,000 rpm, followed by subjected to filtration, the series of which were carried out twice, to thereby obtain a filtration cake. To the obtained filtration cake, 20 parts of a 10% by mass sodium hydroxide aqueous solution was added, and the mixture was mixed by means of TK Homomixer for 30 minutes at 12,000 rpm, followed by subjected to filtration under the reduced pressure, to thereby obtain a filtration cake. To the obtained filtration cake, 300 parts of ion-exchanged water was added, and the mixture was mixed by means of TK Homomixer for 10 minutes at 12,000 rpm, followed by subjected to filtration, to thereby obtain a filtration cake. To the obtained filtration cake, 300 parts of ion-exchanged water was added, and the mixture was mixed by means of TK Homomixer for 10 minutes at 12,000 rpm, the series of which were carried out twice, to thereby obtain a filtration cake. To the obtained filtration cake, 20 parts of 10% by mass hydrochloric acid was added, and the mixture was mixed by means of TK Homomixer for 10 minutes at 12,000 rpm. To the resultant, a 5% by mass methanol solution of a fluorine-based quaternary ammonium salt compound, FUTARGENT F-310 (manufactured by Neos Company Limited), was added in the manner that the amount of the fluorine-based quaternary ammonium salt was to be 0.1 parts relative to 100 parts of the solid content of the toner, and the mixture was stirred for 10 minutes, followed by subjected to filtration. To the obtained filtration cake, 300 parts of ion-exchanged water was added, and the mixture was mixed by means of TK Homomixer for 10 minutes at 12,000 rpm, followed by subjected to filtration, the series of which were carried out twice, to thereby obtain a filtration cake. The obtained filtration cake was dried by means of a circulating wind dryer for 36 hours at 40° C. The resultant was sieved through a mesh having an opening size of 75 μm, to thereby produce Toner Base Particles 1.

Toner Base Particles 2 to 23 were each produced in the same manner as in Production Example 12, provided that a type of Resin B, a type of Filler f or Filler Master Batch, formulated amounts thereof, and a type of Particle Dispersion Liquid were changed as presented in Table 6.

TABLE 6

| | Resin Filler Dispersion Liquid | | | | | |
|---|---|---|---|---|---|---|
| Toner | Resin filler dispersion liquid | Resin b (parts by mass) | | Additive (parts by mss) | | Particle Dispersion Liquid W |
| Toner 1 | Resin Filler Dispersion Liquid 1 | Resin b-1 | 85 | Filler f-1 | 15 | Particle Dispersion Liquid W-1 |
| Toner 2 | Resin Filler Dispersion Liquid 2 | Resin b-1 | 80 | Filler f-1 | 20 | Particle Dispersion Liquid W-1 |
| Toner 3 | Resin Filler Dispersion Liquid 3 | Resin b-1 | 70 | Filler f-1 | 30 | Particle Dispersion Liquid W-1 |
| Toner 4 | Resin Filler Dispersion Liquid 4 | Resin b-1 | 50 | Filler f-1 | 50 | Particle Dispersion Liquid W-1 |
| Toner 5 | Resin Filler Dispersion Liquid 5 | Resin b-1 | 40 | Filler f-1 | 60 | Particle Dispersion Liquid W-1 |
| Toner 6 | Resin Filler Dispersion Liquid 6 | Resin b-1 | 70 | Filler f-2 | 30 | Particle Dispersion Liquid W-1 |
| Toner 7 | Resin Filler Dispersion Liquid 7 | Resin b-1 | 70 | Filler f-3 | 30 | Particle Dispersion Liquid W-1 |
| Toner 8 | Resin Filler Dispersion Liquid 8 | Resin b-1 | 70 | Filler f-4 | 30 | Particle Dispersion Liquid W-1 |
| Toner 9 | Resin Filler Dispersion Liquid 9 | Resin b-1 | 40 | Filler MB1 | 60 | Particle Dispersion Liquid W-1 |
| Toner 10 | Resin Filler Dispersion Liquid 10 | Resin b-1 | 30 | Filler MB2 | 70 | Particle Dispersion Liquid W-1 |
| Toner 11 | Resin Filler Dispersion Liquid 11 | Resin b-1 | 20 | Filler MB3 | 80 | Particle Dispersion Liquid W-1 |
| Toner 12 | Resin Filler Dispersion Liquid 12 | Resin b-1 | 40 | Filler MB4 | 60 | Particle Dispersion Liquid W-1 |
| Toner 13 | Resin Filler Dispersion Liquid 13 | Resin b-1 | 30 | Filler MB5 | 70 | Particle Dispersion Liquid W-1 |
| Toner 14 | Resin Filler Dispersion Liquid 14 | Resin b-1 | 20 | Filler MB6 | 80 | Particle Dispersion Liquid W-1 |
| Toner 15 | Resin Filler Dispersion Liquid 15 | Resin b-1 | 40 | Filler MB7 | 60 | Particle Dispersion Liquid W-1 |
| Toner 16 | Resin Filler Dispersion Liquid 16 | Resin b-1 | 30 | Filler MB8 | 70 | Particle Dispersion Liquid W-1 |
| Toner 17 | Resin Filler Dispersion Liquid 17 | Resin b-1 | 20 | Filler MB9 | 80 | Particle Dispersion Liquid W-1 |
| Toner 18 | Resin Filler Dispersion Liquid 18 | Resin b-2 | 20 | Filler MB10 | 80 | Particle Dispersion Liquid W-1 |
| Toner 19 | Resin Filler Dispersion Liquid 19 | Resin b-3 | 20 | Filler MB11 | 80 | Particle Dispersion Liquid W-1 |
| Toner 20 | Resin Filler Dispersion Liquid 20 | Resin b-4 | 20 | Filler MB12 | 80 | Particle Dispersion Liquid W-1 |
| Toner 21 | Resin Filler Dispersion Liquid 21 | Resin b-1 | 100 | — | — | Particle Dispersion Liquid W-1 |
| Toner 22 | Resin Filler Dispersion Liquid 22 | Resin b-1 | 90 | Filler f-1 | 10 | Particle Dispersion Liquid W-1 |
| Toner 23 | Resin Filler Dispersion Liquid 23 | Resin b-1 | 85 | Filler f-1 | 15 | — |

—Production of Toner—

By means of HENSCHEL MIXER (manufactured by Mitsui Mining Co., Ltd.), 100 parts of each of Toner Base Particles 1 to 23, and as an external additive, 1.0 part of hydrophobic silica (H2000, manufactured by Clariant Japan K.K.) were mixed for 30 seconds at the rim speed of 30 m/sec, followed by resting for 1 minute. This process was performed 5 times. Thereafter, the resultant was sieved with a mesh having an opening size of 35 μm, to thereby produce Toners 1 to 23.

—Production of Carrier—

To 100 parts of toluene, 100 parts of a silicone resin (organo straight silicone), 5 parts of γ-(2-aminoethyl)amino-propyl trimethoxysilane, and 10 parts of carbon black, and the resulting mixture was dispersed for 20 minutes by a homomixer, to thereby prepare a resin layer coating liquid. By means of a fluid-bed coating device, the resin layer coating liquid was applied to surfaces of spherical magnetite (1,000 parts) having the volume average particle diameter of 50 μm, to thereby produce a carrier.

—Production of Developer—

Each of developers of Examples 1 to 20 and Comparative Examples 1 to 3 was prepared by mixing 5 parts of each of Toners 1 to 23, and 95 parts of the carrier.

Next, each of the obtained developers was subjected to evaluations in terms of fixing ability, heat resistant storage stability, haze degree, stress resistance, transfer property, resistance to scratches caused by image transfer, and environmental stability in the following manners. The results are presented in Tables 7-1 to 7-3 and Tables 8-1 to 8-2.

<Fixing Ability>

By means of a modified device of an electrophotographic photocopier (MF-2200, manufactured by Ricoh Company Limited) whose fixing unit had been modified to use a Teflon (registered trade mark) roller, solid images with a toner deposition amount of 0.85 $mg/cm^2 \pm 0.1$ $mg/cm^2$ were formed on plain paper 6200 (manufactured by Ricoh Company Limited) with varying temperature of the fixing belt. During the formation of the solid images, the highest temperature at which hot offset did not occur was determined as the maximum fixing temperature. Moreover, the lowest temperature at which a residual rate of the image density of the solid image after being rubbed with a pad became 70% or higher was determined as the minimum fixing temperature.

As for the evaluation conditions of the minimum fixing temperature, the linear speed for feeding paper was 150 mm/sec, the bearing was 1.2 $kgf/cm^2$, and the nip width was 3 mm.

As for the evaluation conditions of the maximum fixing temperature, the linear speed for feeding paper was 50 mm/sec, the bearing was 2.0 $kgf/cm^2$, and the nip width was 4.5 mm.

[Evaluation Criteria for Maximum Fixing Temperature]

A: The maximum fixing temperature was 160° C. or higher.

B: The maximum fixing temperature was 150° C. or higher, but lower than 160° C.

C: The maximum fixing temperature was 140° C. or higher, but lower than 150° C.

D: The maximum fixing temperature was lower than 140° C.

[Evaluation Criteria for Minimum Fixing Temperature]

A: The minimum fixing temperature was lower than 105° C.

B: The minimum fixing temperature was 105° C. or higher, but lower than 115° C.

C: The minimum fixing temperature was 115° C. or higher, but lower than 125° C.

D: The minimum fixing temperature was 125° C. or higher.

<Image Density>

An solid image was formed on copying paper (TYPE 6000<70W>, manufactured by Ricoh Company Limited) by means of a tandem-type color image forming apparatus (imagio Neo 450, manufactured by Ricoh Company Limited) to give a toner deposition amount of 1.00±0.05 $mg/cm^2$, where a surface temperature of a fixing roller was set at 160° C.±2° C. The image density of the obtained solid image was measured at 6 random points by means of a spectrometer (938 SPECTRODENSITOMETER, manufactured by X-Rite Co., Ltd.) to determine image density (average value). The results were evaluated based on the following criteria.

[Evaluation Criteria]

A: The image density was 2.00 or more.

B: The image density was 1.70 or more, but less than 2.00.

C: The image density was 1.50 or more, but less than 1.70.

D: The image density was less than 1.50.

<Haze Degree>

As for an image sample for fixing evaluation, a single color image sample was printed on an OHP sheet, TYPE PPC-DX (manufactured by Ricoh Company Limited) with setting the temperature of the fixing belt at 160° C. A haze degree of the obtained sample was measured by means of Digital Haze Computer (HGM-2DP, manufactured by Suga Test Instruments Co., Ltd.). The haze degree is also called as a degree of opacity, and is measured as an index for shoring transparency of the toner. The lower the value of the haze degree is, higher transparency is. The low value of the haze degree (high transparency of the toner) gives excellent coloring property when an OHP sheet is used.

[Evaluation Criteria]

A: The haze degree was less than 20%.

B: The haze degree was 20% or more, but less than 30%.

C: The haze degree was 30% or more, but less than 40%.

D: The haze degree was 40% or more.

<Environmental Stability (Initial)>

After stirring the obtained developer for 5 minutes by means of a ball mill in the environment (M/M environment) of 23° C., 50% RH, 1.0 g of the developer was sampled. The developer sample was then subjected to a measurement by means of a blow-off charge measuring device (TB-200, manufactured by KYOCERA Chemical Corporation), and the value measured after exposing the developer to nitrogen gas blow for 1 minute was used as a charged amount. Moreover, this measurement was performed in the environment (H/H environment) of 40° C., 90% RH, and in the environment (L/L environment) of 10° C., 30% RH, and the charged values of each developer under these two conditions were evaluated. The environment variability rate was calculated based on the following formula. The lower the environment variability rate is, more stable the charging property of the developer is.

[Evaluation Criteria]

A: The environment variability rate was lower than 10%.

B: The environment variability rate was 10% or higher, but lower than 30%.

C: The environment variability rate was 30% or higher, but lower than 50%.

D: The environment variability rate was 50% or higher.

<Environmental Stability (after a Durability Test)>

After stirring the obtained developer for 24 hours by means of a ball mill in the environment (M/M environment) of 23° C., 50% RH, 1.0 g of the developer was sampled. The developer sample was then subjected to a measurement by means of a blow-off charge measuring device (TB-200, manufactured by KYOCERA Chemical Corporation), and the value measured after exposing the developer to nitrogen gas blow for 1 minute was used as a charged amount. Moreover, this measurement was performed in the environment (H/H environment) of 40° C., 90% RH, and in the environment (L/L environment) of 10° C., 30% RH, and the charged values of each developer under these two conditions were evaluated. The environment variability rate was calculated based on the following formula. The lower the environment variability rate is, more stable the charging property of the developer is.

$$\text{Environment variability rate} = 2 \times \frac{([L/L] - [H/H])}{([L/L] + [H/H])} \times 100(\%)$$

[Evaluation Criteria]

A: The environment variability rate was lower than 10%.

B: The environment variability rate was 10% or higher, but lower than 30%.

C: The environment variability rate was 30% or higher, but lower than 50%.

D: The environment variability rate was 50% or higher.

<Heat Resistant Storage Stability (Penetration Degree)>

A 50 mL glass container was filled with each toner, and was left to stand in a thermostat of 50° C. for 24 hours. After cooling the toner to 24° C., the toner was subjected to a penetration degree test (JISK2235-1991) to thereby measure a penetration degree (mm), and the result was evaluated based on the following criteria. The greater the penetration degree is, more excellent the heat resistance storage stability of the toner is. The toner having the penetration degree of lower than 5 mm more likely causes a problem on practice.

Note that, in the present specification, the penetration degree is represented with a penetrating depth (mm).

[Evaluation Criteria]

A: The penetration degree was 25 mm or greater.

B: The penetration degree was 15 mm or greater, but less than 25 mm.

C: The penetration degree was 5 mm or greater, but less than 15 mm.

D: The penetration degree was less than 5 mm.

<Stress Resistance>

By means of a tandem full-color image forming apparatus 400 illustrated in FIG. 3, a chart having an imaging area ratio of 0.5% was printed on 50,000 sheets, followed by printing a solid image on an entire area of a sheet. The image area of the solid image was visually observed to confirm whether or not there was a white spot in which the toner was not deposited, and the results were evaluated based on the following criteria.

[Evaluation Criteria]

A: There was not a toner missing white spot in the image area, and it was in an excellent state.

B: A toner missing white spot was slightly observed in the image area, and it was in a desirable state.

C: A toner missing white spot was observed in the image area, but it was a level that there was no problem on practical use.

D: Many toner missing white spots were observed in the image area, and it was a level that there was a problem on practical use.

<Transfer Property>

By means of a tandem full-color image forming apparatus 400 illustrated in FIG. 3, a chart having an imaging area ratio of 0.5% was printed on 50,000 sheets, followed by printing a solid image on an entire area of a sheet. During this operation, the apparatus was stopped just after the toner image transferred from the photoconductor (10) to the intermediate transfer belt (50), the photoconductor was taken out from the apparatus, and an amount of the toner remained, without being transferred, on the area of the photoconductor from which the toner image had been transferred was visually observed. The results were evaluated based on the following criteria.

[Evaluation Criteria]

A: There was no untransferred toner remained on the photoconductor, and it was in an excellent state.

B: The untransferred toner was slightly seen on the photoconductor but the color of the back ground could be seen, and it was in the desirable state.

C: There was the untransferred toner remained on the photoconductor and the back ground of the photoconductor was slightly concealed with the untransferred toner, but it was a level that there was no problem on practical use.

D: A large amount of the untransferred toner was observed on the photoconductor, and most of the background of the photoconductor was covered with the untransferred toner, and it was a level that there was a problem on practical use.

<Image Transport Damage>

By means of a tandem full-color image forming apparatus 400 illustrated in FIG. 3, a solid image that would give a toner deposition amount of 0.85 mg/cm$^2$±0.1 mg/cm$^2$ after transferring was formed on an entire surface of transfer paper (Type 6200, manufactured by Ricoh Company Limited), and fixing was performed by setting the temperature of the fixing belt at the temperature equal to [the minimum fixing temperature of the toner+10° C.]. The degree of an image transport damage formed on a surface of the obtained fixed image with a discharge roller (discharge roller 56, FIG. 3) was evaluated with reference to the ranking samples. Note that, the speed for the sheet passing through the nip of the fixing device was 280 mm/s, and the sheet in the A4 size was fed in the direction along with the short side of the sheet.

[Evaluation Criteria]

A: The image transport damage was not visually observed at all, and it was an excellent state.

B: The image transport damage was slightly confirmed visually, and it was a desirable state.

C: The image transport damage was visually observed, and it was a level that there was no problem on practical use.

D: The image transport damage was clearly confirmed visually, part of the image was scraped to show the background of the transfer paper, and it was a level that there was a problem on practical use.

<Total Evaluation>

[Evaluation Criteria]

The evaluation results of the aforementioned evaluation items were converted into the scores as follow, and the total evaluation was given as below. Namely, the score was given in the manner that A was 3 points, B was 2 points, C was 1 point, and D was 0 point.

I: The total score of the evaluation items was 26 points or higher, and there was no item whose result was D.

II: The total score of the evaluation items was 24 points or higher, but lower than 26 points, and there was no item whose result was D.

III: The total score of the evaluation items was 22 points or higher, but lower than 24 points, and there was no item whose result was D.

IV: The total score of the evaluation items was 20 points or higher, but lower than 22 points, and there was no item whose result was D.

V: The total score of the evaluation items was 18 points or higher, but lower than 20 points, and there was no item whose result was D.

VI: The total score of the evaluation items was lower than 18 points, and there was no item whose result was D.

VII: There was at least one evaluation item whose result was D.

TABLE 7-1

| | | Physical properties | | | | | | | | |
|---|---|---|---|---|---|---|---|---|---|---|
| | | Dv (μm) | Dn (μm) | Dv/Dn | Mn | Mw | Mpt | 100,000 or more | 250,000 or more | Mw/Mn |
| Ex. 1 | Toner 1 | 5.6 | 4.5 | 1.24 | 3,000 | 19,000 | 15,000 | 2.3 | 0.1 | 6.33 |
| Ex. 2 | Toner 2 | 5.7 | 4.5 | 1.27 | 3,000 | 19,000 | 15,000 | 2.3 | 0.1 | 6.33 |
| Ex. 3 | Toner 3 | 5.6 | 4.4 | 1.27 | 3,000 | 19,000 | 15,000 | 2.3 | 0.1 | 6.33 |
| Ex. 4 | Toner 4 | 5.7 | 4.5 | 1.27 | 3,000 | 19,000 | 15,000 | 2.3 | 0.1 | 6.33 |
| Ex. 5 | Toner 5 | 5.3 | 4.1 | 1.29 | 3,000 | 19,000 | 15,000 | 2.3 | 0.1 | 6.33 |
| Ex. 6 | Toner 6 | 5.7 | 4.5 | 1.27 | 3,000 | 19,000 | 15,000 | 2.3 | 0.1 | 6.33 |
| Ex. 7 | Toner 7 | 5.4 | 4.3 | 1.26 | 3,000 | 19,000 | 15,000 | 2.3 | 0.1 | 6.33 |
| Ex. 8 | Toner 8 | 5.6 | 4.4 | 1.27 | 3,000 | 19,000 | 15,000 | 2.3 | 0.1 | 6.33 |
| Ex. 9 | Toner 9 | 5.5 | 4.4 | 1.25 | 2,800 | 18,000 | 14,000 | 2.1 | 0.1 | 6.43 |
| Ex. 10 | Toner 10 | 5.5 | 4.4 | 1.25 | 2,800 | 18,000 | 14,000 | 2.1 | 0.1 | 6.43 |
| Ex. 11 | Toner 11 | 5.4 | 4.4 | 1.23 | 2,800 | 18,000 | 14,000 | 2.1 | 0.1 | 6.43 |
| Ex. 12 | Toner 12 | 5.6 | 4.5 | 1.24 | 2,800 | 18,000 | 14,000 | 2.1 | 0.1 | 6.43 |
| Ex. 13 | Toner 13 | 5.6 | 4.5 | 1.24 | 2,800 | 18,000 | 14,000 | 2.1 | 0.1 | 6.43 |
| Ex. 14 | Toner 14 | 5.4 | 4.4 | 1.23 | 2,800 | 18,000 | 14,000 | 2.1 | 0.1 | 6.43 |
| Ex. 15 | Toner 15 | 5.5 | 4.4 | 1.25 | 2,800 | 18,000 | 14,000 | 2.1 | 0.1 | 6.43 |
| Ex. 16 | Toner 16 | 5.5 | 4.4 | 1.25 | 2,800 | 18,000 | 14,000 | 2.1 | 0.1 | 6.43 |
| Ex. 17 | Toner 17 | 5.4 | 4.4 | 1.23 | 2,800 | 18,000 | 14,000 | 2.1 | 0.1 | 6.43 |
| Ex. 18 | Toner 18 | 5.4 | 4.3 | 1.26 | 6,500 | 42,100 | 32,600 | 5.1 | 0.4 | 6.48 |
| Ex. 19 | Toner 19 | 5.5 | 4.4 | 1.25 | 5,600 | 40,600 | 30,700 | 5 | 0.4 | 7.25 |
| Ex. 20 | Toner 20 | 5.4 | 4.4 | 1.23 | 5,900 | 41,100 | 31,400 | 5.1 | 0.6 | 6.97 |
| Comp. Ex. 1 | Toner 21 | 5.6 | 4.5 | 1.24 | 3,000 | 19,000 | 15,000 | 2.3 | 0.1 | 6.33 |
| Comp. Ex. 2 | Toner 22 | 5.4 | 4.4 | 1.23 | 3,000 | 19,000 | 15,000 | 2.3 | 0.1 | 6.33 |
| Comp. Ex. 3 | Toner 23 | 5.6 | 4.5 | 1.24 | 3,000 | 19,000 | 15,000 | 2.3 | 0.1 | 6.33 |

FIG. 7-2

| | | Physical properties | | | | |
|---|---|---|---|---|---|---|
| | | N (mass %) | Urethane | Urea | (CC)/((CC)) + (AA)) | THF/AcOE insoluble component (mass %) |
| Ex. 1 | Toner 1 | <0.01 | No | No | 0.4 | 4 |
| Ex. 2 | Toner 2 | <0.01 | No | No | 0.4 | 4 |
| Ex. 3 | Toner 3 | <0.01 | No | No | 0.4 | 4 |
| Ex. 4 | Toner 4 | <0.01 | No | No | 0.4 | 4 |
| Ex. 5 | Toner 5 | <0.01 | No | No | 0.4 | 4 |
| Ex. 6 | Toner 6 | <0.01 | No | No | 0.4 | 4 |
| Ex. 7 | Toner 7 | <0.01 | No | No | 0.4 | 4 |
| Ex. 8 | Toner 8 | <0.01 | No | No | 0.4 | 4 |
| Ex. 9 | Toner 9 | <0.01 | No | No | 0.4 | 4 |
| Ex. 10 | Toner 10 | <0.01 | No | No | 0.4 | 4 |
| Ex. 11 | Toner 11 | <0.01 | No | No | 0.4 | 4 |
| Ex. 12 | Toner 12 | <0.01 | No | No | 0.4 | 4 |
| Ex. 13 | Toner 13 | <0.01 | No | No | 0.4 | 4 |
| Ex. 14 | Toner 14 | <0.01 | No | No | 0.4 | 4 |
| Ex. 15 | Toner 15 | <0.01 | No | No | 0.4 | 4 |
| Ex. 16 | Toner 16 | <0.01 | No | No | 0.4 | 4 |
| Ex. 17 | Toner 17 | <0.01 | No | No | 0.4 | 4 |
| Ex. 18 | Toner 18 | <0.01 | No | No | 0.42 | 8.8 |
| Ex. 19 | Toner 19 | 0.67 | Yes | No | 0.29 | 10.2 |
| Ex. 20 | Toner 20 | 0.66 | No | Yes | 0.28 | 10.6 |
| Comp. Ex. 1 | Toner 21 | <0.01 | No | No | 0.4 | 4 |
| Comp. Ex. 2 | Toner 22 | <0.01 | No | No | 0.4 | 4 |
| Comp. Ex. 3 | Toner 23 | <0.01 | No | No | 0.4 | 4 |

TABLE 7-3

| | | Physical properties | | | | | | | |
|---|---|---|---|---|---|---|---|---|---|
| | | T1 | T2 | T1 − T2 | ΔH(T) | ΔH(H) | ΔH(H)/ΔH(T) | logG'(50) | logG'(65) |
| Ex. 1 | Toner 1 | 59 | 52 | 7 | 82.2 | 78 | 0.95 | 6.7 | 4.5 |
| Ex. 2 | Toner 2 | 59 | 52 | 7 | 82.2 | 78 | 0.95 | 6.9 | 4.6 |
| Ex. 3 | Toner 3 | 59 | 52 | 7 | 82.2 | 78 | 0.95 | 7.1 | 4.8 |
| Ex. 4 | Toner 4 | 59 | 52 | 7 | 82.2 | 78 | 0.95 | 7.4 | 4.8 |
| Ex. 5 | Toner 5 | 59 | 52 | 7 | 82.2 | 78 | 0.95 | 7.7 | 4.8 |
| Ex. 6 | Toner 6 | 59 | 52 | 7 | 82.2 | 78 | 0.95 | 6.7 | 4.8 |
| Ex. 7 | Toner 7 | 59 | 52 | 7 | 82.2 | 78 | 0.95 | 6.7 | 4.8 |
| Ex. 8 | Toner 8 | 59 | 52 | 7 | 82.2 | 78 | 0.95 | 6.7 | 4.8 |
| Ex. 9 | Toner 9 | 58 | 50 | 8 | 81.1 | 75 | 0.92 | 6.6 | 4.8 |
| Ex. 10 | Toner 10 | 58 | 50 | 8 | 81.1 | 75 | 0.92 | 6.6 | 4.8 |
| Ex. 11 | Toner 11 | 58 | 50 | 8 | 81.1 | 75 | 0.92 | 6.6 | 4.8 |
| Ex. 12 | Toner 12 | 58 | 50 | 8 | 81.1 | 75 | 0.92 | 6.6 | 4.8 |
| Ex. 13 | Toner 13 | 58 | 50 | 8 | 81.1 | 75 | 0.92 | 6.6 | 4.8 |
| Ex. 14 | Toner 14 | 58 | 50 | 8 | 81.1 | 75 | 0.92 | 6.6 | 4.8 |
| Ex. 15 | Toner 15 | 58 | 50 | 8 | 81.1 | 75 | 0.92 | 6.6 | 4.8 |
| Ex. 16 | Toner 16 | 58 | 50 | 8 | 81.1 | 75 | 0.92 | 6.6 | 4.8 |
| Ex. 17 | Toner 17 | 58 | 50 | 8 | 81.1 | 75 | 0.92 | 6.6 | 4.8 |
| Ex. 18 | Toner 18 | 63 | 56 | 7 | 88.5 | 85.4 | 0.96 | 6.9 | 5.0 |
| Ex. 19 | Toner 19 | 62 | 54 | 8 | 74.3 | 72.2 | 0.97 | 7.0 | 5.5 |
| Ex. 20 | Toner 20 | 62 | 55 | 7 | 72.9 | 71.4 | 0.98 | 7.2 | 5.8 |
| Comp. Ex. 1 | Toner 21 | 59 | 52 | 7 | 82.2 | 78 | 0.95 | 5.8 | 4.0 |
| Comp. Ex. 2 | Toner 22 | 59 | 52 | 7 | 82.2 | 78 | 0.95 | 6.1 | 4.2 |
| Comp. Ex. 3 | Toner 23 | 59 | 52 | 7 | 82.2 | 78 | 0.95 | 8.2 | 6.5 |

In Tables 7-1 to 7-3, each item means as follows. These were measured by the methods described in the present specification.

The item "Dv" denotes the volume average particle diameter (μm).

The item "Dn" denotes the number average particle diameter (μm).

The item "100,000 or more" denotes an amount of the component having a molecular weight of 100,000 or greater, and a unit thereof is "%."

The item "250,000 or more" denotes an amount of the component having a molecular weight of 250,000 or greater, and a unit thereof is "%."

The item "N" denotes an amount the element N (% by mass).

The item "Urethane" denotes whether or not a urethane bond of a THF soluble component present in the toner. "Yes" denotes the presence of the urethane bond, and "No" denotes no presence of the urethane bond.

The item "Urea" denotes whether or not a urea bond of a THF soluble component present in the toner. "Yes" denotes the presence of the urea bond, and "No" denotes no presence of the urea bond.

The item "T1" denotes the maximum endothermic peak T1 (° C.) of the toner as obtained from the second heating from 0° C. to 150° C. in differential scanning calorimetry (DSC) of the toner.

The item "T2" denotes the maximum exothermic peak T2 (° C.) of the toner as obtained from cooling in differential scanning calorimetry (DSC).

The item "ΔH(T)" denotes an endothermic value (J/g) of the toner as obtained by differential scanning calorimetry (DSC).

The item "ΔH(H)" denotes an endothermic value (J/g) of a tetrahydrofuran (THF)-ethyl acetate mixed solvent (mass ratio THF/ethyl acetate=50/50) insoluble component of the toner as obtained by differential scanning calorimetry (DSC).

The item "log G'(50)" denotes storage elastic modulus (log, unit: Pa·s) at 50° C.

The item "log G'(60)" denotes storage elastic modulus (log, unit: Pa·s) at 60° C.

TABLE 8-1

| | | Evaluation Results | | | | | |
|---|---|---|---|---|---|---|---|
| | | | | | | Environment variability | |
| | | Minimum fixing temperature | Maximum fixing temperature | Image density | Haze degree | Initial | After endurance test |
| Ex. 1 | Toner 1 | A | C | A | C | B | C |
| Ex. 2 | Toner 2 | A | B | A | C | B | C |
| Ex. 3 | Toner 3 | A | A | A | C | B | B |
| Ex. 4 | Toner 4 | B | A | A | C | B | C |
| Ex. 5 | Toner 5 | C | A | A | C | B | C |
| Ex. 6 | Toner 6 | A | A | A | C | B | B |

TABLE 8-1-continued

| | | Evaluation Results | | | | | |
|---|---|---|---|---|---|---|---|
| | | | | | | Environment variability | |
| | | Minimum fixing temperature | Maximum fixing temperature | Image density | Haze degree | Initial | After endurance test |
| Ex. 7 | Toner 7 | A | A | A | C | B | B |
| Ex. 8 | Toner 8 | A | A | B | C | B | C |
| Ex. 9 | Toner 9 | A | A | A | B | A | B |
| Ex. 10 | Toner 10 | A | A | A | A | A | B |
| Ex. 11 | Toner 11 | A | A | A | A | A | B |
| Ex. 12 | Toner 12 | A | A | A | B | A | B |
| Ex. 13 | Toner 13 | A | A | A | A | A | B |
| Ex. 14 | Toner 14 | A | A | A | A | A | B |
| Ex. 15 | Toner 15 | A | A | A | B | A | A |
| Ex. 16 | Toner 16 | A | A | A | A | A | A |
| Ex. 17 | Toner 17 | A | A | A | A | A | A |
| Ex. 18 | Toner 18 | A | A | A | A | A | A |
| Ex. 19 | Toner 19 | A | A | A | A | A | A |
| Ex. 20 | Toner 20 | A | A | A | A | A | A |
| Comp. Ex. 1 | Toner 21 | A | D | A | A | A | C |
| Comp. Ex. 2 | Toner 22 | A | D | A | C | B | C |
| Comp. Ex. 3 | Toner 23 | A | C | A | C | B | C |

TABLE 8-2

| | | Evaluation Results | | | | |
|---|---|---|---|---|---|---|
| | | Heat resistant storage stability | Image trans-porting scratch | Transfer property | Stress resistance | Total evaluation |
| Ex. 1 | Toner 1 | C | C | C | C | VI |
| Ex. 2 | Toner 2 | C | C | C | C | VI |
| Ex. 3 | Toner 3 | C | C | C | C | V |
| Ex. 4 | Toner 4 | C | C | C | C | VI |
| Ex. 5 | Toner 5 | C | C | C | C | VI |
| Ex. 6 | Toner 6 | C | C | C | C | V |
| Ex. 7 | Toner 7 | C | C | C | C | V |
| Ex. 8 | Toner 8 | C | C | C | C | VI |
| Ex. 9 | Toner 9 | C | C | C | C | IV |
| Ex. 10 | Toner 10 | C | C | C | C | IV |
| Ex. 11 | Toner 11 | C | C | C | C | IV |
| Ex. 12 | Toner 12 | C | C | C | C | IV |
| Ex. 13 | Toner 13 | C | C | C | C | IV |
| Ex. 14 | Toner 14 | C | C | C | C | IV |
| Ex. 15 | Toner 15 | C | C | C | C | IV |
| Ex. 16 | Toner 16 | C | C | C | C | III |
| Ex. 17 | Toner 17 | C | C | C | C | III |
| Ex. 18 | Toner 18 | A | B | C | C | II |
| Ex. 19 | Toner 19 | A | A | B | B | I |
| Ex. 20 | Toner 20 | A | A | B | B | I |
| Comp. Ex. 1 | Toner 21 | D | D | C | C | VII |
| Comp. Ex. 2 | Toner 22 | D | D | C | D | VII |
| Comp. Ex. 3 | Toner 23 | D | C | C | C | VII |

As presented in Tables 7-1 to 7-3, and Tables 8-1 to 8-1, the developers of Examples 1 to 20 had excellent low temperature fixing ability with a wide fixing width. Especially, the developers of Examples 18 to 20 had excellent results on the heat resistant storage stability, stress resistance, transfer property, resistance to scratches caused by image transporting.

The embodiments of the present invention are as follows:

<1> A toner for developing an electrostatic image, containing:

resin particles (C), wherein the resin particles (C) each contain a resin particle (B) and resin particles (A) or a coating film (P) deposited on a surface of the resin particle (B), where the resin particle (B) contains a second resin (b) and a filler (f), wherein the resin particles (A) or the coating film (P) contains a first resin (a), wherein the second resin (b) contains a crystalline resin, and wherein the resin particle (B) contains the filler (f) in an amount of 15% by mass or greater.

<2> The toner according to <1>, wherein the toner has a ratio (CC)/((CC)+(AA)) of 0.15 or greater, where (CC) is an integrated intensity of part of a spectrum derived from a crystal structure, and (AA) is an integrated intensity of a part of the spectrum derived from a non-crystal structure, where the spectrum is a diffraction spectrum of the toner obtained by an X-ray diffractometer.

<3> The toner according to any of <1> or <2>, wherein the toner satisfies the following relational expressions (1):

$$(T1-T2)\leq 30^\circ\ \text{C.}$$

$$T2\geq 30^\circ\ \text{C.} \qquad \text{Expressions (1)}$$

where T1 is a maximum endothermic peak obtained from a second heating from 0° C. to 150° C., and T2 is a maximum exothermic peak obtained from cooling in differential scanning calorimetry (DSC) of the toner, in which the heating from 0° C. to 100° C. is performed at a heating rate of 10° C./min, and the cooling is performed from 100° C. to 0° C. at a cooling rate of 10° C./min.

<4> The toner according to any one of <1> to <3>, wherein a proportion of a tetrahydrofuran (THF) soluble component having a molecular weight of 100,000 or greater in the toner as measured by gel permeation chromatography (GPC) is 5% or greater, and the toner has a weight average molecular weight (Mw) of 15,000 to 70,000.

<5> The toner according to any one of <1> to <4>, wherein a value represented by ΔH(H)/ΔH(T) is 0.2 to 1.25, where ΔH(T) is an endothermic value (J/g) of the toner as measured by DSC, and ΔH(H) is an endothermic value (J/g) of a component of the toner as measured by DSC, the component of the toner being insoluble to a mixed solvent of THF and ethyl acetate mixed in a mass ratio (THF/ethyl acetate) of 50/50.

<6> The toner according to any one of <1> to <5>, wherein the second resin (b) contains the crystalline resin in an amount of 50% by mass or greater.

<7> The toner according to any one of <1> to <6>, wherein the resin particle (B) contains the filler (f) in an amount of 15% by mass to 60% by mass.

<8> The toner according to any one of <1> to <7>, wherein the filler (f) contains carbonate.

<9> The toner according to any one of <1> to <8>, wherein the filler (f) contains a stearic acid modified product.

<10> The toner according to any one of <1> to <9>, wherein the filler (f) has an average primary particle diameter of 5 nm to 1,000 nm.

<11> The toner according to any one of <1> to <10>, wherein the toner is granulated by the method containing:

kneading the filler (f) and the second resin (b).

<12> The toner according to any one of <1> to <11>, wherein the first resin (a) is a polyester resin, which is composed of polybasic acid, and polyhydric alcohol.

<13> The toner according to <12>, wherein the polyester resin of the first resin (a) has an acid value of 10 mgKOH/g to 40 mgKOH/g.

<14> The toner according to any one of <1> to <13>, wherein the first resin (a) is a polyester resin, which contains a basic compound.

<15> The toner according to any one of <1> to <14>, wherein the crystalline resin contains a urethane bond, or a urea bond, or both the urethane bond and the urea bond.

<16> The toner according to any one of <1> to <15>, wherein the crystalline resin is a resin containing a crystalline polyester unit.

<17> A developer, containing:

the toner according to any one of <1> to <16>.

<18> An image forming apparatus, containing:

a latent electrostatic image bearing member;

a charging unit configured to charge a surface of the latent electrostatic image bearing member;

an exposing unit configured to expose the charged surface of the latent electrostatic image bearing member to light to form a latent electrostatic image;

a developing unit, which houses a toner, and configured to develop the latent electrostatic image with the toner to form a visible image;

a transferring unit configured to transfer the visible image to a recording medium; and a fixing unit configured to fix the transferred visible image to the recording medium, wherein the toner is the toner according to any one of <1> to <16>.

<19> An image forming method, containing:

charging a surface of a latent electrostatic image bearing member;

exposing the charged surface of the latent electrostatic image bearing member to light to form a latent electrostatic image;

developing the latent electrostatic image with a toner to form a visible image;

transferring the visible image to a recording medium; and fixing the transferred visible image to the recording medium, wherein the toner is the toner according to any one of <1> to <16>.

<20> A process cartridge, containing:

a latent electrostatic image bearing member; and a developing unit configured to develop a latent electrostatic image formed on the latent electrostatic image bearing member with a toner to form a visible image, wherein the process cartridge can be detachably mounted in a main body of an image forming apparatus, and wherein the toner is the toner according to any one of <1> to <16>.

REFERENCE SIGNS LIST

1: process cartridge
2: photoconductor
3: charging unit
4: developing unit
5: cleaning unit
10: intermediate transfer member
14•15•16: supporting roller
17: intermediate transfer member cleaning device
18: image forming unit
20: tandem image forming section
22: secondary transfer device
24: secondary transfer belt
25: fixing device
26: fixing belt
27: pressurizing roller
28: sheet reverser
30: document table
32: contact glass
33: first carriage
34: second carriage
35: image formation lens
36: read sensor
40: photoconductor
42: feeding roller
43: paper bank
44: multi feeder cassettes
45: separation roller
46: feeder path
47: transport roller
48: feeder path
49: registration roller
55: switch craw
56: discharge roller
57: output tray
60: charging device
61: developing device
62: primary transfer device
64: diselectrification device
63: photoconductor cleaning device
61: developing device
100: apparatus main body
200: feeding table
300: scanner
400: automatic document feeder (ADF)

The invention claimed is:

1. A toner for developing an electrostatic image, comprising:

resin particles (C), wherein the resin particles (C) each comprise a resin particle (B) and resin particles (A), or a coating film (P) deposited on a surface of the resin particle (B), wherein the resin particle (B) comprises:

(b) a second resin comprising a crystalline polyester resin comprising a urethane bond and/or a urea bond; and (f) 15% by mass or more of a filler comprising a carbonate, and wherein the resin particles (A) or the coating film (P) comprise:

a first resin, which is a polyester resin.

2. The toner according to claim 1, wherein the toner has a ratio (CC)/((CC)+(AA)) of 0.15 or greater, where (CC) is an integrated intensity of part of a spectrum derived from a crystal structure, and (AA) is an integrated intensity of a part of the spectrum derived from a non-crystal structure, where the spectrum is a diffraction spectrum of the toner obtained by an X-ray diffractometer.

3. The toner according to any of claim 1, wherein the toner satisfies expressions (1) and (2):

$$(T1-T2)\leq 30^\circ\ \text{C.} \quad (1),$$

$$T2\geq 30^\circ\ \text{C.} \quad (2)$$

wherein

T1 is a maximum endothermic peak obtained from a second heating from 0° C. to 150° C., and T2 is a maximum exothermic peak obtained from cooling in differential scanning calorimetry (DSC) of the toner, in which the heating from 0° C. to 100° C. is performed at a heating rate of 10° C./min, and the cooling is performed from 100° C. to 0° C. at a cooling rate of 10° C./min.

4. The toner according to claim 1, wherein a proportion of a tetrahydrofuran (THF) soluble component having a molecular weight of 100,000 or greater in the toner as measured by gel permeation chromatography (GPC) is 5% or greater, and the toner has a weight average molecular weight (Mw) of 15,000 to 70,000.

5. The toner according to claim 1, wherein the toner has a ratio of ΔH(H)/ΔH(T) in the range of 0.2 to 1.25, wherein ΔH(T) is an endothermic value (J/g) of the toner as measured by DSC, and ΔH(H) is an endothermic value (J/g) of a component of the toner as measured by DSC, the component of the toner being insoluble to a mixed solvent of THF and ethyl acetate mixed in a mass ratio (THF/ethyl acetate) of 50/50.

6. The toner according to claim 1, wherein the second resin (b) comprises the crystalline polyester resin in an amount of 50% by mass or greater.

7. The toner according to claim 1, wherein the resin particle (B) comprises from 15% by mass to 60% by mass of the filler (f).

8. The toner according to claim 1, wherein the filler (f) comprises a stearic acid-treated carbonate.

9. The toner according to claim 1, wherein the filler (f) has an average primary particle diameter of 5 nm to 1,000 nm.

10. The toner according to claim 1, wherein the first resin (a) is a polyester resin comprising a polybasic acid and a polyhydric alcohol.

11. The toner according to claim 10, wherein the polyester resin of the first resin (a) has an acid value of 10 mgKOH/g to 40 mgKOH/g.

12. The toner according to claim 1, wherein the first resin (a) is a polyester resin, which comprises a basic compound.

13. An image forming apparatus, comprising:

a latent electrostatic image bearing member;

a charging unit configured to charge a surface of the latent electrostatic image bearing member;

an exposing unit configured to expose the charged surface of the latent electrostatic image bearing member to light to form a latent electrostatic image;

a developing unit, which houses a toner, and configured to develop the latent electrostatic image with the toner to form a visible image;

a transferring unit configured to transfer the visible image to a recording medium; and a fixing unit configured to fix the transferred visible image to the recording medium, wherein the toner is a toner for developing an electrostatic image, wherein the toner for developing an electrostatic image comprises:

resin particles (C), wherein the resin particles (C) each comprise a resin particle (B) and resin particles (A), or a coating film (P) deposited on a surface of the resin particle (B), wherein the resin particle (B) comprises:

(b) a second resin comprising a crystalline polyester resin comprising a urethane bond and/or a urea bond; and (f) 15% by mass or more of a filler comprising a carbonate, and wherein the resin particles (A) or the coating film (P) comprise:

(a) a first resin, which is a polyester resin.

14. An image forming method, comprising:

charging a surface of a latent electrostatic image bearing member;

exposing the charged surface of the latent electrostatic image bearing member to light to form a latent electrostatic image;

developing the latent electrostatic image with a toner to form a visible image;

transferring the visible image to a recording medium; and fixing the transferred visible image to the recording medium, wherein the toner is a toner for developing an electrostatic image, wherein the toner for developing an electrostatic image comprises:

resin particles (C), wherein the resin particles (C) each comprise a resin particle (B) and resin particles (A), or a coating film (P) deposited on a surface of the resin particle (B), wherein the resin particle (B) comprises:

(b) a second resin comprising a crystalline polyester resin comprising a urethane bond and/or a urea bond; and (f) 15% by mass or more of a filler comprising a carbonate, and wherein the resin particles (A) or the coating film (P) comprise:

(a) a first resin which is a polyester resin.

15. The toner according to claim 9, wherein the filler (f) has an average primary particle diameter of 700 nm to 1,000 nm.

* * * * *